US011274471B2

(12) United States Patent
Trinh et al.

(10) Patent No.: US 11,274,471 B2
(45) Date of Patent: Mar. 15, 2022

(54) FURNITURE DRAWER SECUREMENT DEVICE

(71) Applicants: Albert Long Trinh, Maineville, OH (US); David Lam Trinh, Maineville, OH (US); Dennis Sam Trinh, Maineville, OH (US); Toan Trinh, Maineville, OH (US)

(72) Inventors: Albert Long Trinh, Maineville, OH (US); David Lam Trinh, Maineville, OH (US); Dennis Sam Trinh, Maineville, OH (US); Toan Trinh, Maineville, OH (US)

( * ) Notice: Subject to any disclaimer, the term of this patent is extended or adjusted under 35 U.S.C. 154(b) by 0 days.

(21) Appl. No.: 17/340,227

(22) Filed: Jun. 7, 2021

(65) Prior Publication Data

US 2021/0293055 A1 Sep. 23, 2021

Related U.S. Application Data

(63) Continuation-in-part of application No. PCT/US2019/065116, filed on Dec. 7, 2019.
(Continued)

(51) Int. Cl.
*E05B 65/46* (2017.01)
*A47B 88/919* (2017.01)
*E05B 67/38* (2006.01)

(52) U.S. Cl.
CPC ..... *E05B 65/46* (2013.01); *A47B 88/919* (2017.01)

(58) Field of Classification Search
CPC ..... E05B 65/44; E05B 65/46; E05B 65/461; E05B 65/462; E05B 65/467;
(Continued)

(56) References Cited

U.S. PATENT DOCUMENTS 321,628 A 7/1885 Nelson
413,128 A 10/1889 Brabson
(Continued)

FOREIGN PATENT DOCUMENTS

GB 148717 8/1920
GB 149779 8/1920
(Continued)

OTHER PUBLICATIONS

International Search Report & Written Opinion dated Jan. 8, 2014, for related International Application No. PCT/US2013/062081 filed Sep. 27, 2013 (16 pages).
(Continued)

*Primary Examiner* — Lloyd A Gall
(74) *Attorney, Agent, or Firm* — Daniel F. Nesbitt; Hasse & Nesbitt LLC

(57) ABSTRACT

A tamper-evident securement device for use in securing closed a drawer of a furniture, comprising: a flexible extending closure member comprising an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture; wherein a lock device can be inserted through the aperture of the flexible locking portion. The tamper-evident securement device may employ a shield plate. For installation of the tamper-evident securement device, an implement may be utilized.

20 Claims, 68 Drawing Sheets

Related U.S. Application Data

(60) Provisional application No. 62/776,828, filed on Dec. 7, 2018.

(58) Field of Classification Search
CPC ..... E05B 2065/469; E05B 15/0046; E05B 15/1607; E05B 67/383; Y10T 70/5128; Y10T 70/5097; Y10T 29/49947; G07G 1/0027; E05C 19/182; E05C 21/00; E05C 19/001; E05C 19/188; E05C 19/066; E05C 67/06; A47B 88/919
USPC ..... 70/14, 77–88, DIG. 9; 292/256, 258, 292/259 R, 260, 288–298, 307 R, 292/DIG. 38, DIG. 65; 312/215, 216, 333
See application file for complete search history.

(56) References Cited

U.S. PATENT DOCUMENTS 464,415 A 12/1891 Bate
777,342 A * 12/1904 Homer
787,847 A 4/1905 Kollme
827,624 A 7/1906 Foster
1,321,514 A 11/1919 Erickson
1,330,936 A 2/1920 Erickson
1,464,415 A 8/1923 Fontana
1,490,811 A 4/1924 Falsani
1,496,099 A 6/1924 O'Connor
1,772,252 A 8/1930 Henry
1,864,883 A 6/1932 Anderson
2,055,906 A 9/1936 Menchen
2,140,066 A 12/1938 White
2,720,102 A 10/1955 Spain
2,787,847 A 4/1957 Arps
2,845,295 A * 7/1958 Clarke ..... E05C 19/08 292/281
2,889,571 A 6/1959 Moore
2,903,286 A 9/1959 Richard et al.
2,918,318 A 12/1959 Sacharski
3,013,426 A 12/1961 Taylor
3,262,292 A 7/1966 Glass
3,381,992 A 5/1968 Friesen
3,397,001 A 8/1968 Friedman
3,423,968 A 1/1969 Foote
3,437,365 A 4/1969 Zadanoff et al.
3,475,929 A 11/1969 Weingart
3,497,059 A 2/1970 Watts, Jr.
3,649,095 A 3/1972 Gunzburg
3,834,746 A 9/1974 Hinden
3,847,462 A 11/1974 Repetti
3,850,463 A 11/1974 Hawkins
3,854,764 A 12/1974 Corrigan
3,856,373 A 12/1974 Tucich
3,933,402 A 1/1976 Peterson
3,997,206 A 12/1976 Hagopian
4,030,426 A 6/1977 Lyons
4,030,788 A 6/1977 Bleeker
4,142,391 A 3/1979 Paig
4,169,619 A 10/1979 McCracken
4,326,394 A 4/1982 Stein
4,505,526 A 3/1985 Leck
4,525,012 A 6/1985 Dunner
4,617,810 A 10/1986 Fish et al.
4,653,785 A 3/1987 Tobey
4,715,628 A 12/1987 Brink et al.
4,819,463 A 4/1989 Jacobs
4,873,850 A 10/1989 Lyons et al.
5,033,803 A 7/1991 Katsuyoshi et al.
5,102,210 A 4/1992 Beals
5,136,862 A 8/1992 Langen
5,154,497 A 10/1992 Smith
5,243,736 A 9/1993 Cannaday et al.
5,292,191 A 3/1994 Slivon
5,325,685 A 7/1994 Frank
5,369,970 A 12/1994 Voiculescu et al.
5,489,129 A 2/1996 Shepherd
5,493,880 A 2/1996 Jang
5,516,581 A 5/1996 Kreckel et al.
5,547,236 A 8/1996 Gregory
5,704,665 A 1/1998 Budolfson
5,709,442 A 1/1998 Feldpausch et al.
5,743,608 A 4/1998 Johannes
5,747,133 A 5/1998 Vinod et al.
5,784,907 A 7/1998 Hu et al.
5,819,561 A 10/1998 Blehi, III
5,842,359 A * 12/1998 Longueira ..... E05C 19/182 70/14
5,944,396 A 8/1999 Stephan
5,984,387 A 11/1999 Zeller
6,001,471 A 12/1999 Bries et al.
6,106,630 A 8/2000 Frankel
6,179,399 B1 1/2001 Brustle et al.
6,406,781 B1 6/2002 Hamerski
6,416,089 B1 7/2002 Williams, Jr.
6,481,811 B1 11/2002 Marsh
6,527,900 B1 3/2003 Kreckel et al.
6,541,089 B1 4/2003 Hamerski et al.
6,547,289 B1 4/2003 Greenheck et al.
6,655,762 B2 12/2003 Krueger
6,755,450 B1 6/2004 Chen
7,567,744 B2 7/2009 Krampotich et al.
8,220,297 B2 7/2012 Palumbo et al.
8,496,276 B2 7/2013 Kaminsky, Jr.
8,510,994 B2 8/2013 Scott
8,534,721 B1 9/2013 Boggs
8,544,899 B2 10/2013 Hertrich
9,133,651 B2 9/2015 Trinh et al.
10,094,146 B2 10/2018 Trinh et al.
10,151,127 B1 * 12/2018 Shell ..... E05C 19/182
2003/0213094 A1 11/2003 Wills
2006/0261716 A1 11/2006 Chen et al.
2007/0085352 A1 4/2007 Ulanday et al.
2007/0096478 A1 5/2007 White
2008/0053167 A1 3/2008 Basche
2009/0217713 A1 9/2009 Loughlin et al.
2010/0301996 A1 12/2010 Stradiota
2014/0091694 A1 4/2014 Trinh et al.
2014/0260444 A1 9/2014 Trinh et al.
2014/0318194 A1 10/2014 Harris
2015/0082840 A1 3/2015 Trinh et al.
2016/0002956 A1 1/2016 Trinh et al.
2016/0002957 A1 1/2016 Trinh et al.

FOREIGN PATENT DOCUMENTS

RU 82799 U1 5/2009
WO 98/28511 A1 7/1998
WO 2014052696 A1 4/2014
WO 2014152711 A2 9/2014
WO 2018100439 A1 6/2018

OTHER PUBLICATIONS

International Search Report & Written Opinion dated Sep. 16, 2014, for related International Application No. PCT/US2014/027648 filed Mar. 14, 2014 (11 pages).
International Search Report & Written Opinion dated Mar. 12, 2020, for corresponding International Application No. PCT/US2019/065116 filed Dec. 7, 2019 (9 pages).
International Preliminary Report on Patentability (Chapter 1) dated Jun. 8, 2021, for corresponding International Application No. PCT/US2019/065116 filed Dec. 7, 2019 (7 pages).

* cited by examiner

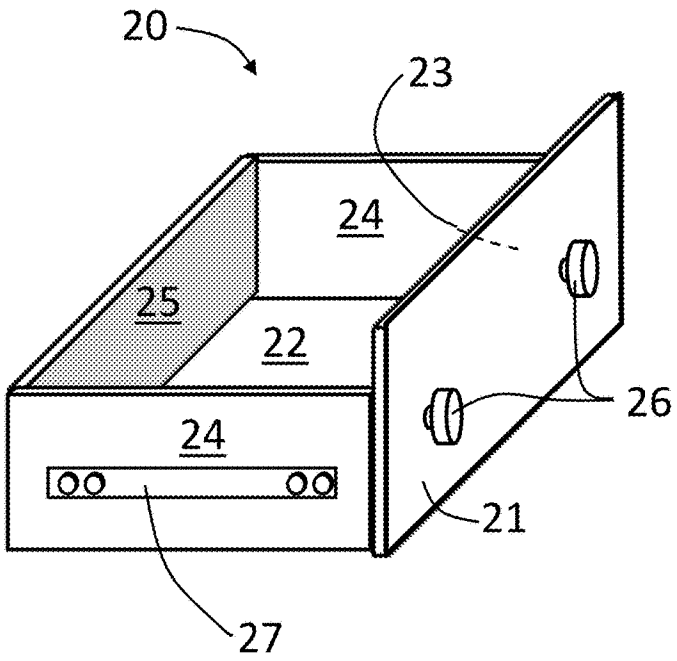
FIG. 2 - Prior Art
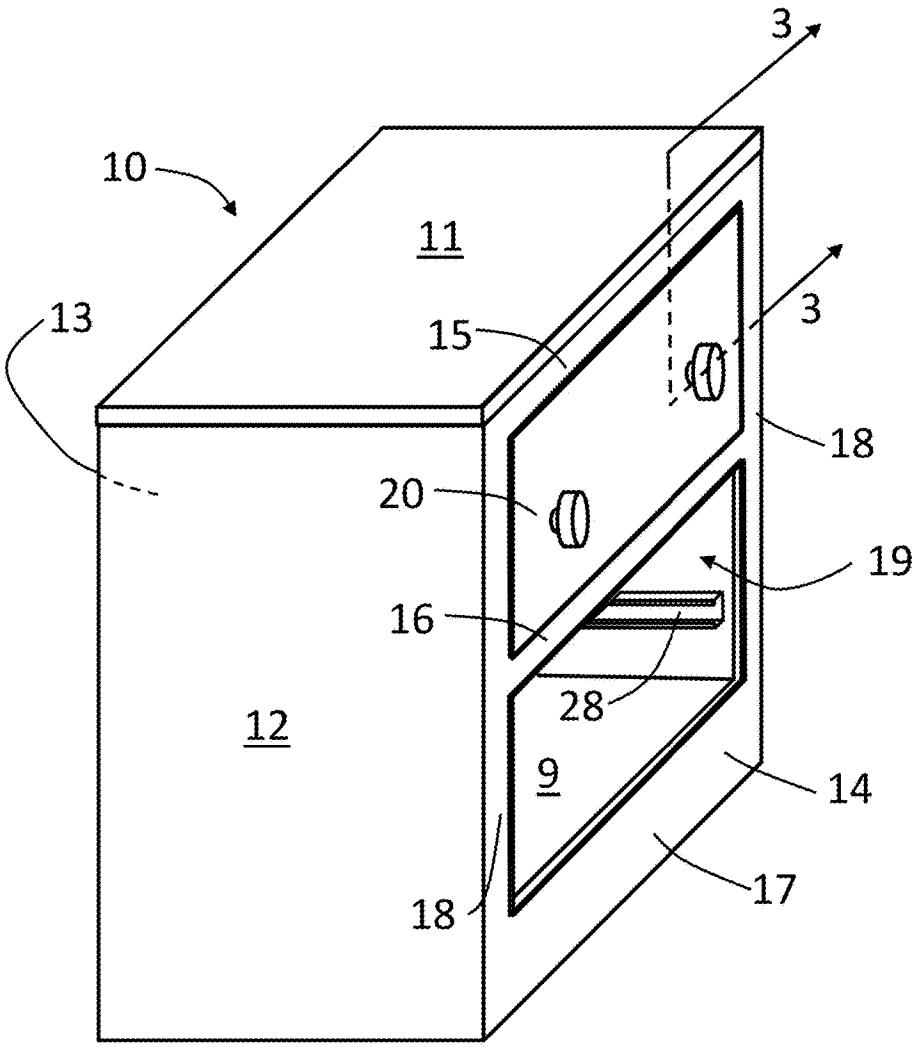
FIG. 1 - Prior Art

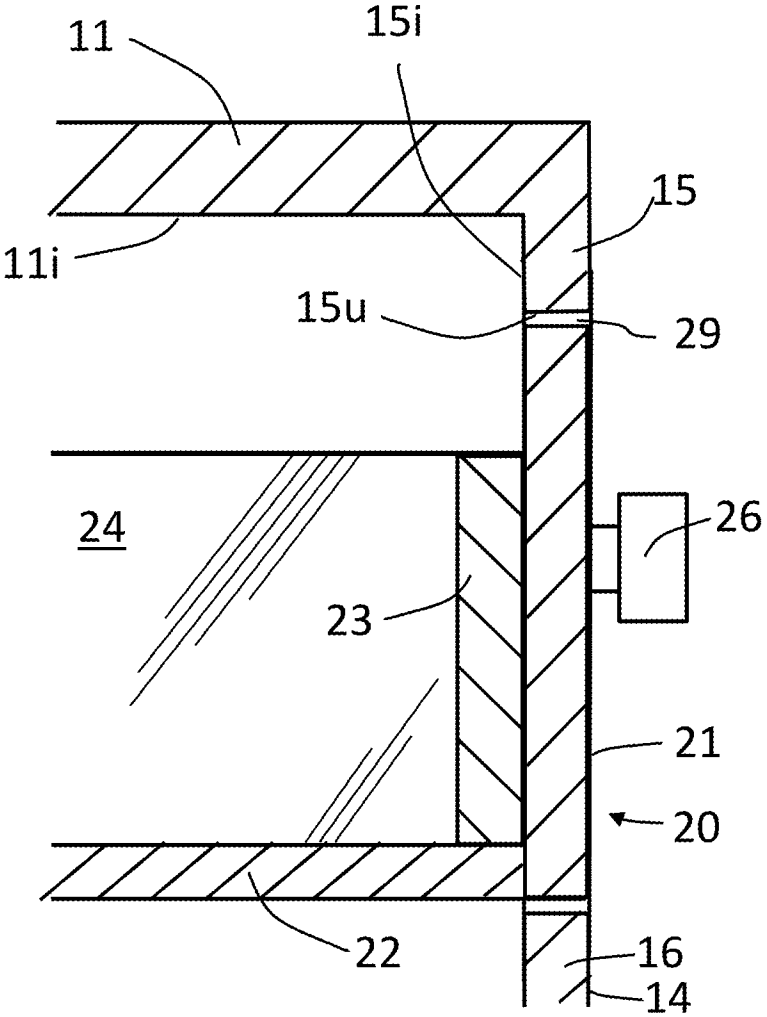
FIG. 4 - Prior Art
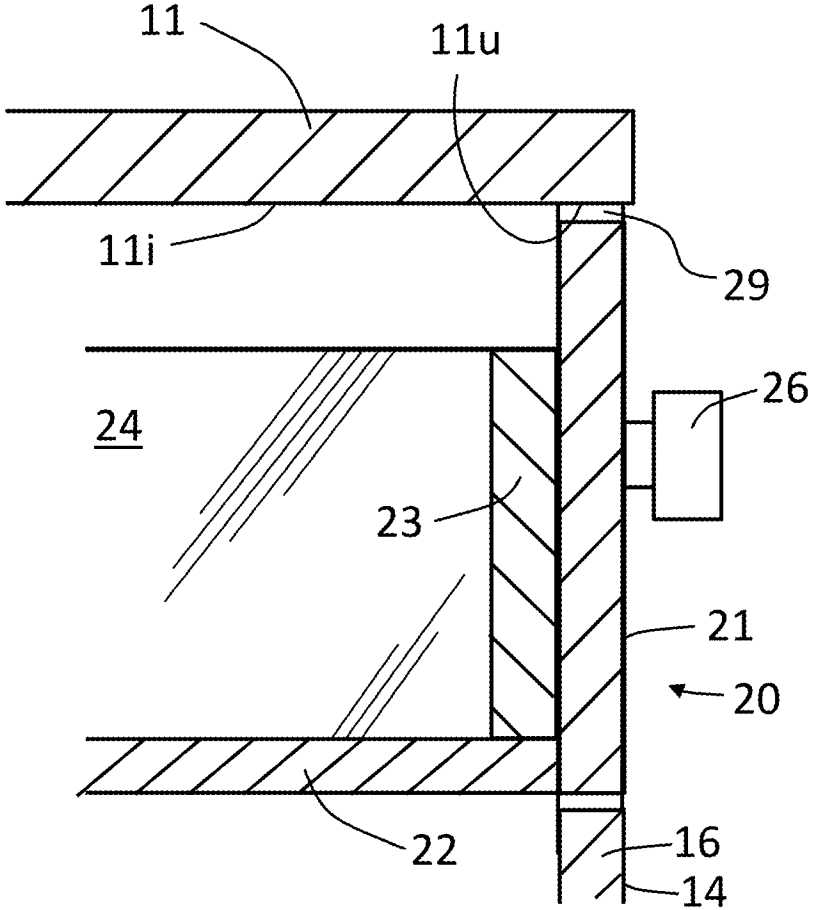
FIG. 3 - Prior Art

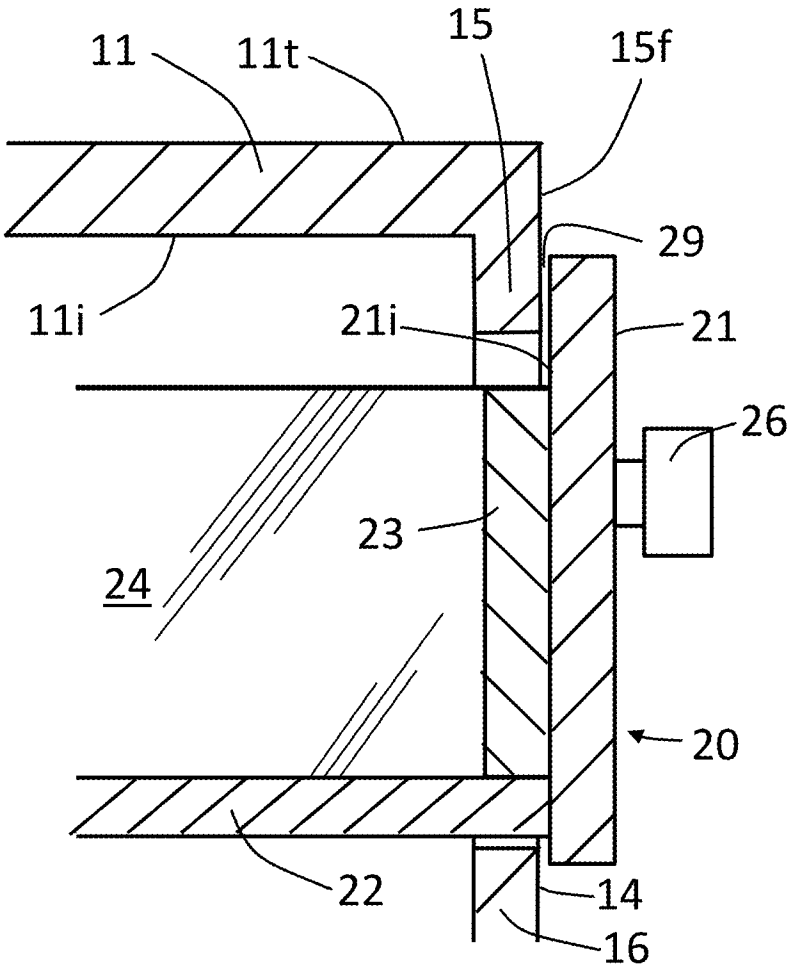
FIG. 6 - Prior Art
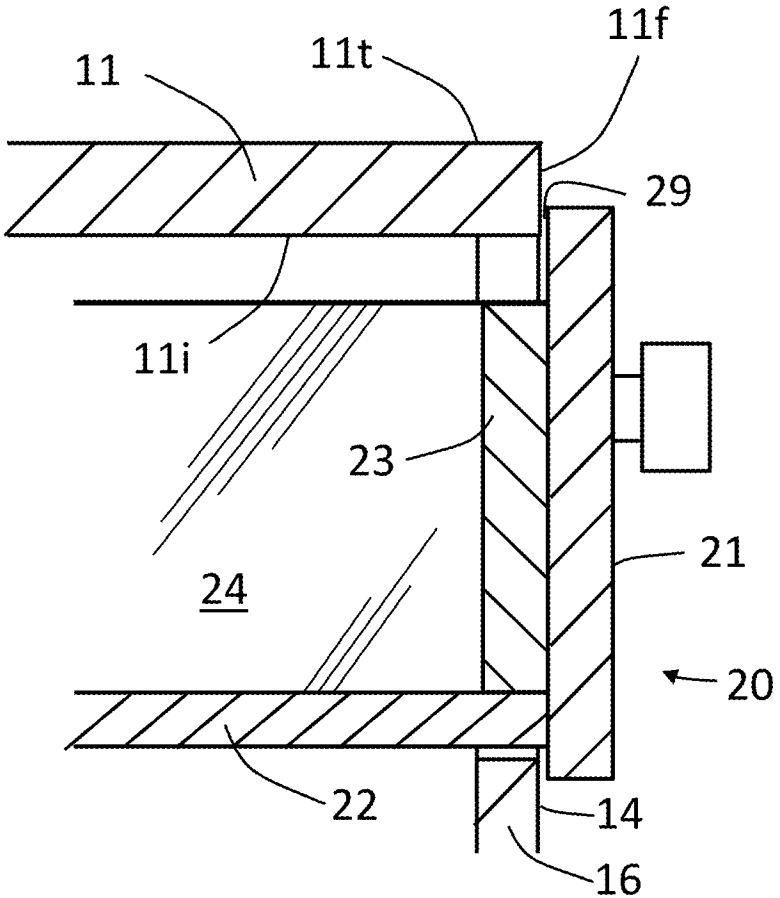
FIG. 5 - Prior Art

FURNITURE DRAWER SECUREMENT DEVICE

CROSS-REFERENCE TO RELATED APPLICATIONS

The present application is a continuation-in-part of International Application No. PCT/US2019/065116 filed Dec. 7, 2019, which claims the benefit of U.S. Provisional Application No. 62/776,828 filed Dec. 7, 2018, the disclosures of which are hereby incorporated by reference in their entireties.

FIELD OF THE INVENTION

The present invention relates generally to a securing device for drawers of furniture.

BACKGROUND OF THE INVENTION

Persons when traveling or staying outside their home place their personal belongings into whatever furniture happens to be available. For travelers, the accommodations may be a hotel, motel, a bed-and-breakfast, or the home or apartment of a friend or relative. Persons staying outside the home can include students residing in a dormitory or apartment, and a person visiting relatives or friends. In the case of a hotel, motel or a bed-and-breakfast, the person can typically lock the room so that outsiders cannot gain access to the room, although cleaning, maintenance and security personnel may have keys to access the room. In apartment rooms, dormitory rooms or within the homes or apartments of relatives or friends, the living area may be locked but may be shared with one or more other persons, or the living area may be unlocked, allowing free access thereto.

In many hotels, a guest may have a security box or vault within the room or the hotel itself, within which the guest can securely lock away valuables such as jewelry and electronic devices, cash, etc. For guests or travelers in hotels, apartments, dormitory rooms or the homes of friends and relatives, the guest, student or traveler may provide their own lockable luggage, security box, or baggage, within which cash, valuable or personal or business documents and articles can be secured, away from access to others.

At other times, the guest, traveler, or student simply wants to secure their personal items and valuables in a furniture drawer, away from the persons having legitimate access to the area, such as roommates, family members, etc., who may snoop around or may be curious about another person's belongings. A temporary lock for a furniture drawer in such a case needs not be unbreakable or unassailable, but should reveal signs of tampering or forced entry if an unauthorized access is attempted. The temporary lock is used as a means to deter and discourage unauthorized access to a curious snooper.

One location where a person might store valuables, sensitive or confidential documents, etc. is in a drawer of furniture provided in the accommodations, such as a dresser, cabinet or desk. While office furniture is typically provided with built-in locks that prevent a drawer from being opened, most dresser drawers, and drawers in many cabinets and desks, are not made with integral locks. Thus, there is a need for a temporary lock to deter and discourage the unauthorized access to a curious snooper by requiring a definitely strong effort to open a drawer protected by such lock, and once opened the drawer cannot be returned to the locked condition by the intruder.

Most household goods are designed and manufactured by many producers and have many different sizes, shapes, and styles. For instance, every hardware store carries many types of toilet flapper for many different toilet water tanks, which vary in size and shape depending on the different toilet models made by many different manufacturers. Each type and design of toilet tank requires a specific toilet flapper. Similarly, there are many types and sizes of drawer for different kinds of furniture. U.S. Pat. No. 9,133,651 issued Sep. 15, 2015 and U.S. Pat. No. 10,094,146 issued Oct. 9, 2018 categorize the many different dresser openings and drawers into four general styles, especially for the top-level drawers and top-level openings, and describe various temporary tamper-evident securement devices that are specifically designed for each general styles. U.S. Pat. No. 9,133,651 discloses tamper-evident securement devices specifically designed for one general style, while U.S. Pat. No. 10,094,146 discloses tamper-evident securement devices specifically designed for another general style; both said patents are incorporated herein by reference. U.S. Pat. Publ. Nos. 20150082840 and 20160002957, also disclose temporary tamper-evident securement devices for different types of file cabinets; both said patent applications are incorporated herein by reference.

It is rather inconvenient to have to carry several types of temporary tamper-evident securement devices when going on a trip, where the type of furniture at the destination is unknown, or having to wait until after arrival at an accommodation before searching for an appropriate temporary tamper-evident securement device. It is therefore very desirable to have a universal temporary tamper-evident securement device that can be used for almost all types of furniture and drawers.

SUMMARY OF THE INVENTION

An embodiment provides a tamper-evident securement device for use in securing closed a drawer of a furniture, comprising: 1) a flexible extending closure member comprising an at least partially flexible attaching portion disposed within the furniture, and a flexible locking portion comprising a distal end section that traverses a gap between the drawer and a drawer opening when the drawer is closed and provides an aperture that is disposed outside the furniture; and 2) a securement member disposed within the furniture that attaches the extending closure member to an inner surface of a top side of the furniture; wherein a lock device can be inserted through the aperture of the flexible locking portion.

In an embodiment, the securement member comprises a pressure-sensitive adhesive layer that is integral with a dorsal surface of the attaching portion.

In another embodiment, the aperture may comprise a hole, a loop, or an aperture.

In another embodiment, the securement member comprises a mechanical fastener system comprising a fastener base that attaches the extending closure member to the inner surface of the top side of the furniture; and wherein the attaching portion is adjustably and removably secured on the securement member at one of a plurality of positions on the attaching portion relative to the securement member.

In another embodiment, the mechanical fastener system in addition to the fastener base further comprises a substantially planar attachment base that attaches the fastener base to the inner surface of the top side of the furniture.

In an embodiment, the fastener base comprises a ventral surface selected from the group of: a plurality of hook elements, a plurality of loop elements, and a locking head comprising an opening to a passage and a locking tab disposed in the passage; and the attaching portion comprises either: a dorsal surface selected from the group of a plurality of hook elements or a plurality of loop elements; or a ventral surface comprising a plurality of serrations; such that the ventral surface of the fastener base complements the dorsal surface or the ventral surface of the attaching portion.

In another embodiment, the attaching portion comprises a surface comprising serrations, and the fastener base comprises a locking head comprising an opening to a passage within the locking head and a locking tab disposed in the passage and hingedly attached to the locking head, such that the locking tab permits ratcheting engagement of the locking head with the serrations.

In another embodiment, the fastener base further comprises a dorsal surface facing opposite to the ventral surface of the fastener base, the dorsal surface selected from the group of: a) at least one adhesive layer that can adhere the fastener base to the inner surface of the top side of the furniture; b) a plurality of hook elements wherein the inner surface of the top side of the furniture comprises a plurality of loop elements; c) a plurality of loop elements wherein the inner surface of the top side of the furniture comprises a plurality of hook elements; or d) at least one drill hole for a fastener screw.

In an embodiment, the attachment base comprises a dorsal surface comprising at least one adhesive layer that attaches the attachment base to the inner surface of the top side of the furniture; and a ventral surface facing opposite the dorsal surface, selected from the group of: a plurality of hook elements wherein the dorsal surface of the fastener base has a plurality of loop elements, a plurality of loop elements wherein the dorsal surface of the fastener base has a plurality of hook elements, a magnetic substrate, and at least one adhesive layer.

In an embodiment comprising a locking head, the locking tab is hingedly attached to the locking head, and comprises one or more transversely-arranged teeth that partially extend into the passage, to ratchetingly engage the serrations of the attaching portion.

In another embodiment comprising a locking head, the locking tab comprises a lever extending from the locking tab that can manually pivot the locking tab away from the passage and move the one or more teeth out of ratcheting engagement with the serrations of the attaching portion.

In another embodiment comprising a locking head, the lever extends from the locking tab in a direction toward the gap between the drawer and the drawer opening.

In an embodiment, the attaching portion further comprises a fingerplate. The fingerplate can optimize placement or adjustment of the attaching portion.

In an embodiment, the flexible locking portion is an elongated approximately planar portion comprising the distal end section comprising the aperture through which the lock device can be inserted.

In another embodiment, the flexible locking portion is an extended flexible cable comprising a proximal end section, a body section and the distal end section, wherein the proximal end section is fixed to the attaching portion, and the distal end section is joined to the body section forming a loop through which the lock device can be inserted.

In another embodiment comprising an extended flexible cable, both the proximal end section and the distal end section of the extended flexible cable are fixed to the attaching portion, and the body section of the cable forms the loop through which the lock device can be inserted.

In another embodiment comprising an extended flexible cable, the extended flexible cable is a flexible stainless steel cable.

In another embodiment comprising an extended flexible cable, the extended flexible cable has a thin coating layer of a thermoplastic material.

In an embodiment, the device further comprises a shield plate having one or more slot openings through which the flexible locking portion can extend, wherein the shield plate has one or both of a) a planar shape, or b) an angled shape.

In an embodiment, the device further comprises a separate aperture-withdrawing implement comprising a planar body comprising a handle at one edge, a raised cylindrical receptor to removably engage the aperture, and a semicircular depression surrounding the raised cylindrical receptor to accommodate the distal end section, wherein one or more planar supports are disposed perpendicularly to and extending laterally from an opposite edge of the planar body, wherein the one or more planar supports can be temporarily pressed flush against a front face or a top face of the furniture.

In an embodiment, the lock device comprises a padlock comprising a shackle that passes though the aperture of the flexible locking portion.

In an embodiment, the lock device comprises a combination lock comprising a shackle that passes though the aperture of the flexible locking portion.

In an embodiment, the lock device is not part of the tamper-evident securement device.

In an embodiment, the tamper-evident securement device is not built into or integral with the drawer or the furniture.

In an embodiment, a retracting implement is removably engaged with the flexible locking portion of the extending closure member, the retracting implement comprising a wire, or a raised arched hook and depression, to help guide placement of the shield plate during installation of the securement device. In some embodiments, the retracting implement temporarily houses the shield plate, and in another embodiment the shield plate and retracting implement are packaged in combination. In a further embodiment, the retracting implement is part of a combination implement, wherein the combination implement comprises one end that comprises the elements of the aperture-withdrawing implement (i.e., an aperture-withdrawing end), and another end that comprises the elements of the retracting implement (i.e., a retracting end).

A method for deterring unauthorized access to a drawer in a furniture employing a tamper-evident securement device comprises the steps of: a) with the drawer open, temporarily pressing and maintaining the flexible locking portion against an upper edge of a drawer opening or a front face of the furniture, such that the aperture is disposed just outside the drawer opening; b) extending the attaching portion into and past the drawer opening while maintaining the flexible locking portion against the upper edge or the front face, until the flexible extending closure member is taut; c) firmly attaching the attaching portion to an inner surface of a top side of the furniture using a securement member, while maintaining the flexible extending closure member taut and maintaining the flexible locking portion against the upper edge or the front face; d) releasing the flexible locking portion from the pressing against the upper edge or the front face; e) closing the drawer within the drawer opening while maintaining the aperture just outside of the drawer opening; and f) inserting a lock device through the aperture.

Another method for deterring unauthorized access to a drawer in a furniture employing a tamper-evident securement device comprises the steps of: a) with the drawer open, temporarily pressing and maintaining a planar support of an aperture-withdrawing end of at least one implement against a front face of the furniture or a top exterior face of the furniture, such that the aperture is disposed at a position outside the furniture; b) extending the attaching portion into and past the drawer opening while maintaining the planar support against the front face or the top exterior face, until the flexible extending closure member is taut; c) firmly attaching the attaching portion to an inner surface of a top side of the furniture using a securement member, while maintaining the flexible extending closure member taut and maintaining the planar support against the front face or the top exterior face; d) disengaging the aperture-withdrawing end of the at least one implement from the aperture; e) engaging the aperture with a retracting end of the at least one implement; f) gently pulling the retracting end to maintain the aperture at the same position outside the furniture as when maintained by the aperture-withdrawing end; g) closing the drawer within the drawer opening; h) sliding a slot of a shield plate across the retracting end until the shield plate is flush with at least one surface of the drawer; i) inserting a lock device through the aperture; and j) disengaging the retracting end of the at least one implement from the aperture.

Another method for deterring unauthorized access to a drawer in a furniture employing a tamper-evident securement device comprises the steps of: a) with the drawer open, attaching a securement member of the device to an inner surface of a top side of the furniture; b) while temporarily maintaining the aperture just outside a drawer opening, extending the attaching portion into and past the drawer opening; c) removably securing the attaching portion on the securement member at one of a plurality of positions on the attaching portion relative to the securement member, using a mechanical fastener system of the securement member, until the extending closure member is taut, while maintaining the aperture just outside the drawer opening; d) closing the drawer within a drawer opening while maintaining the aperture just outside of the drawer opening; and e) inserting a lock device through the aperture.

Another method for deterring unauthorized access to a drawer in a furniture employing a tamper-evident securement device comprises the steps of: a) with the drawer open, attaching a securement member of the device to an inner surface of a top side of the furniture; b) while temporarily pressing and maintaining a planar support of an aperture-withdrawing end of at least one implement against a front face of the furniture or a top exterior face of the furniture, extending the attaching portion into and past a drawer opening; c) removably securing the attaching portion on the securement member at one of a plurality of positions on the attaching portion relative to the securement member, using a mechanical fastener system of the securement member, until the extending closure member is taut with the aperture disposed at a position outside the furniture, while maintaining the planar support against the front face or the top exterior face; d) disengaging the aperture-withdrawing end from the aperture; e) engaging the aperture with a retracting end of the at least one implement; f) gently pulling the retracting end to maintain the aperture at the same position outside the furniture as when maintained by the aperture-withdrawing end; g) closing the drawer within the drawer opening; h) sliding a slot of a shield plate across the retracting end until the shield plate is flush with at least one surface of the drawer; i) inserting a lock device through the aperture; and j) disengaging the retracting end from the aperture.

In another method, the step of attaching the attaching portion on the securement member at one of a plurality of positions on the attaching portion, further comprises adjusting the attaching portion on the securement member, by securing the attaching portion on the securement member at a second position on the attaching portion relative to the securement member, such that the aperture just outside the drawer opening.

In another method, the step of closing the drawer within the drawer opening further comprises the steps of: i) engaging the aperture with a retracting implement; ii) gently pulling the implement away from the drawer to maintain the aperture just outside the drawer opening; iii) closing the drawer within the drawer opening; and iv) sliding a slot of a shield plate across the implement until the shield plate is flush with at least one surface of the drawer. After the step of inserting a lock device in this method, a final step comprises disengaging the implement from the aperture.

An embodiment provides an article of manufacture comprising: a) a tamper-evident securement device described herein, b) instructions for use by a consumer of the device with a furniture having a drawer, wherein the instructions direct the consumer to attach the device to the furniture, and to close and lock the drawer in the furniture for tamper-evident securement, and c) packaging that contains the aforementioned elements.

In another article of manufacture, the instructions are according to one of the methods described herein.

Another article of manufacture further provides a lock device such as a padlock or a combination lock.

An embodiment provides a tamper-evident securement device in combination with a furniture having a drawer, for securing closed a drawer of the furniture.

BRIEF DESCRIPTION OF THE DRAWINGS

FIG. 1 shows a perspective view of a conventional furniture with drawer openings and a drawer.

FIG. 2 shows a perspective view of a conventional furniture drawer.

FIG. 3 shows a sectional view through the front of the top drawer of a first type of furniture and drawer, through line 3-3 of FIG. 1.

FIG. 4 shows a sectional view through the front of the top drawer of a second type of furniture and drawer, through line-3-3 of FIG. 1.

FIG. 5 shows a sectional view through the front of the top drawer of a third type of furniture and drawer, through line-3-3 of FIG. 1.

FIG. 6 shows a sectional view through the front of the top drawer of a fourth type of furniture and drawer, through line-3-3 of FIG. 1.

DETAILED DESCRIPTION OF THE INVENTION

Figure 7:
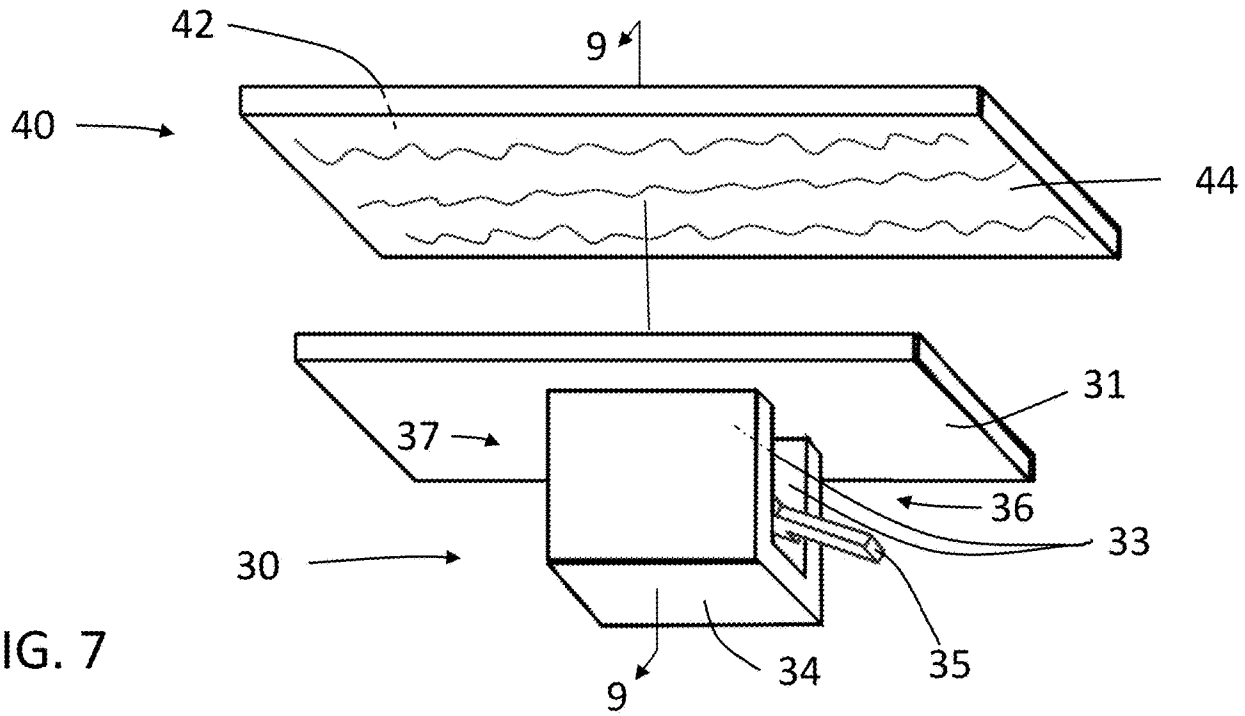
FIG. 7 shows a securement member comprising a locking head, a fastener base and an attachment base.

The phrase "opening of a drawer" means the outward movement of a drawer, from within a drawer opening of a furniture, that is uninhibited by a securing or securement device other than the present invention, and is more than a wiggling of the drawer, and is more than "cracking open" the drawer by a centimeter, or by a couple of centimeters.

For "flexible" or "flexibility" it is meant that an element is capable of bending readily and continuously along its length without breaking and without rigid portions along its length, and is able to easily adopt the physical environments and adapt the shape of surrounding structures it is in contact with. Preferably, a flexible element is also resilient or at least partially resilient, wherein the element tends to fully or at least partially regain its original, pre-use form, after the sources of pressure that results in the bending or other change in form are released.

The word "aperture" generally describes a hollow space through a portion or section of an extending closure member of the device. A distal section of an extending closure member can have a solid shape that is typically rectangular, and the "aperture" would be a defined opening through the shape at the distal end. An alternative extending closure member can comprise a distal section having a cable, rope, wire, or similar shape wherein the distal section is a formed loop; the loop is defined as an "aperture". If the loop comprises more than the distal section of an extending closure member, the distal section of the loop (with the extending closure member taut) is defined as the "aperture."

The phrase "tamper-evident securement" describes a securement device that has a primary purpose of clearly indicating unauthorized attempts at opening a drawer in a furniture. The indication of unauthorized attempted openings is intended to discourage such attempts, and thus the device may have a "deterrent use". The actual securement of the drawer is not a primary purpose, since most furniture drawers can be pried open with sufficient force and/or tools, no matter the securement device. A device that has secured a drawer with "tamper-evident securement" only allows a drawer to open if 1) the installer properly unlocks the device by unlocking the lock device such as padlock, or 2) the unauthorized user cuts or mangles the device to gain access; in this second option the device would clearly indicate the tampering.

By "permanently" it is meant that a device element or member that is attached to a surface of a furniture is intended to stay fixed to the surface and not be removed. Removal of the element "permanently" attached to the furniture could only be accomplished by disfiguring and damaging the surface of the furniture. For example, though most of a securement device can be removed, an element of the device, such as an attachment base, may be "permanently" adhered to a surface of the furniture. That is, the surface would have to be removed by chipping or carving into the furniture, in order to remove the "permanently" adhered element.

By "temporarily" it is meant that an element or member of the device that is attached to a surface of a furniture may be removed without damaging or disfiguring the surface. For example, an attachment base that is "temporarily" adhered to a surface of the furniture by using a stretch-releasable adhesive strip, may be removed after use of the device without causing damage or scratching of the surface.

An element that is "integral to" or "integral with" another element of the device cannot be physically separate from the other element without destroying the function of the element. For example, a locking head may be "integral" with a fastener base, meaning that the locking head must be attached to the fastener base for the locking head to function.

Where an element specified as "just outside" a location, it is meant that, in a first and second types of furnitures and drawers (further described herein), the element is less than about 5 mm apart from the location, or more preferably less than about 3 mm apart, or most preferably less than about 2 mm apart, while in a third and fourth types of furnitures and drawers (further described herein), the element is less than about 9 mm apart from the location, or more preferably less than about 8 mm apart, or most preferably less than about 7 mm apart. In several embodiments, a precisely-formed separate tool, such as an implement, may dispose the element "just outside" the location without requiring measurements. Alternative precisely-formed tools may dispose the element slightly further than "just outside" the location, so that a second element such as a shield plate can be accommodated.

A "dorsal surface" of an element of the device is meant to be the surface facing the top side of a furniture, such as facing an inner surface of the top side. A "ventral surface" of an element of the device is meant to be the surface facing the interior of the drawer and away from the top side of the furniture.

A conventional furniture and drawer are shown in FIGS. 1 and 2. Conventional furnitures and drawers come in a variety of styles and sizes. FIG. 1 shows the general construction of a furniture 10, having an enclosed frame having drawer openings 19 and comprising a top side 11, side panels 12, a back 13, a front 14, and a bottom-drawer floor 9. The front 14 has drawer openings 19 for receiving drawers 20 (shown in FIG. 2), the openings defined by vertical portions 18 called stiles, and by horizontal rails, comprising a top rail 15, an intermediate or cross rail 16, and a bottom rail 17.

The drawer 20, as shown in FIG. 2, is an open-topped box, and comprises a bottom 22, a front wall 23, side walls 24, a rear wall 25, and a front (false) face 21 attached to the front wall 23. The front face 21 is commonly taller than the front wall 23. In some drawers, the front face can serve as the front wall of the open-topped box. Handles 26 are attached to or formed into the front face 21 for manually pulling the drawer 20 open when the drawer is disposed within drawer opening 19 of the furniture in a closed position. The drawer 20 moves laterally within the opening on a track 27 fastened to the drawer sides 24 that moves along a guide 28 mounted on the inside the opening of the furniture. The track and guide system maintains the drawer in horizontal orientation when disposed within the furniture opening.

There are four general styles of furniture openings and drawers shown in FIGS. 3-6, to illustrate the utility of the present invention, but in no way to limit the scope of the invention. The furniture drawers and openings considered in FIGS. 3-6 relate mainly to top-level drawers and top-level openings. The top-level drawer and opening are closest to the top side of the furniture, relative to other drawers and openings in the furniture. However, the devices of the present invention may be also applicable to lower-level drawers and other drawers that are not top-level.

FIG. 3 shows a cross sectional view of a first style of furniture and drawer, through line 3-3 of FIG. 1, with the drawer disposed within the drawer opening in the closed position, in which a planar inner surface 11*i* of a top side 11 of the furniture is substantially coincident with a gap 29 defined horizontally between an upper edge of the front face 21 of the drawer, and an upper edge 11*u* of the drawer opening. In this style, the outer surface of the front face 21 of the drawer can be substantially flush with the front 14 of the furniture. The periphery of the front face 21 of the drawer 20 is disposed within the opening of the furniture. A front face 11*f* of the top side 11 of the furniture can be substantially flush with or only slightly extended forward of the front face 21 of the drawer 20, as shown in FIG. 3, although in another embodiment of the first style of furniture and drawer, the front edge of the furniture top can extend forward horizontally over the upper edge of the front face 21 of the drawer 20.

FIG. 4 shows a second style of furniture and drawer, with the drawer disposed within the drawer opening in the closed position, in which the top rail 15 extends downward from the top side 11 of the furniture, such that planar inner surface 11*i* of the top side 11 of the furniture is not substantially coincident with the gap 29, which is defined horizontally between an upper edge of the front face 21 of the drawer, and a bottom edge 15*u* of the top rail 15. Importantly, the bottom edge 15*u* of the top rail 15 also defines the upper edge 15*u* of the drawer opening in this style. Also, the outer surface of the front face 21 of the drawer is substantially flush with the front 14 of the furniture, and specifically flush with the top rail 15, and the periphery of the front face 21 of the drawer 20 is disposed within the opening.

The horizontal gap 29 of furnitures of the first style (depicted in FIG. 3) and the second style (depicted in FIG. 4) is usually about 1.8 millimeters or wider, such as about 3.0 millimeters and wider, for furnitures of average quality. The horizontal gap 29 for high quality furniture can be narrower, about 1.2 millimeters and can be even narrower.

FIGS. 5 and 6 show a third style and a fourth style, respectively, of furniture opening and drawer in the closed position, wherein the front face 21 of the drawer 20 is larger than the opening. In the third style shown in FIG. 5, the top edge of the front face 21 extends over a forward or front face 11*f* of the top side 11 of the furniture. In the fourth style shown in FIG. 6, the top rail 15 extends downward from the top side 11 of the furniture, and the top edge portion of the front face 21 extends upward and over a front face 15*f* of the top rail 15. Typically, the side and bottom edges of the front face 21 may also extend over the outside surfaces of the stiles 18 and the cross rail 16. In the third style of furniture, the gap 29 is defined vertically between the front face 11*f* of the top side 11 and the upper, inner surface of the front face 21. In the fourth style of furniture, the gap 29 is defined vertically between the front face 15*f* of the top rail 15 and the upper, inner surface of the front face 21.

In an embodiment, a tamper-evident securement device is provided for use in securing closed a drawer of a furniture, comprising 1) a flexible extending closure member comprising an at least partially flexible attaching portion disposed within the furniture and a flexible locking portion that traverses the gap 29 and provides an opening such as a hole, loop or an aperture that is disposed outside the furniture; and 2) a securement member that attaches the extending closure member to an inner surface of the top side of the furniture. The tamper-evident securement device can additionally and preferably comprise a shield plate to provide a better securement of the closed drawer or a protection of the front face of the drawer.

Figure 79:
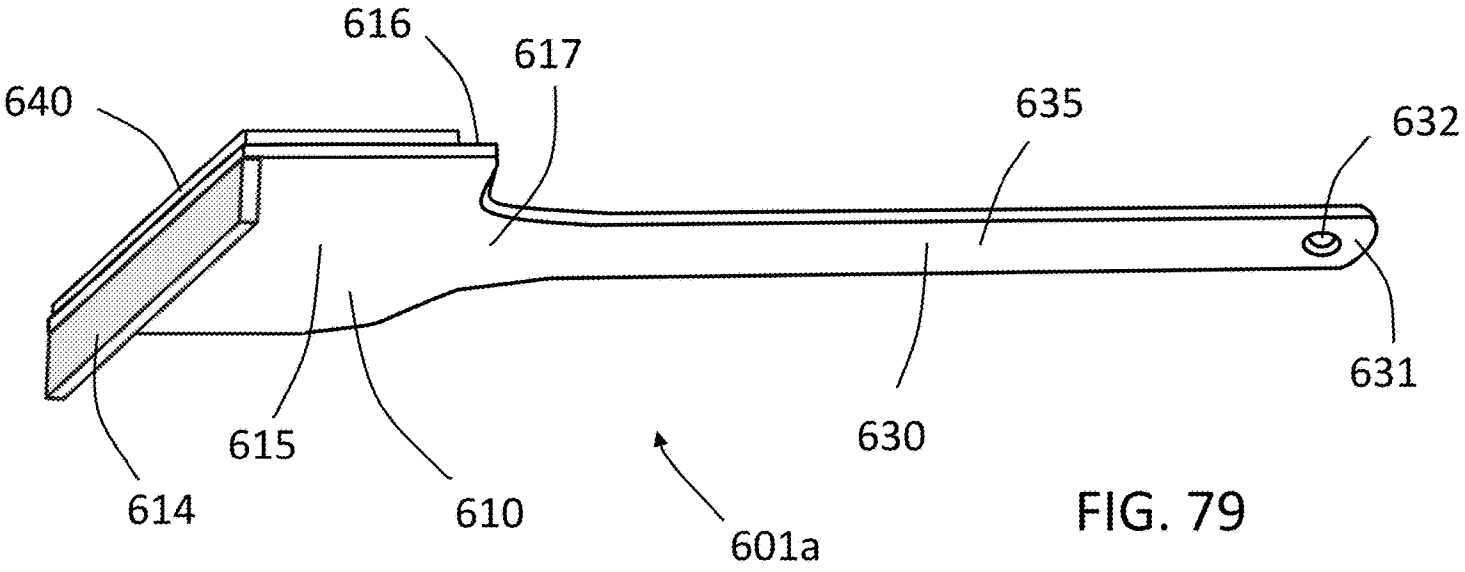
FIG. 79 shows a flexible extending closure member comprising an aperture at a distal end section of a flexible locking portion, and an adhesive layer at an attaching portion that can attach the extending closure member to the inner surface of the furniture.
Figure 80:
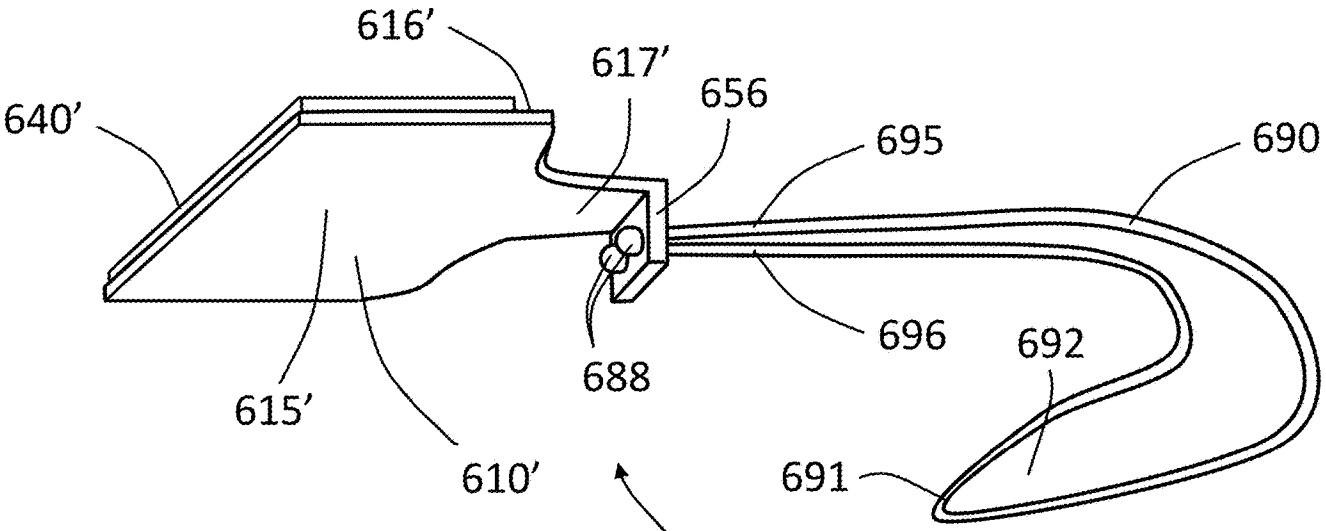
FIG. 80 shows the flexible extending closure member of FIG. 79 wherein the distal end section is an extended cable loop.

Another embodiment provides an extending closure member comprising an attaching portion comprising a securement member comprising a pressure-sensitive adhesive layer on a dorsal surface of the attaching portion, and a locking portion comprising an opening such as a hole, loop or an aperture through which a lock device can be inserted, wherein the adhesive layer of the attaching portion is attached directly onto the inner surface 11*i* of the top side of the furniture, as shown in FIGS. 79 and 80. The adhesive layer can be covered with a release paper which is removed prior to attaching the attaching portion to the inner surface 11*i*. The extending closure member may further comprise a body portion disposed between the attaching portion and the locking portion. The pressure-sensitive adhesive layer can be high tack in nature, and can be temporarily attached.

FIG. 79 shows an extending closure member 601*a* comprising an optional fingerplate 614. An extending closure member 601 (not shown) comprises an attaching portion 610 comprising a wide body section 615 having a dorsal surface 616 that comprises an adhesive layer 640 that is integral with the dorsal surface 616; and a flexible body section 617 that is fixed to a flexible locking portion 630 having a hole or aperture 632. The locking portion 630 comprises a body section 635 having universal flexibility to angle and/or traverse from the interior of the furniture through the gap between the drawer and drawer opening, for all types of drawers; and a distal end section 631 comprising a hole or aperture 632 through which a lock device can be inserted. The flexible body portion 617 may be tapered, as shown in FIG. 79. The flexible locking portion may be wide or narrow, and the distal end section of the flexible locking portion may have a rounded end. The extending closure member 601*a* comprises an optional fingerplate 614 typically disposed at a distal end section of the attaching portion 610 and typically having a width approximately equivalent to a width of the attaching portion 610, to ease or optimize placement of the extending closure member 601 to the inner surface of the furniture.

The adhesive layer 640 removably attaches the attaching portion 610 to the inner surface 11*i* of the furniture top 11, and typically comprises a layer of pressure-sensitive high tack adhesive. The adhesive is applied to the dorsal surface 616 in any effective pattern, preferably a uniform coating. An alternative adhesive layer 640 comprises a stretch-releasable adhesive strip. Once in use, removing or releasing the stretch-releasable adhesive strip from the furniture surface involves a pull tab on the end of the adhesive strip that is grasped and pulled, which stretches and releases the adhesive strip. Non-limiting examples of stretch-releasable adhesive elements are described in U.S. Pat. Nos. 6,541,089, 5,516,581, 5,747,133, 6,001,471, 6,106,630, and 6,406,781, the disclosures of which are incorporated by reference in their entireties. The attaching portion of the extending member can be elongated and/or widened, in order to increase the surface area of the associated securement means and attachment means. The adhesive-layered surface may be covered with a release paper, which is removed prior to using the adhesive. If necessary, the drawer 20 may be removed from the drawer opening 19 to facilitate installing the adhesive. The attaching portion is intended to remain secured to the furniture as long as the user chooses. Typical of adhesive substrates applied to a structure, the force required to vertically peel the attaching portion from the inner surface is substantially less than the horizontal pulling force required to overcome the shear strength of the adhered substrate of the attaching portion. Under normal use of the tamper-evident securement device, the attaching portion is not visible from outside the furniture.

FIG. 80 shows another flexible extending closure member 602 comprising an attaching portion 610' similar to that of FIG. 79, comprising a wide body section 615' having a dorsal surface 616' that comprises an adhesive layer 640' that is integral with the dorsal surface 616'; and a flexible body section 617'. The body section 617' further comprises an end plate 656 which extends perpendicularly from the body section 617' comprising a pair of holes (not shown) through which two legs or proximal ends 695, 696 of a flexible cable 690 are passed and fixed therein, with stop members 688 preventing detachment of the proximal ends 695, 696 from the end plate 656. The two legs 695, 696 of the flexible cable 690 extend to a distal end section 691 forming an extended loop 692 of the flexible extending closure member 602. The flexible body portion 617' may be tapered. The attaching portion 610' optionally comprises a fingerplate (not shown) typically disposed at a distal end section of the attaching portion 610' and typically having a width approximately equivalent to a width of the attaching portion 610'.

Figure 81:
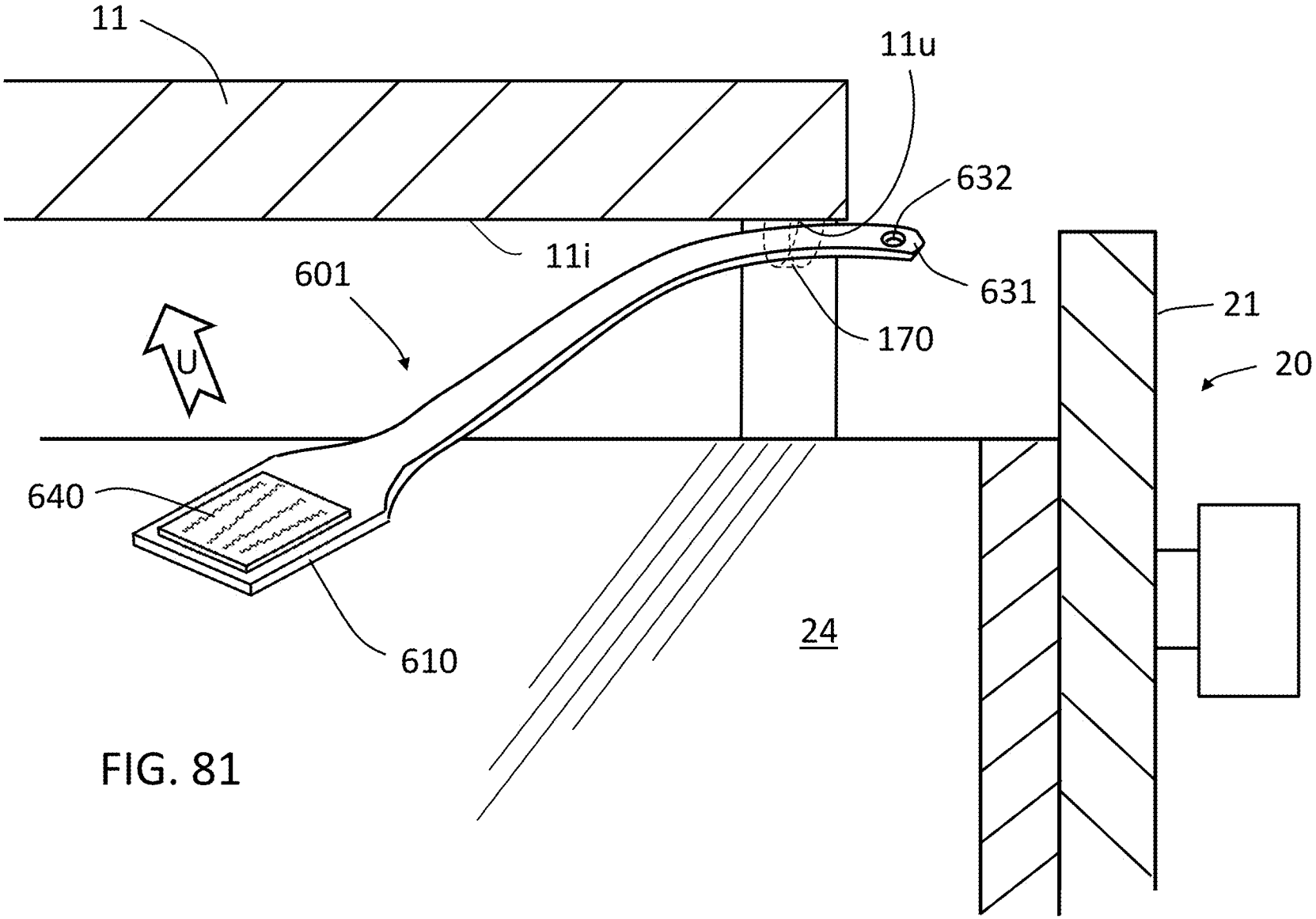
FIG. 81 shows the flexible extending closure member of FIG. 79 being positioned for attachment to the inner surface of the furniture of type 1.
Figure 82:
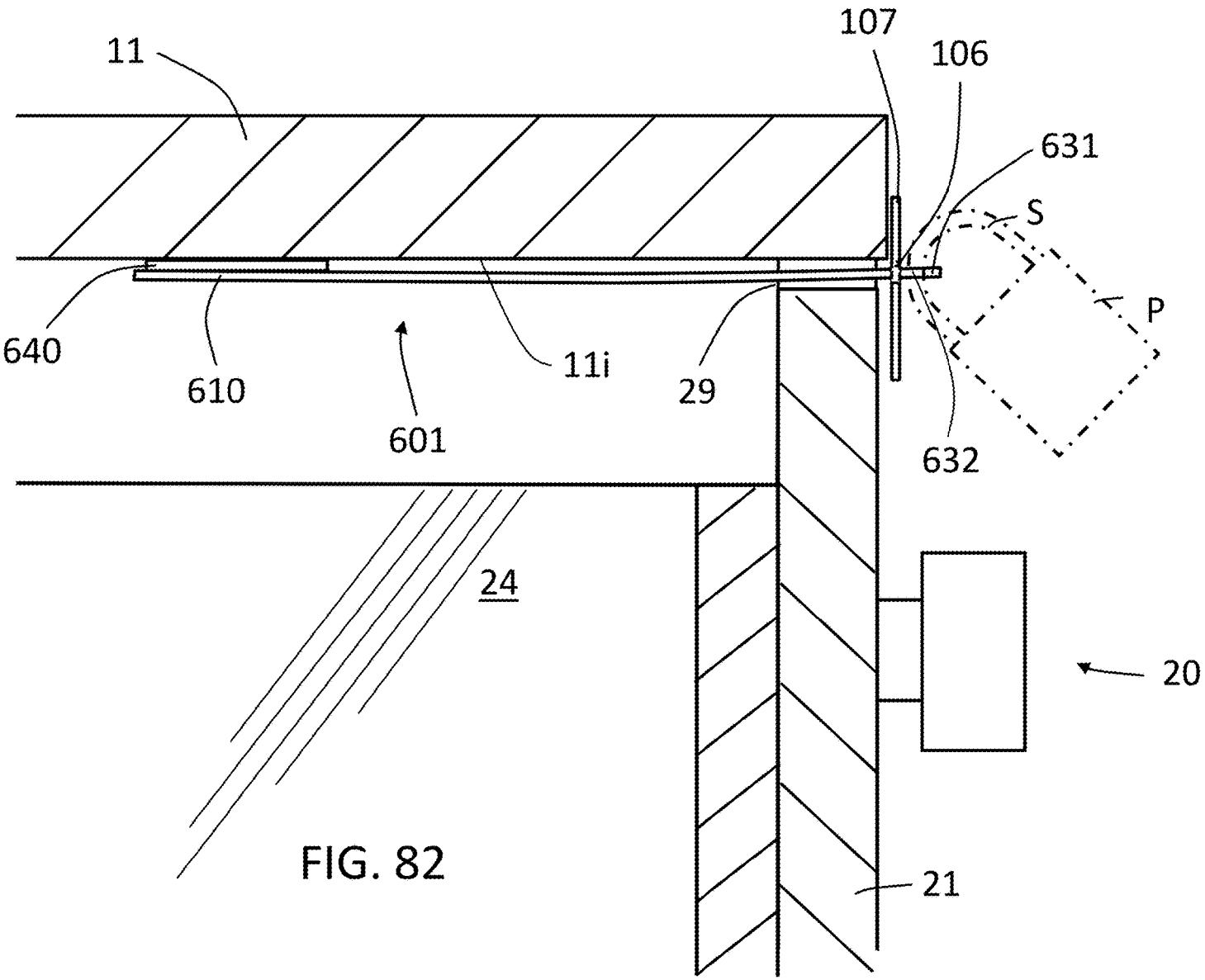
FIG. 82 shows the flexible extending closure member of FIG. 79 attached to the inner surface of the furniture of type 1 with the drawer closed. The shield plate of FIG. 24 is used with a padlock.

FIGS. 81 and 82 show a tamper-evident securement device securing a drawer of the first type of furniture and drawer shown in FIG. 3. FIG. 81 shows the drawer 20 pulled open, and the device 601 positioned with the distal end section 631 temporarily held just outside the drawer opening so that the aperture 632 protrudes just past an upper edge 11*u* of the drawer opening, just to have enough space for a lock device such as a shackle S of a padlock P to pass through. The distal end section 631 is pressed firmly against the upper edge 11*u* of the drawer opening by one hand of a user, while the other hand of the user pulls the attaching portion 610 inwardly to the furniture, into and past the drawer opening, until the device 601 is taut, and then moves the attaching portion 610 upwardly in the direction of arrow U while keeping the device 601 taut, until an adhesive layer 640 of the attaching portion 610 touches an inner surface 11*i* of the top side of the furniture. The adhesive layer 640 is firmly pressed to the inner surface 11*i* to affix the attaching portion 610 to the inner surface 11*i*. As shown in FIG. 82, the aperture 632 is maintained outside the drawer opening as the drawer 20 is closed forming a gap 29, and a lock device such as the shackle S of the padlock P is inserted through the aperture 632 and locked, to close and deter opening of the drawer 20 within the furniture. The distal end section 631 may be preferably extended past the upper edge 11*u* slightly further to accommodate a slot of an optional shield plate 107. The aperture 632 can be maintained outside the drawer opening by using an implement (not shown), which can also account for the inclusion of the shield plate.

As shown in FIG. 81, rather than manually pressing the distal end section 631 against the upper edge 11*u* during positioning of the device 601, the user can place a piece of adhesive tape 170 across the span of the upper edge 11*u*, to temporarily hold the distal end section 631 in place. Non-limiting examples of adhesive tape include duct tape and Scotch tape. The adhesive tape can be removed once the attaching portion 610 is affixed to the inner surface 11*i*, or can remain as part of the functioning device 601.

Figure 83:
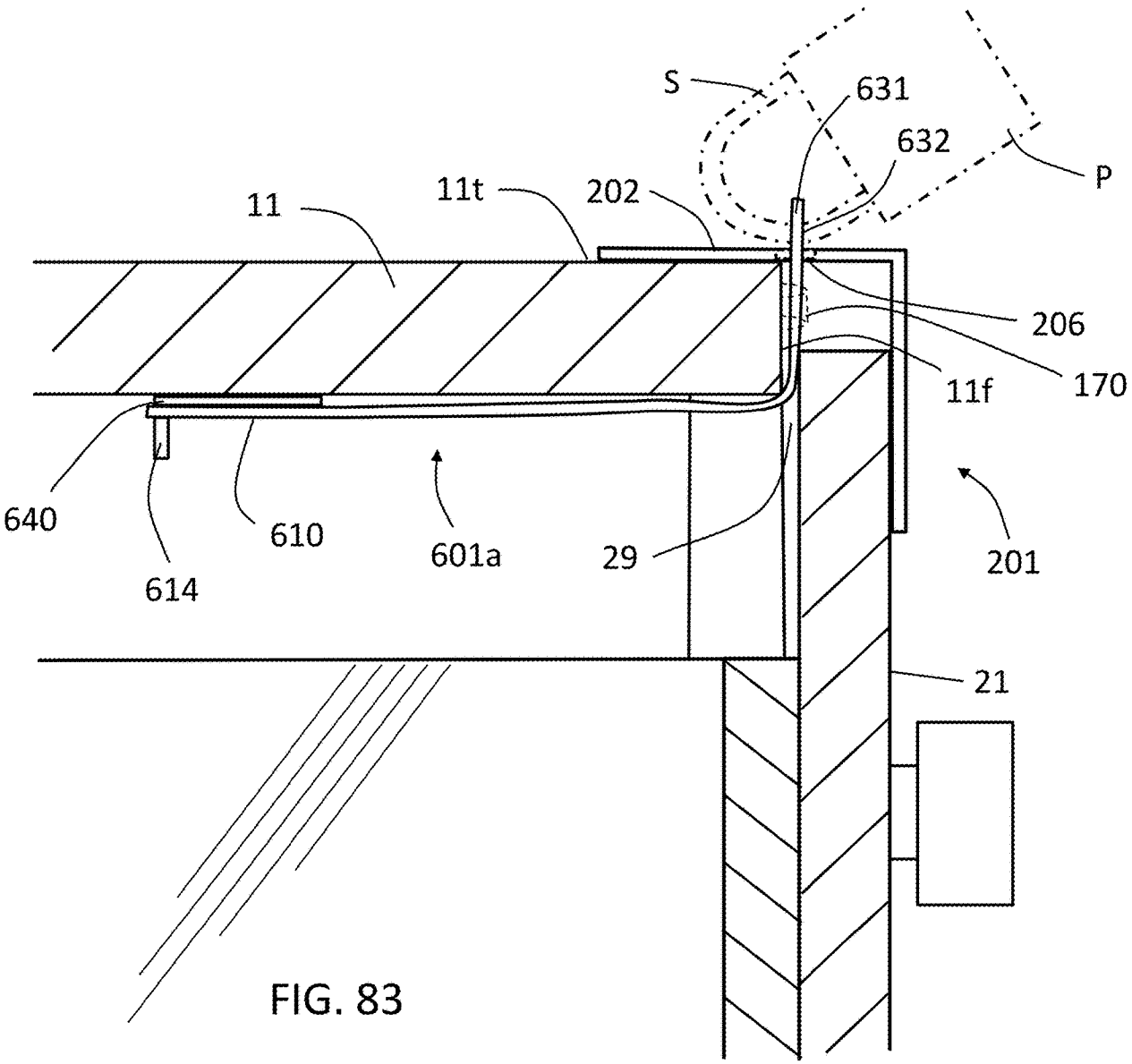
FIG. 83 shows the flexible extending closure member of FIG. 79 attached to the inner surface of the furniture of type 3 with the drawer closed. The shield plate of FIG. 25 is used with a padlock.

FIG. 83 shows the tamper-evident securement device used in a drawer of the third type of furniture shown in FIG. 5. This device 601*a* further comprises a fingerplate 614. In positioning device 601*a* in the third type of furniture, the distal end section 631 is to be temporarily held on the front face 11*f* of the top side 11 of the furniture, so that the aperture 632 protrudes just past a top exterior face 11*t* of the furniture. The distal end section 631 is passed through a slot 206 of an angled shield plate 202, and a lock device such as a shackle S of a padlock P is passed through the aperture 632. To maintain the distal end section 631 against the front face 11*f*, the user can place a piece of adhesive duct tape 170 across the span of the front face 11*f*. The fingerplate 614 can extend by about 1 cm to about 2 cm from a distal end section of the attaching portion 610, and can comprise a width approximately equivalent to a width of the attaching portion 610. The distal end section 631 may be preferably extended past the top exterior face 11*t* to accommodate an optional shield plate 201. The aperture 632 can be maintained outside the drawer opening by using an implement (not shown), which can also account for the inclusion of the shield plate.

Figure 84:
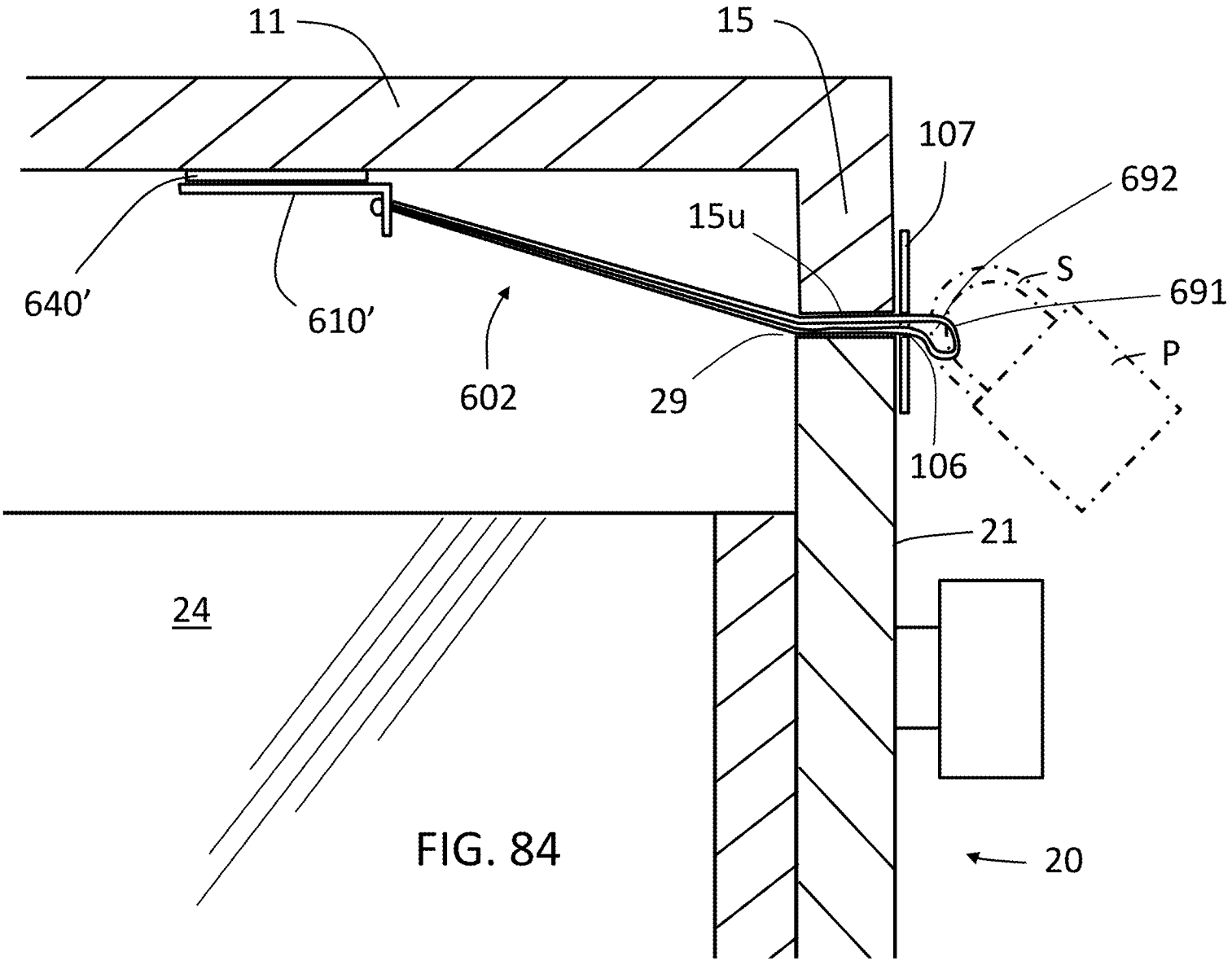
FIG. 84 shows the flexible extending closure member of FIG. 80 attached to the inner surface of the furniture of type 2 with the drawer closed. The shield plate of FIG. 24 is used with a padlock.

FIG. 84 shows the tamper-evident securement device used in a drawer of the second type of furniture shown in FIG. 4. In positioning device 602 in the second type of furniture, a portion of the flexible cable 690 is to be temporarily held against the bottom edge 15*u* of the top rail 15, so that the distal end section 691 forming the extended loop 692 protrudes just past the drawer opening, for a lock device such as a shackle S of a padlock P to pass through. In order to maintain the portion of the flexible cable 690 against the bottom edge 15*u*, the user can temporarily place a piece of adhesive tape 170 across the span of the bottom edge 15*u*. An optional shield plate 107 is shown in FIG. 84, the distal end section 691 passing through a slot 106 thereof. The distal end section 691 may be preferably extended past the bottom edge 15*u* to accommodate the optional shield plate 107. The loop 692 can be maintained outside the drawer opening by using an implement (not shown), which can also account for the inclusion of the shield plate.

Figure 85:
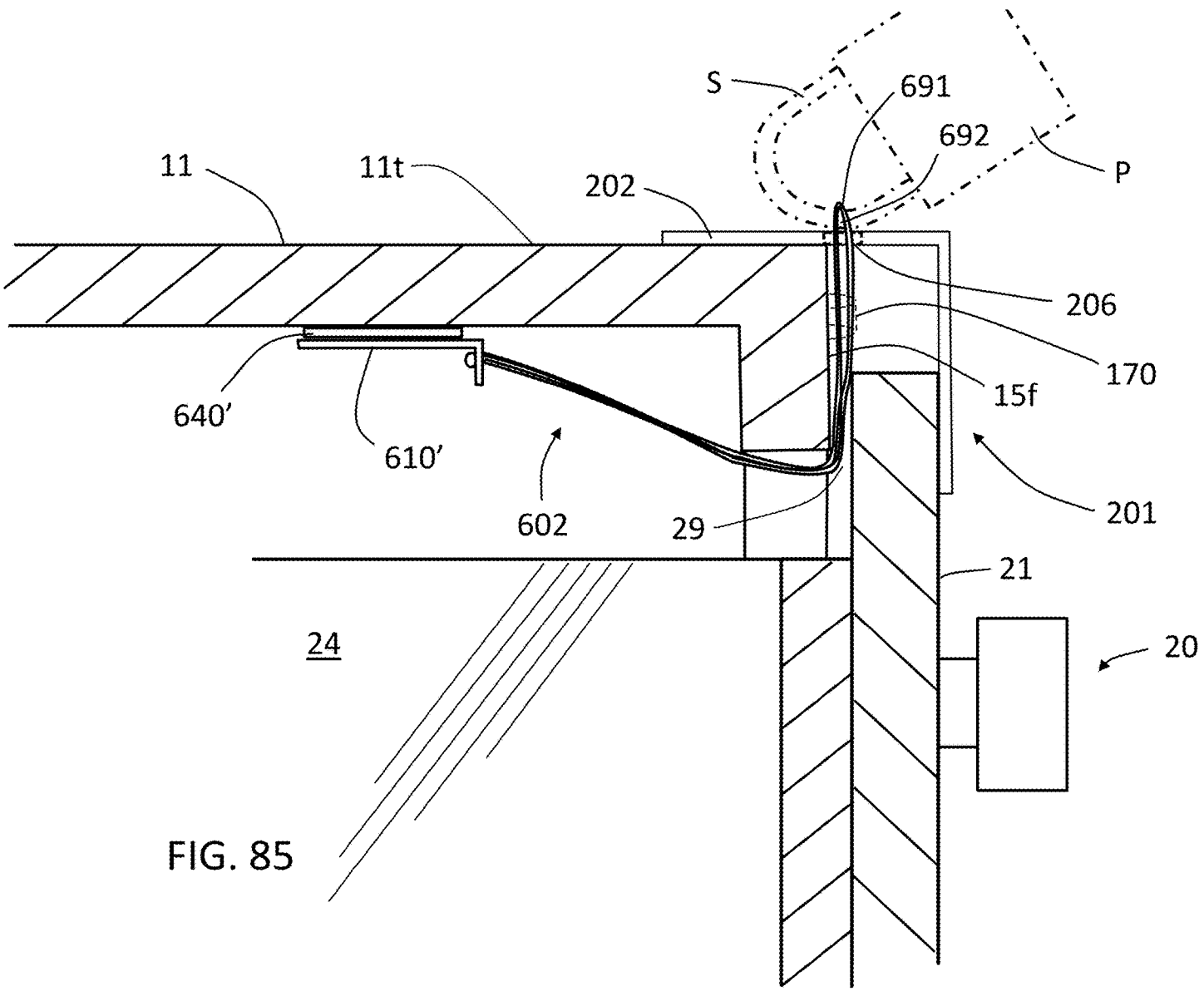
FIG. 85 shows the flexible extending closure member of FIG. 80 attached to the inner surface of the furniture of type 4 with the drawer closed. The shield plate of FIG. 25 is used with a padlock.

FIG. 85 shows the tamper-evident securement device used in a drawer of the fourth type of furniture shown in FIG. 6. In positioning device 602 in the fourth type of furniture, a portion of the flexible cable 690 is to be temporarily held on the front face 15*f* of the top rail 15 of the furniture, so that the distal end section 691 forming the extended loop 692 protrudes just past the top exterior face 11*t* of the furniture. The distal end section 691 is passed through a slot 206 of an angled shield plate 202, and a lock device such as a shackle S of padlock P is passed through the extended loop 692. To maintain the portion of the cable 690 against the front face 15*f*, the user can place a piece of adhesive tape 170 across the span of the front face 15*f*. The distal end section 691 may be preferably extended past the top exterior face 11*t* to accommodate the optional shield plate 201. The loop 692 can be maintained outside the drawer opening by using an implement (not shown), which can also account for the inclusion of the shield plate.

In another embodiment, the at least partially flexible attaching portion comprises a distal end section, a body section that can attach to a securement member, and a proximal end section, and wherein the flexible locking portion comprises a proximal end section that is fixed to the proximal end section of the attaching portion, a flexible body section, and a distal end section comprising an opening, such as a hole, loop or an aperture, through which a lock device, such as a padlock or a combination lock, can be inserted. One or more of the distal end section, body section, and proximal end section of the attaching portion can be at least partially flexible.

The securement member can comprise a mechanical fastener system comprising a fastener base and an attachment base, wherein the attachment base can be attached permanently or temporarily to the inner surface of the furniture top, and the fastener base is attached to the attachment base to fix the attaching portion of the extending closure member while permitting the attaching portion to adjust and change its position on or in the securement member. Non-limiting examples of the mechanical fastener system of the securement member include: a hook-and-loop fastener element, comprising one or the other of hook elements or loop elements; and a locking head comprising an opening to a passage comprising a locking tab that allows for ratcheting engagement of the locking tab with serrations of the attaching portion, a locking head is illustrated in FIGS. 7 and 8.

Figure 25:
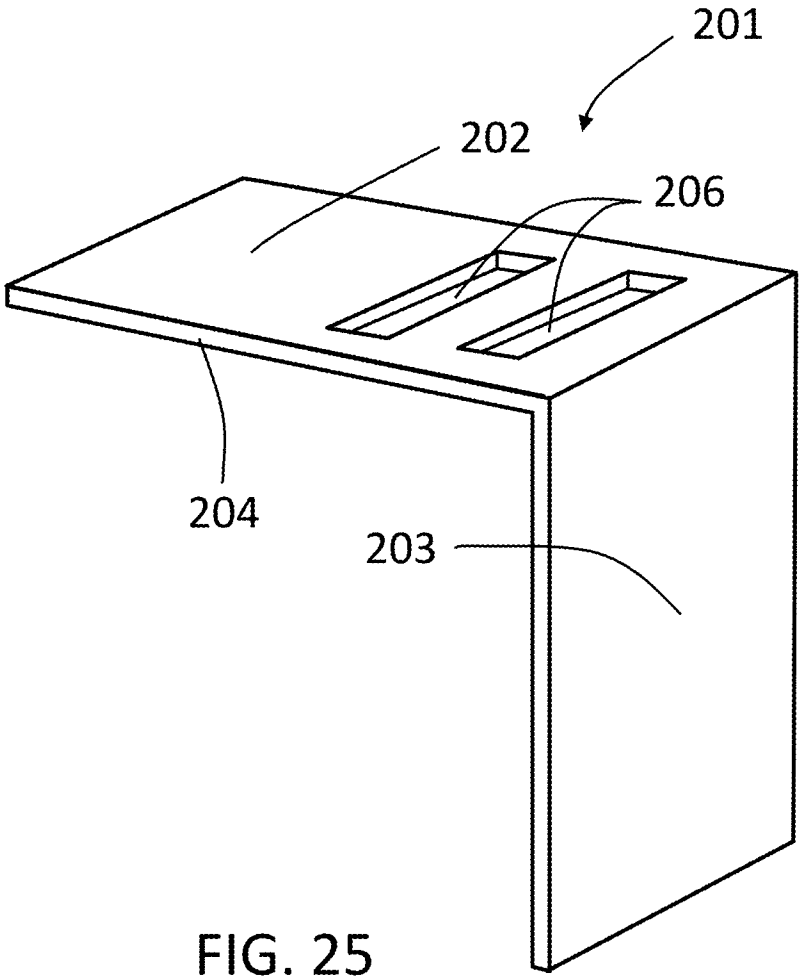
FIG. 25 shows an angled shield plate.
Figure 24:
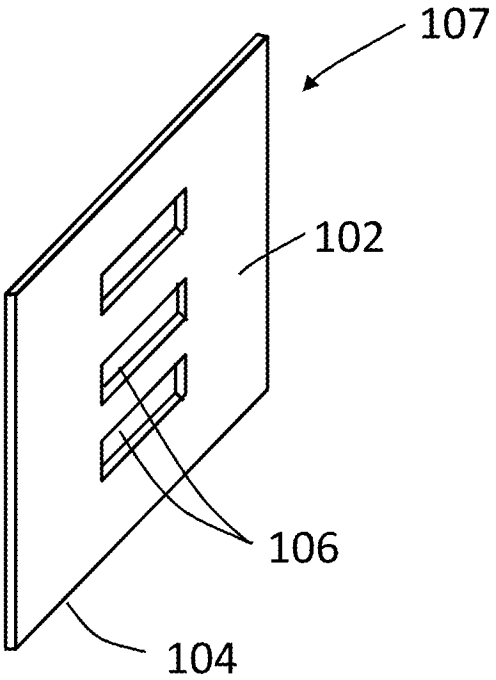
FIG. 24 shows a planar shield plate for use with an extending closure member.

An optional shield plate can be a substantially planar plate, and/or a curved or angled plate, the angled plate typically having a right angle of 90°, comprising one or more openings, typically rectangular, round, or oval slots, as illustrated in FIGS. 24 and 25, to narrowly accommodate the distal end section of the locking portion. The shield plate is used for improving or allowing the securement of a drawer, and/or for minimizing contact and scratching between an outer surface of the furniture and of the drawer with the lock device, such as a padlock, that is engaged with the locking portion.

Figure 13:
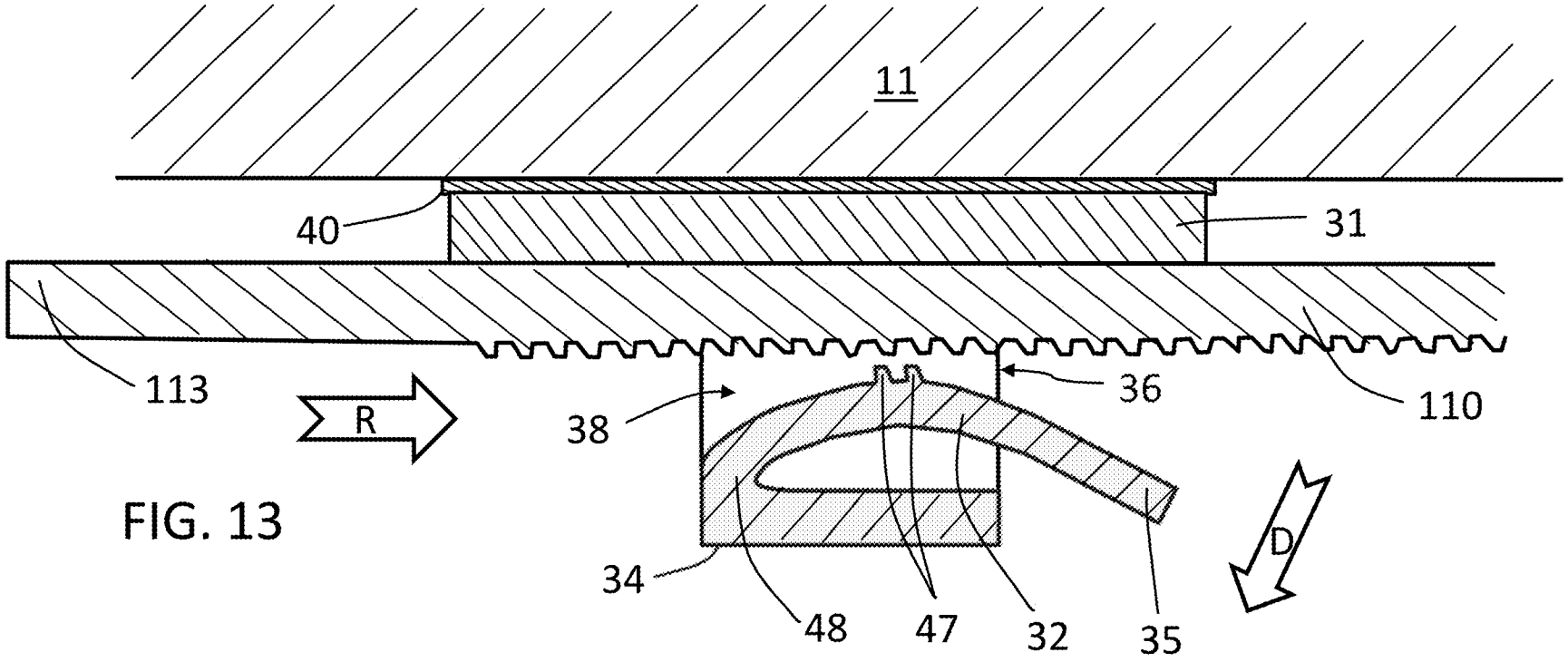
FIG. 13 shows a sectional view of the securement member of FIG. 10 with the attaching portion of FIG. 12 in the passage of the locking head, after a lever on a locking tab is pivoted out of engagement from the attaching portion, to re-position or remove the extending closure member from the securement member.

FIG. 7 shows a securement member comprising a locking head 30 molded to and integral with a fastener base 31 that is attached to an inner surface of the furniture through an attachment base 40 comprising at least one adhesive substrate. A ventral surface 44 may comprise a high tack adhesive for adhesive attachment to a dorsal surface of the fastener base 31. A dorsal surface 42 may comprise a high tack adhesive for adhering to the inner surface the furniture, such as a top side of the furniture. Alternatively, the ventral surface 44 comprises one or the other of the hook elements or the loop elements wherein the fastener base 31 comprises the other of hook elements or hook elements. The locking head 30 comprises an opening 36, an opposite exit end 37, and a passage 38 (FIG. 9) that receives a distal end section 113 of an extending closure member (FIG. 13). The passage 38 is formed in part by the base 31 and sidewalls 33 secured to the base 31.

Figure 8:
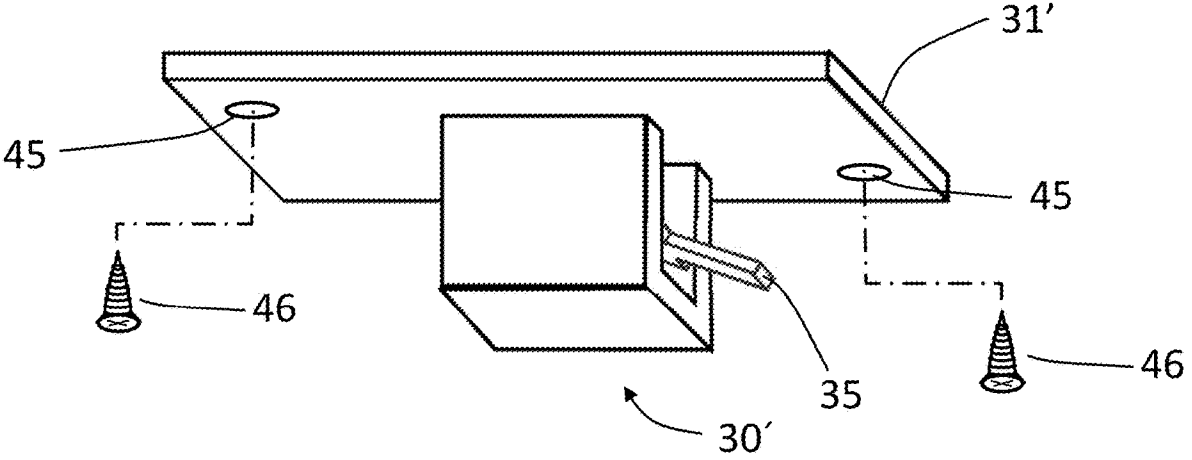
FIG. 8 shows another securement member comprising a locking head and a fastener base.

FIG. 8 shows another securement member comprising a locking head 30' comprising a fastener base 31' that is directly attached to the inner surface of the furniture using fastener screws 46 that are run through oppositely-positioned holes 45 in the fastener base 31', and into the inner surface using a screw driver or other implement, or by employing a thumb screw. This securement member is particularly convenient with wooden furniture. The length of the fastener screws 46 should be as short as possible while still obtaining a fastened securement into the inner surface of the furniture, such as the top side of the furniture, to minimize penetrating or bulging of the opposite surface such as the top exterior face of the top side. Insertion of the screws can be aided by forming a tap hole, by boring with a gimlet or using an awl.

Other styles of locking heads can be used that can comprise members extending between sidewalls to improve guidance of an extending closure member through the locking head are described in U.S. Pat. Nos. 5,745,957, 5,890,265, and 6,003,208, the disclosures of which are incorporated herein by reference in their entireties.

There are numerous other means to attach the securement member to the inner surface of a furniture which may occur to a person of ordinary skill in the art, including but not limited to: direct adhesion using a glue or adhesive, a mechanical fastener using hook-and-loop fasteners (also known as VELCRO®), latches and catches, etc. A tamper-evident securement device with a hook-and-loop fastener on the dorsal surface of the fastener base can be used for securing closed a drawer of a file cabinet, including a steel-constructed file cabinet, as described hereinafter and illustrated in FIGS. 67-69.

Figure 9:
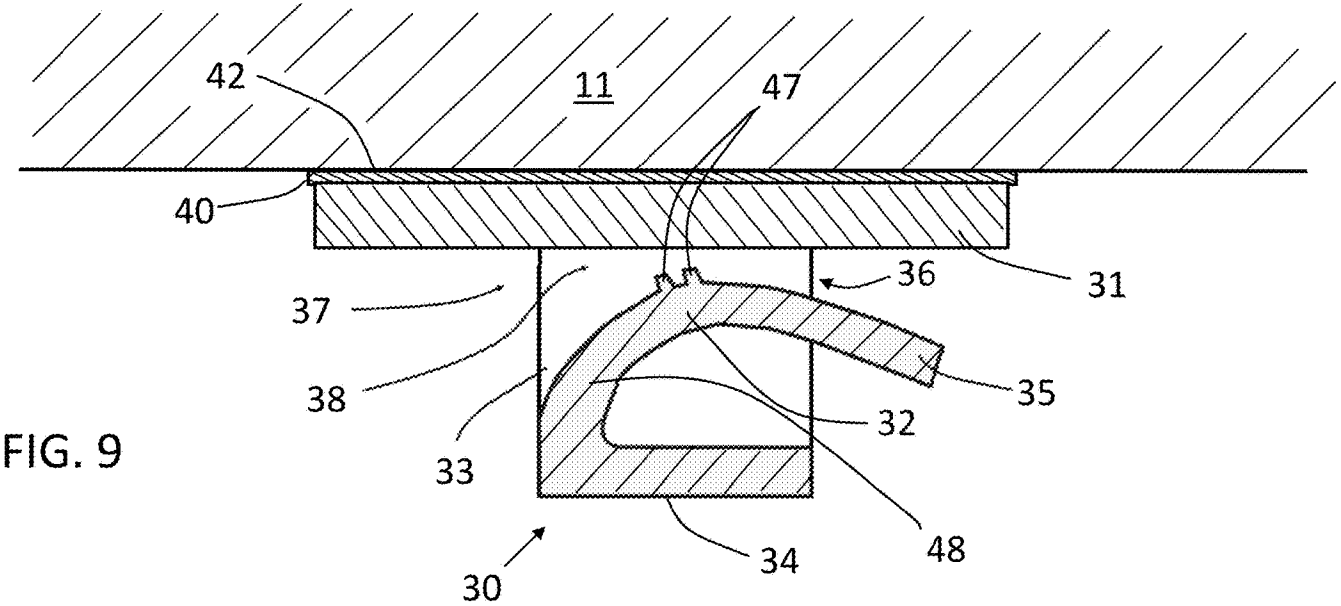
FIG. 9 shows a sectional view of the securement member of FIG. 7, after attachment thereof to an inner surface of furniture, through line 9-9 of FIG. 7.

FIG. 9 shows a vertical cross section view through line 9-9 of FIG. 7 through the passage 38 of the locking head 30 that is molded to and integral with the fastener base 31. The passage is defined by the boundaries of the opening 36, the exit end 37, the base 31, and a locking tab 32. The passage 38 receives a distal end section 113 of an attaching portion 110 (FIG. 13). The locking tab 32 is attached to a support rib 34 that spans between the sidewalls 33, at a hinge section 48. The locking tab 32 comprises one or more transversely-arranged teeth 47 that extend into the passage 38. The teeth 47 typically extend less than about 3 mm, from the locking tab 32 into the passage 38. In a natural, unbiased state prior to use, the hinge section 48 extends the teeth 47 partially into the passage 38. The hinge section 48 is configured to permit pivoting of the locking tab 32 away from the passage 38, as described hereinafter.

Figure 10:
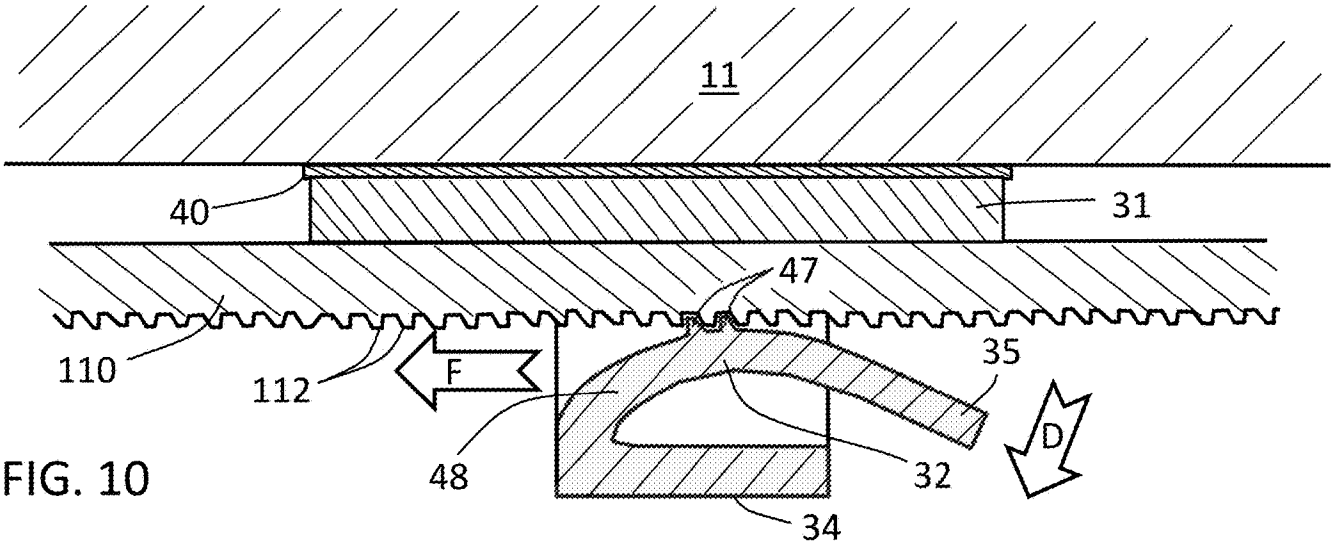
FIG. 10 shows a sectional view of the securement member of FIG. 9, after insertion of an attaching portion of an extending closure member through an opening and passage of the locking head.

As shown in FIG. 10, when the distal end section 113 (FIG. 13) of the attaching portion 110 is inserted into the opening 36 and through the passage 38 (in direction F) while the drawer is open, a plurality of serrations 112 along a ventral surface of the attaching portion 110 ratchetingly engage the teeth 47 and pivot the locking tab 32 away from the passage 38, pressing the locking tab 32 in the direction D. When the movement of the attaching portion 110 in the passage 38 ceases, the locking tab 32 has a bias toward the passage 38, opposite the arrow D direction, which maintains the teeth 47 in ratcheting engagement with the serrations 112 to prevent the withdrawal of the attaching portion 110 from the passage 38, opposite to the direction F. The bias of the locking tab 32 is a magnitude of force that is dependent on the strength of the material(s) comprising the locking tab 32, the hinge section 48, and the support rib 34. Materials with higher resilience will convey a stronger bias.

Figure 11:
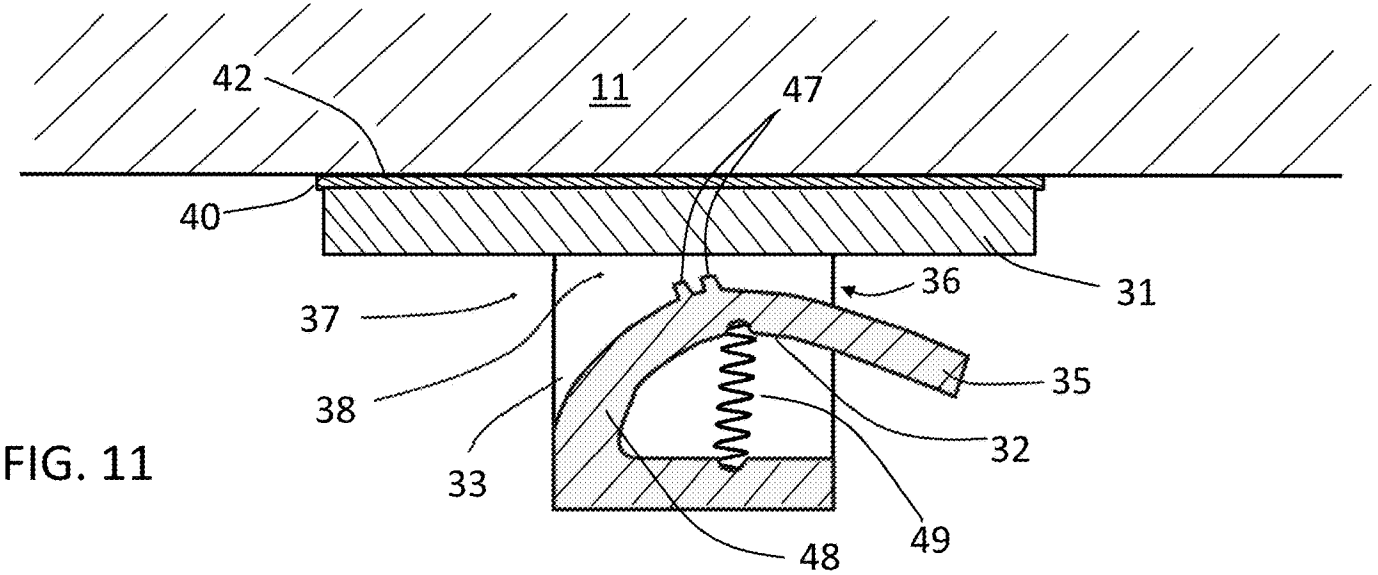
FIG. 11 shows a sectional view of a securement member comprising an alternative locking head to that of FIG. 9.
Figure 12:
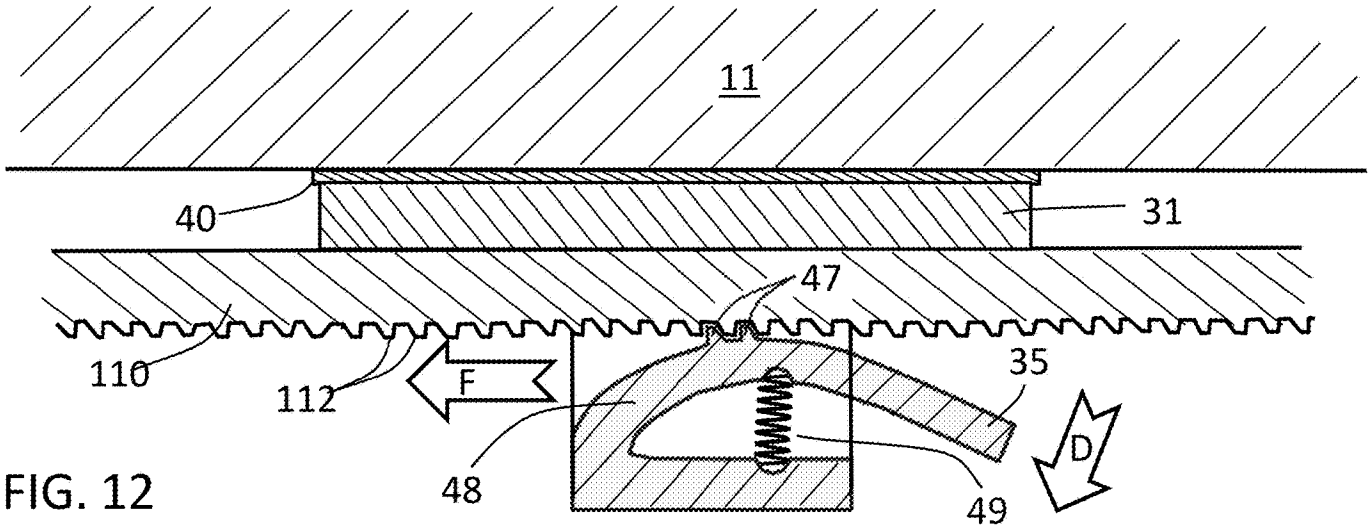
FIG. 12 shows a sectional view of the securement member of FIG. 11, after insertion of an attaching portion of an extending closure member through an opening and passage of the locking head.

FIG. 11 shows an alternative locking head wherein the locking tab 32 is supported within the passage 38 by a coil spring 49. This coil spring 49 within the locking head is generally made from a metal, typically steel, and generates an additional magnitude of force in the direction toward the passage 38. The additional force increases when the locking tab 32 is engaged with the attaching portion 110, as shown in FIG. 12. The coil 49 supports and maintains the bias of the locking tab 32 toward the passage 38. The material(s) comprising the locking head 30 with a coil spring 49 can have less or minimal strength, though keeping its general form.

If a significant and/or sudden withdrawing force (in direction R, FIG. 13) is applied to the attaching portion 110, for example during attempts at unauthorized opening of a drawer using a tamper-evident securement device, the serrations 112 would exert the withdrawing force upon the teeth 47 and the locking tab 32 and can shear and destroy either the teeth 47 or the locking tab 32, or both. However, a larger size of the locking head 30 and extending closure member 101, and a greater material strength thereof (for example, a stainless steel versus a nylon material), convey a lower probability of damage from a withdrawing force. Non-limiting typical materials from which the securement member and serrated attaching portion 110 can be made are:

plastic, metal, ceramic, and laminates thereof. The width and thickness of the attaching portion 110 are typically from about 0.3 cm to about 4 cm in width, more typically about 0.5 cm to 2 cm wide, and about 0.75 mm to about 4 mm thick, more typically about 1 mm to about 3 mm thick. The metals can include, without limitation: aluminum, steel, stainless steel, brass, iron, zinc, tin, and mixtures and alloys thereof, preferably stainless steel. The plastic can include, without limitation, nylon, polypropylene, polyester, acrylonitrile butadiene styrene (ABS), fluoroplastics, polyaryletherketone, polyamides, polycarbonate, acrylonitrile styrene, and polyvinylchloride, and laminates and composites thereof, preferably nylon. The attaching portion 110 can be molded, cast, formed, machined, extruded and/or forged by well known means.

The locking tab 32 can comprise a lever or handle 35 extending from a distal portion of the tab 32, which can be manipulated by a user away from the passage 38, to counter the bias of the locking tab 32 and pivot the tab 32 and the teeth 47 away from the passage 38 and out of ratcheting engagement with the serrations 112, as shown in FIG. 13. Depressing the lever 35 in the direction of arrow D permits the attaching portion 110 to be withdrawn freely from the locking head 30, to change or optimize a position of the attaching portion 110 within the passage 38, or to remove the extending closure member 101 entirely from the locking head 30. When the user manipulation on the lever 35 is removed, the locking tab 32 and teeth 47 regain the bias and pivot back toward the passage 38. In some embodiments, the locking tab 32, the lever 35, and the teeth 47 may be oriented in an opposite direction to that shown in FIGS. 10, 12, and 13 such that the lever 35 may extend toward the interior of the furniture and away from the drawer opening, i.e. the lever 35 may extend in direction F in FIG. 10. This can provide an alternative method of user manipulation when installing the attaching portion 110.

Figure 14:
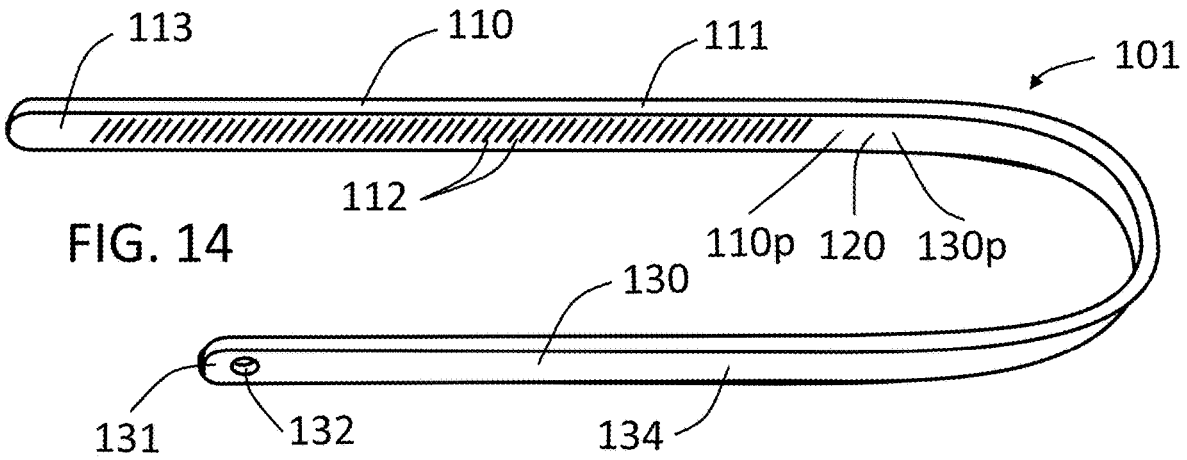
FIG. 14 shows an extending closure member comprising an attaching portion and a flexible locking portion.

FIG. 14 shows an extending closure member 101 comprising a flexible attaching portion 110 and a flexible locking portion 130. The attaching portion 110 further comprises a body section 111 having a plurality of serrations 112 on a ventral surface; a distal end section 113 which can have a rounded end, and can have some flexibility typically in a direction transverse to the arrangement of serrations 112; and a proximal end section 110*p* that is fixed to the locking portion at juncture 120. The locking portion 130 has at least some flexibility. The extending closure member 101 further comprises a proximal end section 130*p* that is fixed to the proximal end section 110*p* at a juncture 120; a flexible body section 134 having universal flexibility to accommodate the angling and manipulation from the furniture's interior and through the gap between the drawer and drawer opening, for any type of furniture; and a distal end section 131 comprising a hole or aperture 132 through which a lock device, such as a shackle of a padlock, can be inserted. The distal end section 131 can have a rounded end.

The attaching portion 110 can comprise a first elongated approximately rectangular planar portion, and the locking portion 130 can comprise a second approximately rectangular planar portion. The first rectangular planar portion and the second rectangular planar portion can be flexible and can have similar or different widths, and can be made of the same or different materials, and alternatively can comprise a unitary strap. Each approximately rectangular planar portion has a length, a width, and a thickness. The width of the locking portion 130 is typically from about 5 mm to about 4 cm, more typically from about 1 cm to about 2 cm wide, and the thickness is typically from about 0.5 mm to about 5 mm, more typically from about 0.8 mm to about 3 mm thick. The attaching portion 110 is typically from about 5 cm to about 30 cm in length, more typically from about 8 cm to about 25 cm. The thickness of the attaching portion 110 with plurality of serrations 112 is typically from about 1 mm to about 10 mm, more typically from about 2 mm to about 5 mm, and the width is typically from about 5 mm to about 4 cm, and more typically from about 0.7 cm to about 2 cm.

The extending closure member 101 is typically from about 15 cm to about 50 cm in length, more typically from about 20 cm to about 40 cm. Longer or shorter lengths can be used, as desired or required for a particular furniture type or size. The extending closure member 101 is typically made of one or more resilient materials and has a sufficient thickness to provide resilience but with sufficient flexibility to be manipulated to adapt to different styles of drawers, such as those shown in FIGS. 3 to 6. Non-limiting examples of a material for members 110, 130 of the extending closure member 101 include: woven or nonwoven fabric, preferably nylon fabric, leather, thermoplastic materials including nylon, polyethylene, polypropylene, polyesters, polyamides, fluoroplastics, polyacrylonitrile and copolymers thereof, polyvinylchloride, and the like, and laminates and composites thereof, and further strengthening thereof with a metallic or plastic mesh. The plurality of serrations 112 can be made of thermoplastic materials, preferably nylon or steel, and are attached, for example sewn, inserted, glued, and the like, onto the attaching portion 110, or integrally molded with the attaching portion 110. The extending closure member can be molded, cast, formed, machined, and/or extruded by well-known means. Where the locking portion 130 is made of a woven or nonwoven fabric, a hole or aperture 132 can be preferably capped with a metallic eyelet.

Figure 15:
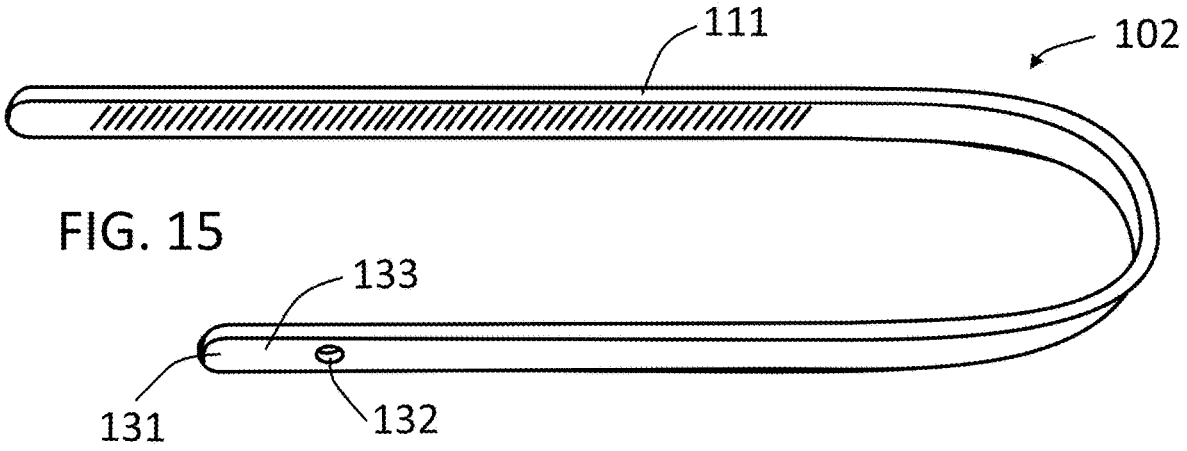
FIG. 15 shows an alternative extending closure member to that of FIG. 14 wherein a distal end section of the flexible locking portion further provides an extension to facilitate handling of the extending closure member.

FIG. 15 shows an alternative extending closure member 102 wherein the distal end section 131 of the locking portion 130 extends beyond the aperture 132 to form an extension 133 that can be handled by the user to facilitate installation of the extending closure member 102 through the gap 29 between the drawer and the drawer opening.

Figure 16:
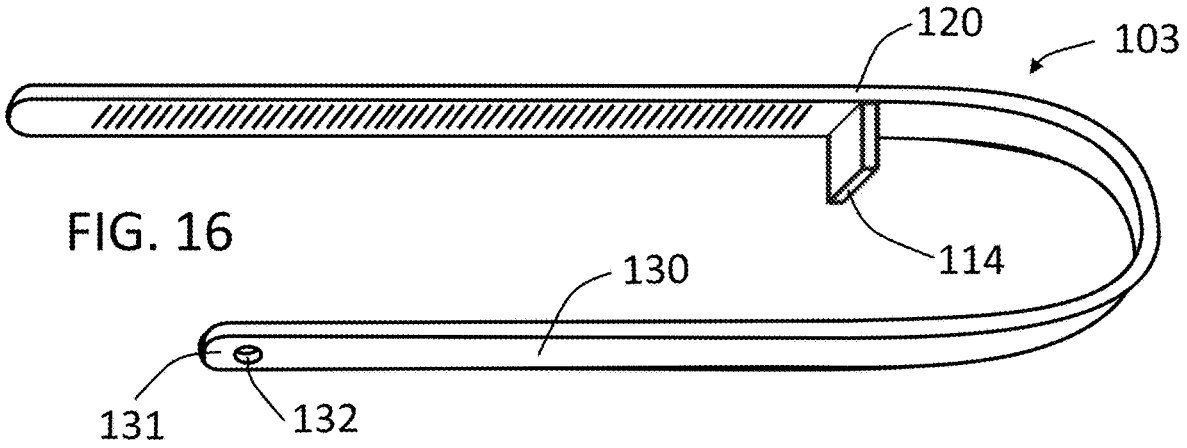
FIG. 16 shows another alternative extending closure member to that of FIG. 14, wherein a fingerplate extends from a proximal end section of the attaching portion.

FIG. 16 shows another extending closure member 103 comprising a fingerplate 114 disposed approximately at the juncture 120 between the attaching portion 110 and the locking portion 130. The fingerplate 114 extends from the extending closure member 103 by about 1 cm to about 2 cm, and has a width approximately equivalent to the width of the attaching portion 110. The fingerplate 114 makes adjustment of the attaching portion on or in the securement member easier for the user, when inserting or withdrawing the attaching portion 110 into or from the corresponding locking head 30 that is integral with the securement member.

Figure 17:
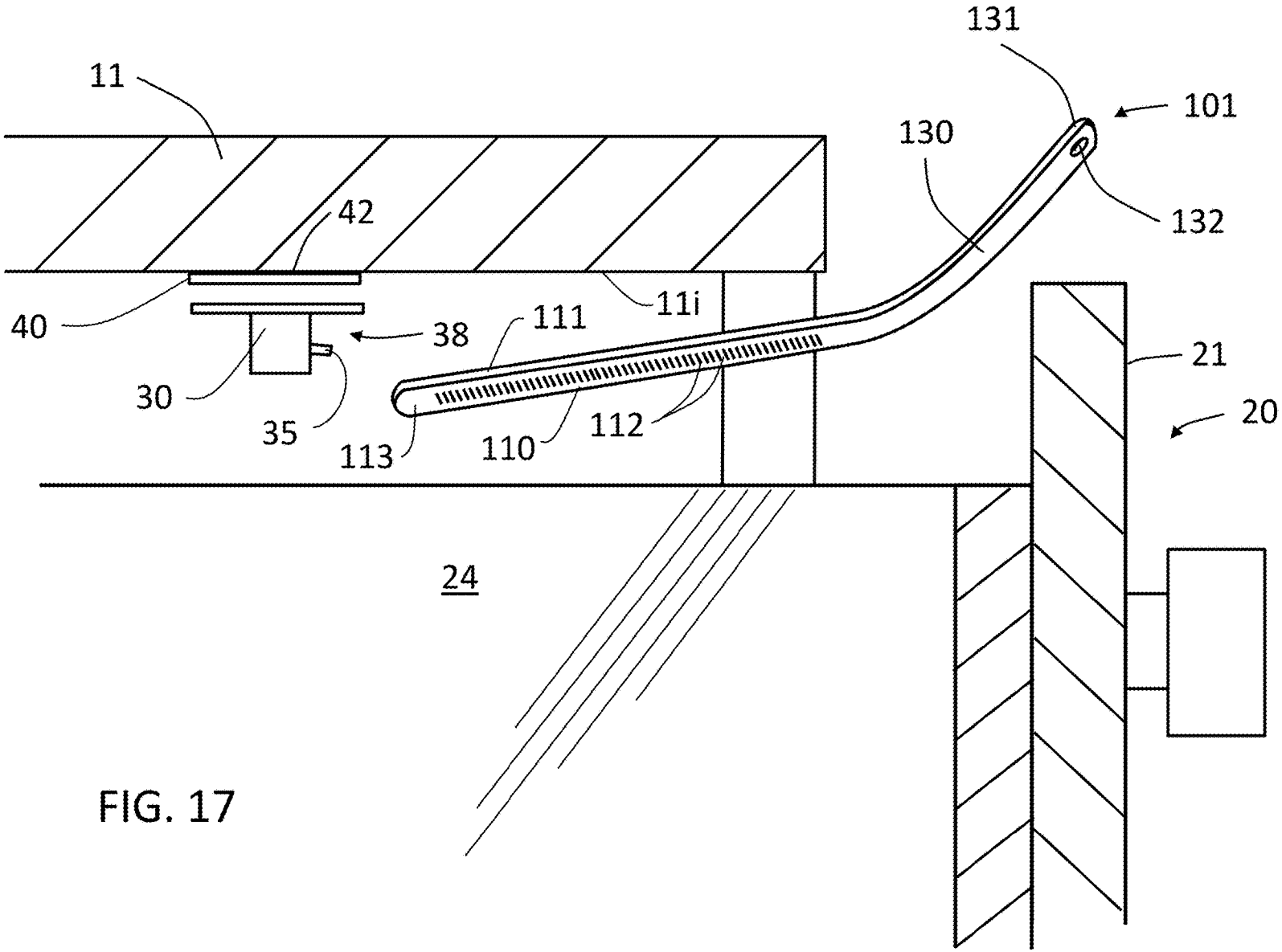
FIG. 17 shows the extending closure member of FIG. 14 being positioned for attachment to the securement member of FIG. 7 inside the first type of furniture and drawer.

FIGS. 17 through 20 show a tamper-evident securement device comprising a flexible extending closure member 101 used for securing a drawer in the first type of furniture shown in FIG. 3. FIG. 17 shows the drawer 20 pulled open, and an attachment base 40 secured by an adhesive layer to the inner surface 11*i* of the top side 11 of the furniture. An exposed adhesive surface 42 is positioned upward, facing the inner surface 11*i*, with the long dimension of the attachment base 40 oriented in the direction of the drawer opening, and then pressed upward onto the inner surface 11*i* of the top 11 to secure the adhesive attachment base 40 to the inner surface 11*i*. The adhesive may be covered with a release paper, which is removed prior to use of the attachment base 40.

Figure 18:
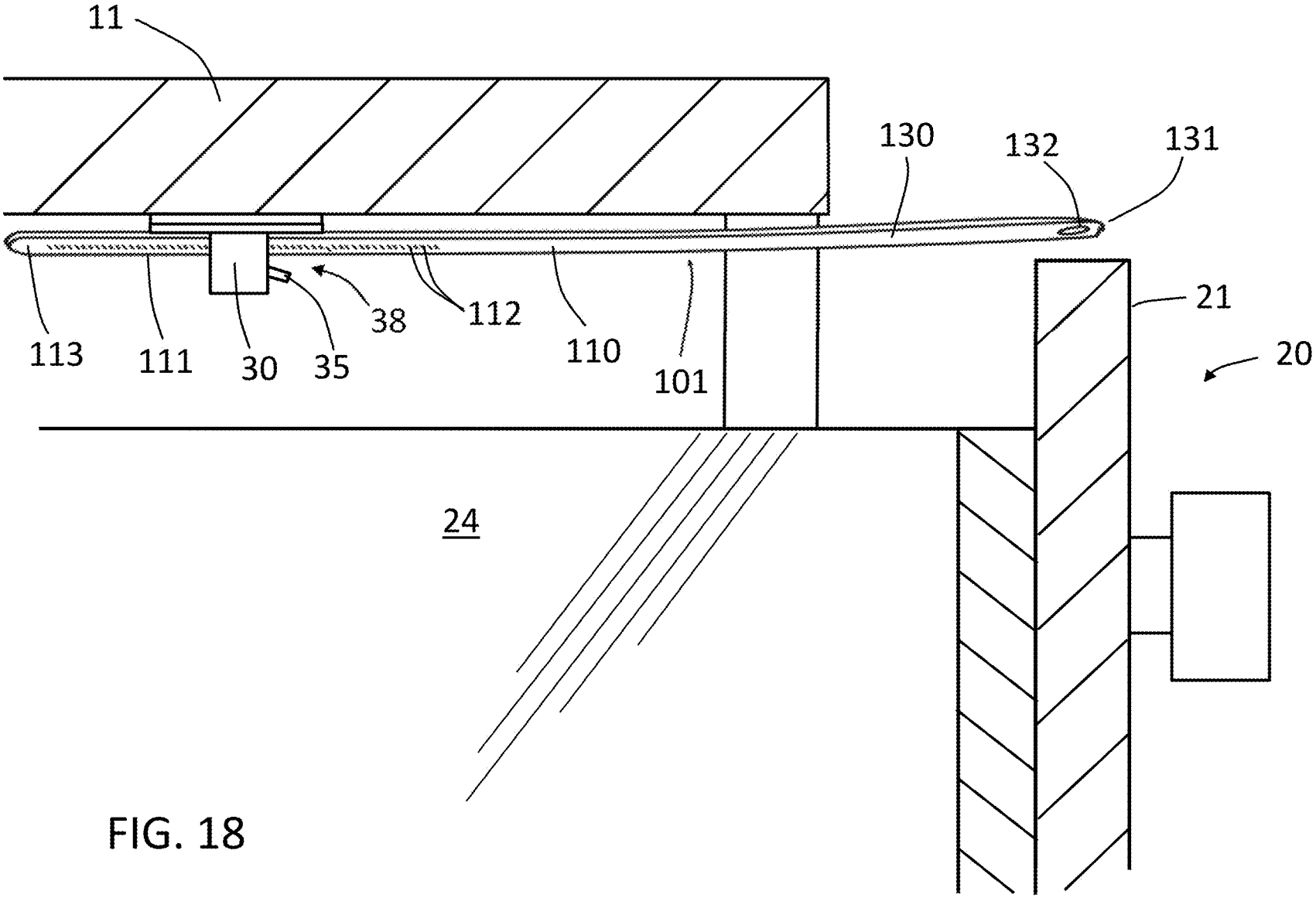
FIG. 18 shows the extending closure member of FIG. 14 engaged with the securement member as in FIG. 10 and extending through a gap between the drawer and the drawer opening of the first type of furniture and drawer.
Figure 19:
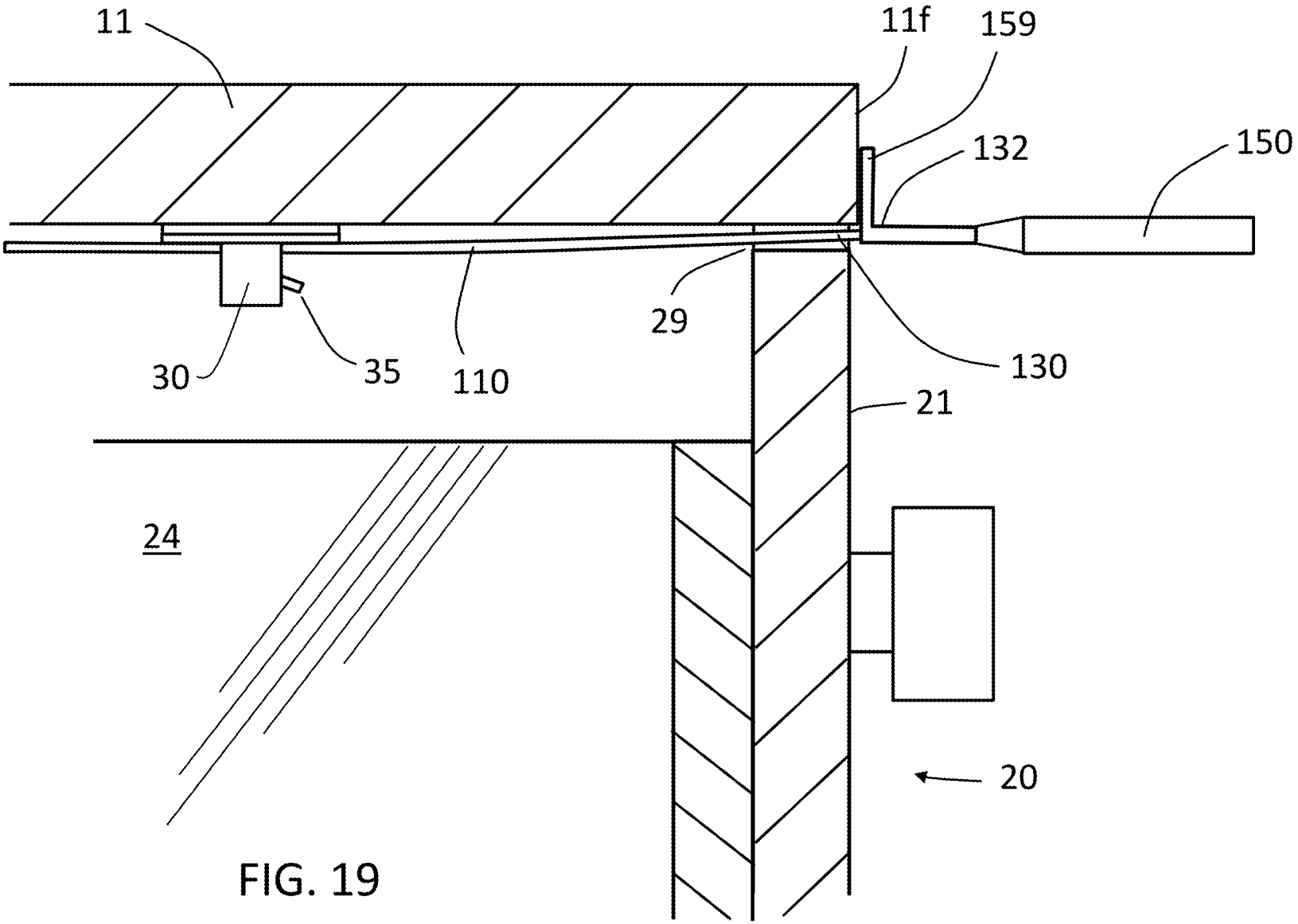
FIG. 19 shows the extending closure member of FIG. 14 being extended though the gap of the first type of furniture and drawer with an implement.
Figure 20:
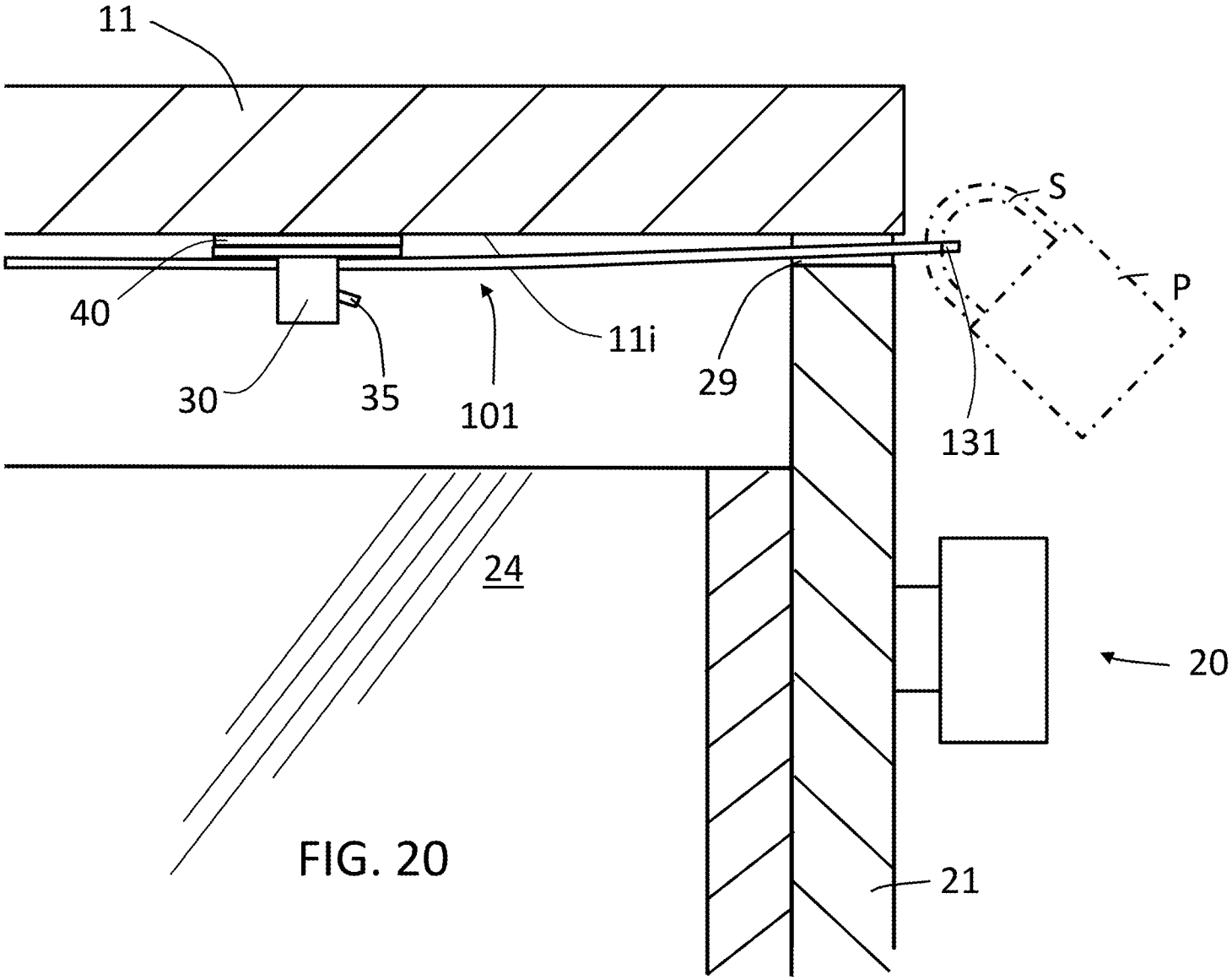
FIG. 20 shows the device of FIG. 19 with a padlock, through an aperture of the extending closure member with the drawer closed.
Figure 21:
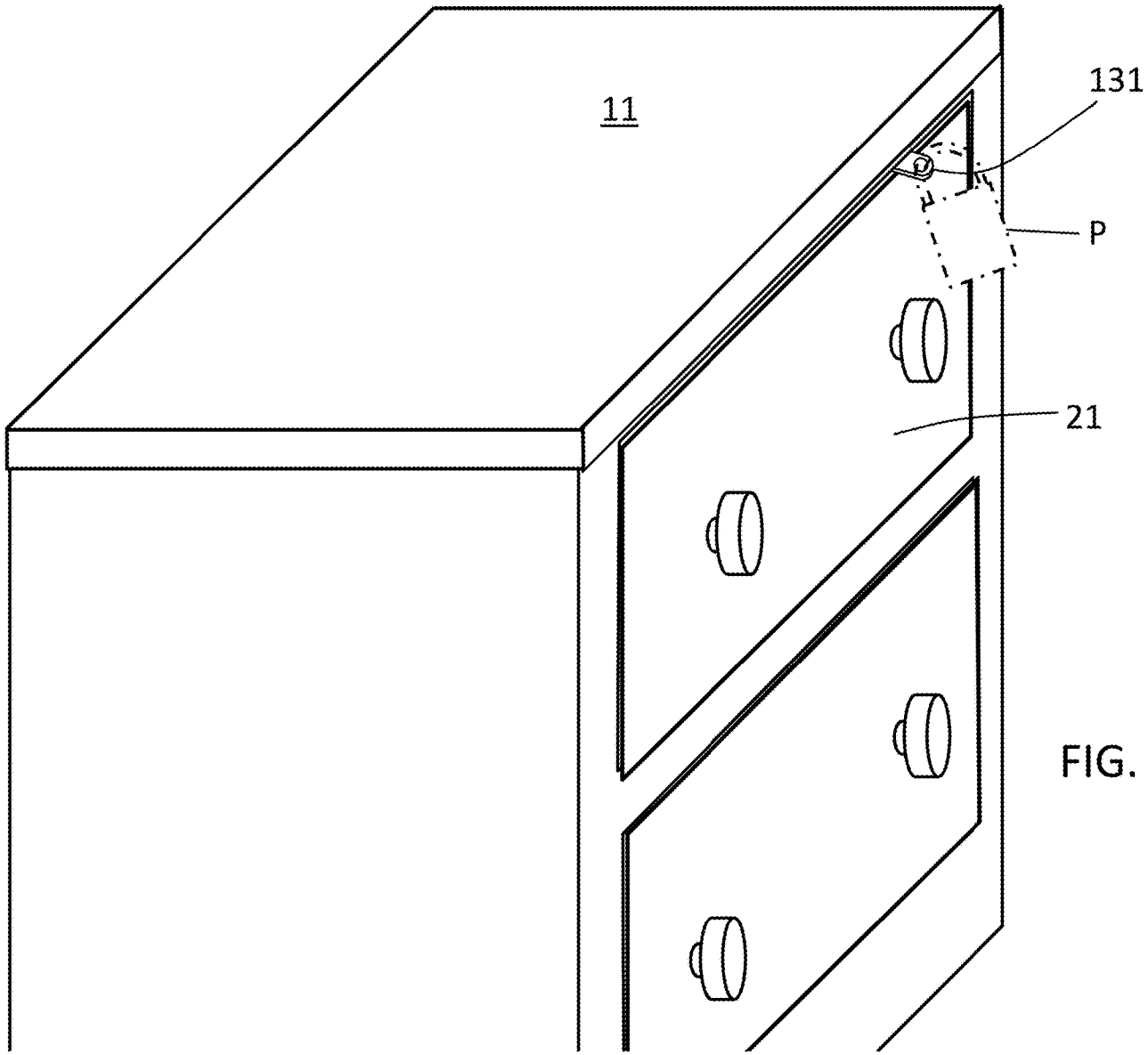
FIG. 21 shows a perspective view of a furniture of the first type with a drawer closed and locked using the extending closure member of FIG. 14 and a padlock.

In FIG. 18, with the drawer open, the user inserts the distal end section 113 of the attaching portion 110 of the extending closure member 101 into the drawer opening and then through the passage 38 of the locking head 30, with the plurality of serrations 112 (shown in FIG. 14) along the body section 111 ratchetingly engaging the teeth 47 of the locking tab 32 (shown in FIG. 9). The distal end section 131 and aperture 132 of the locking portion 130 are maintained just outside the drawer opening by the user as the attaching portion 110 is pushed through the locking head 30, to pull the extending closure member 101 taut. As shown in FIG. 20, the drawer 20 is then closed within the drawer opening. An aperture-withdrawing implement can facilitate maintaining the position of the aperture 132 and the distal end section 130 just outside the drawer opening, by engaging and aligning the aperture 132 and distal end section 131 during installation of the device. An example of an aperture-withdrawing implement 150 is illustrated in FIG. 19; the implement is further described herein. A lock device such as a shackle S of a padlock P is then passed through the aperture 132 and positioned next to the face 21 of the drawer, with minimal wiggle space (between about 1 mm and about 3 mm), and locked, as shown in FIG. 20, to secure the drawer 20 closed with tamper-evident securement within the furniture. An attempt by a person not able or authorized to unlock the lock device, to forcibly open the drawer, would be noticeable and tamper-evident. FIG. 21 shows the furniture utilizing the extending closure member 101, after closing the drawer and securing and locking with the padlock P.

Figure 23:
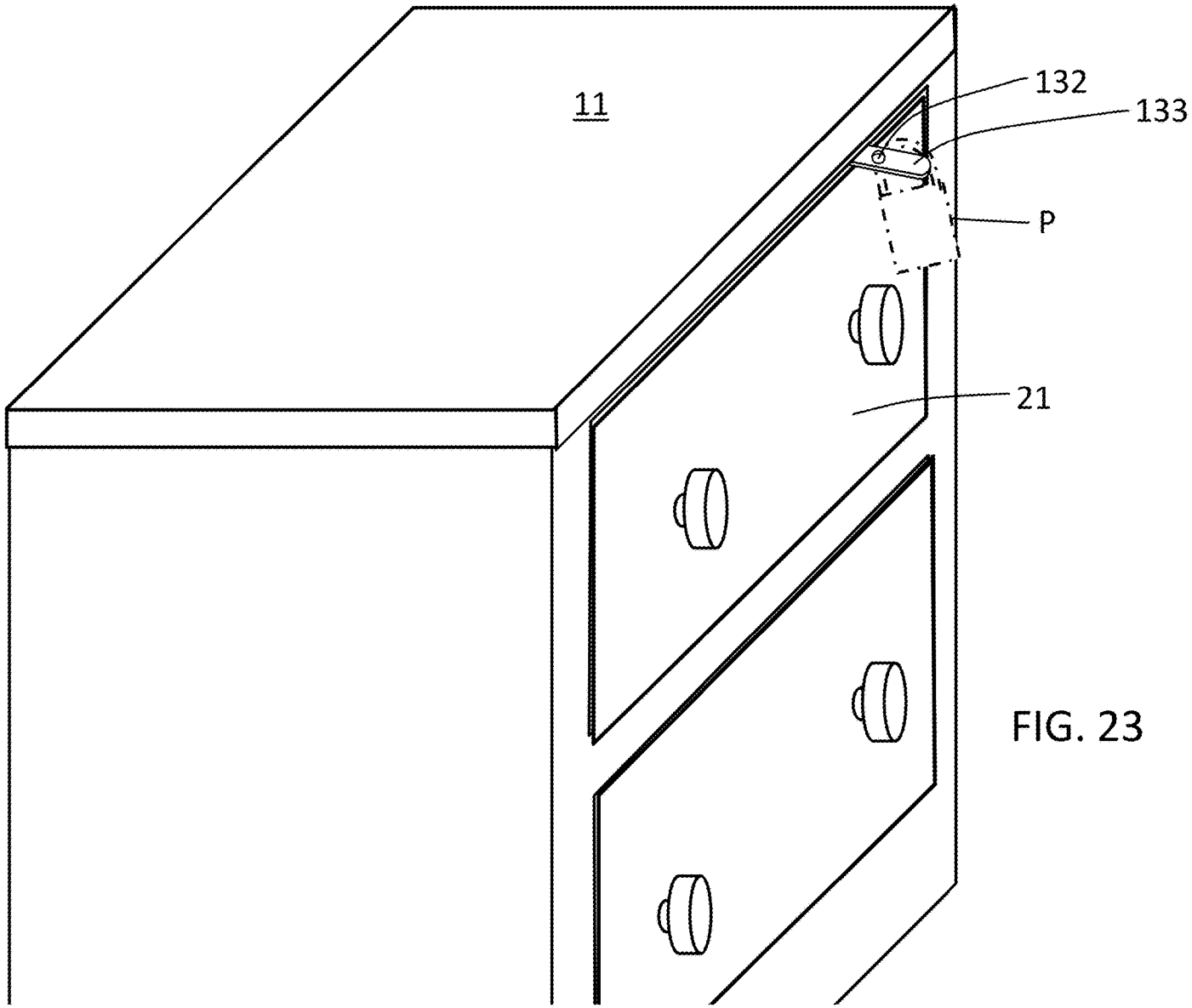
FIG. 23 shows a perspective view of a furniture of the first type with the extending closure member of FIG. 15 attached and secured using a padlock, with the drawer closed.

As shown in FIG. 23, rather than utilizing an implement 150, the flexible locking portion can further comprise an extension 133 that extends from the distal end section 131, to facilitate simpler installation of the extending closure member through the gap 29 between the drawer and the furniture. The user manually grabs the extension 133 and maintains it at a position such that the aperture 132 is just outside the drawer opening. FIG. 23 shows the furniture utilizing the extending closure member 102 of FIG. 15, after closing the drawer and securing and locking with the padlock P.

Figure 22:
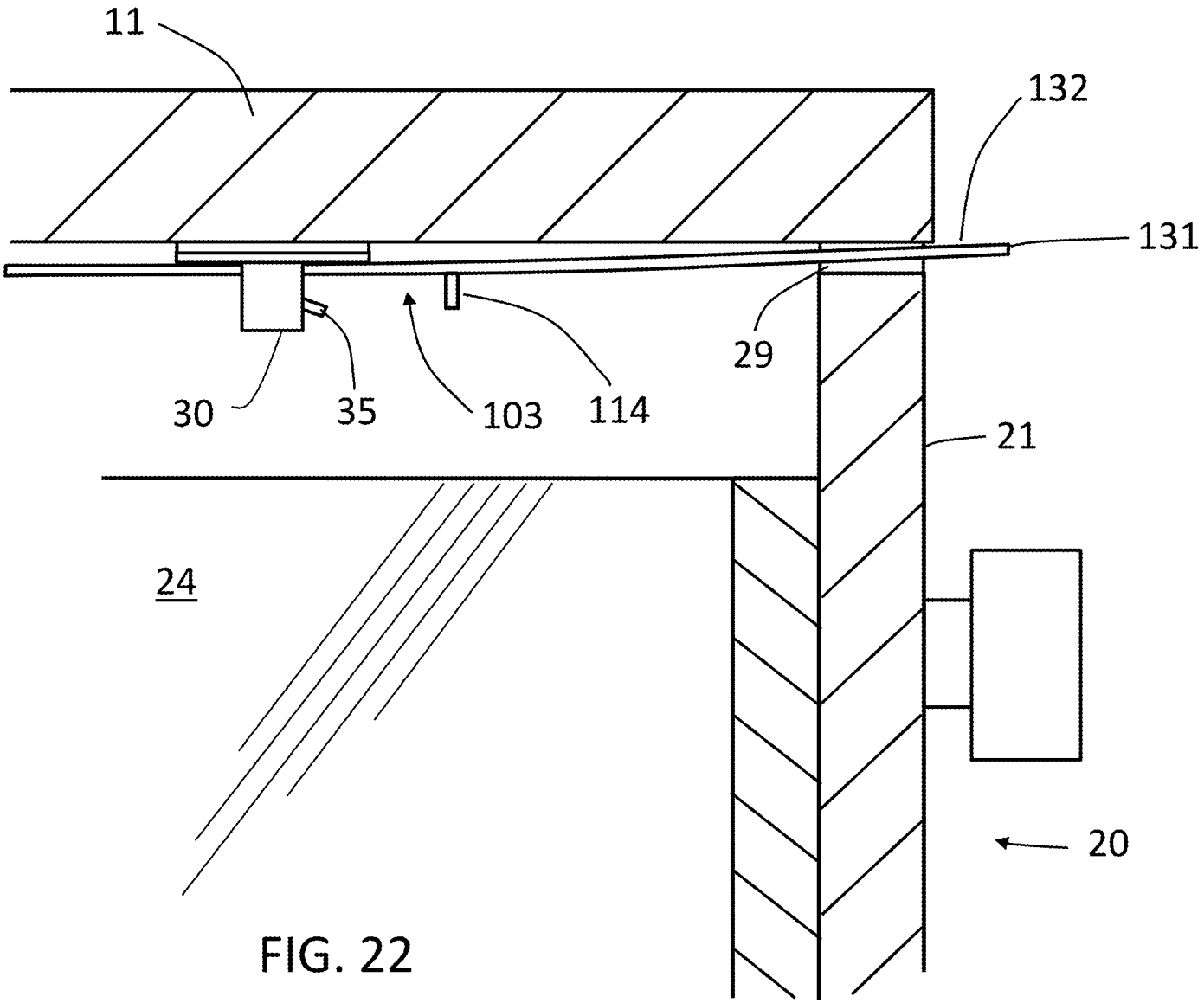
FIG. 22 shows the extending closure member of FIG. 16 engaged with the securement member of FIG. 10, shown in the first type of furniture and drawer.

FIG. 22 shows the extending closure member 103 of FIG. 16, comprising the fingerplate 114 as an aid for the user, to push the closure member 103 through the locking head 30 during installation. The drawer 20 is closed, with the aperture 132 of the locking portion just exterior to the gap 29 between the drawer 20 and the drawer opening.

After use of any embodiment of the tamper-evident securement device, the padlock P can be unlocked and removed from the aperture 132, and the extending closure member 101 can be completely inserted into the locking head 30, to hide it within the furniture, or withdrawn from the locking head 30 and furniture for separate storage. The extending closure member 101 can be attached again to the locking head 30 for a next use. When the tamper-evident securement device is no longer needed for a specific drawer, such as when the user is no longer using the furniture (for example moving out of a dormitory or a hotel), the fastener base comprising the locking head 30 can also be detached from the attachment base 40 disposed on the inner surface 11*i*. A common practice would be to leave the used attachment base 40 on the inner surface 11*i*, as it remains quite innocuous inside the drawer. The user can then reuse the securement device including the fastener base for another furniture, by installing a new attachment base 40 to the inner surface 11*i* of a new furniture top.

In any of the embodiments of the extending closure member 101, 102, or 103, as well as any other extending closure members described herein, it is preferred to additionally place a shield plate over the drawer opening wherein the drawer is closed, before inserting the lock device. When using a shield plate, the distal end section 131 of the locking portion 130 protruding through the gap 29 between the drawer and the drawer opening is passed through a slot of the shield plate, such that the aperture is also passed through before a lock device is inserted.

Figure 26:
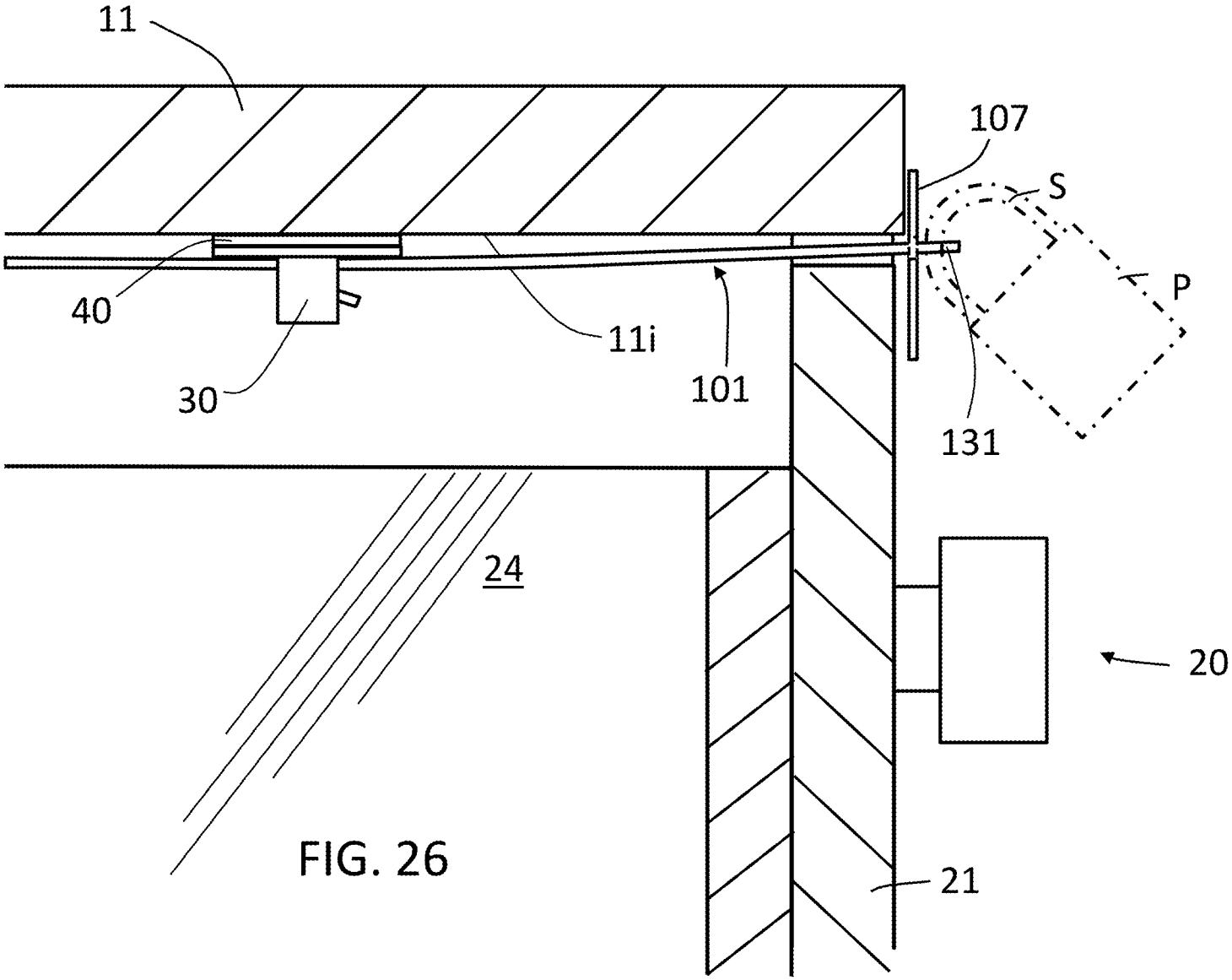
FIG. 26 shows the extending closure member of FIG. 14, attached and locked as in FIG. 20 using the shield plate of FIG. 24 and a padlock, with the drawer closed.

FIG. 24 shows a shield plate 107 as a rectangular plate 102 having a substantially planar body and a periphery 104, and comprising one or more slots 106, illustrated as rectangular slots, to accommodate passing therethrough of a distal end section of a locking portion of a closure member. Typically the slot 106 is disposed approximately near or at the center of the plate 102, and can also have other shapes, including but not limited to round and oval, to narrowly accommodate the distal end section, such that the distal end section does not wiggle or twist in the slot 106, and substantial movement (up and down, or side to side, or rotational) of the shield plate 107 is inhibited. A plurality of slots 106 can be provided in the shield plate. The shield plate 107 is designed for optional but preferred use with any extending closure member in securing a drawer in the first type of furniture (FIG. 3) or the second type of furniture (FIG. 4). When used, the distal end section 131 of the locking portion 130 is passed through the slot 106 of the shield plate 107, with the aperture 132 exposed sufficiently past the slot 106 for attachment of the lock device, such as a shackle (S) of a padlock (P). The periphery 104 of the shield plate extends from the slot 106 creating a surface area sufficient to block and prevent the drawer front face 21 from being opened beyond the shield plate 107 and the lock device, as shown in FIG. 26. The shield plate 107 typically has a width to at least accommodate a width of the slot 106 of about 7 mm, of which accommodates a width of the distal end section of about 5 mm passing therethrough, and typically has a height to accommodate a height of two or more slots 106, each of which accommodates a thickness and/or width of the distal end section passing therethrough. The plate 107 typically has a thickness between about 2 mm and about 5 mm. The shield plate can be made of inflexible plastic or metal. The planar body and the periphery of a metallic shield plate can be coated with a plastic layer to reduce chipping or scratching of wooden surfaces of the furniture and drawer. The shield plate 107 provides a superior tamper-evident securement of the drawer, and protection of the front face 21 of the drawer from potential damage caused by constant or repetitive tapping contact from the lock device. The shield plate is particularly suitable for use with padlocks.

Figure 31:
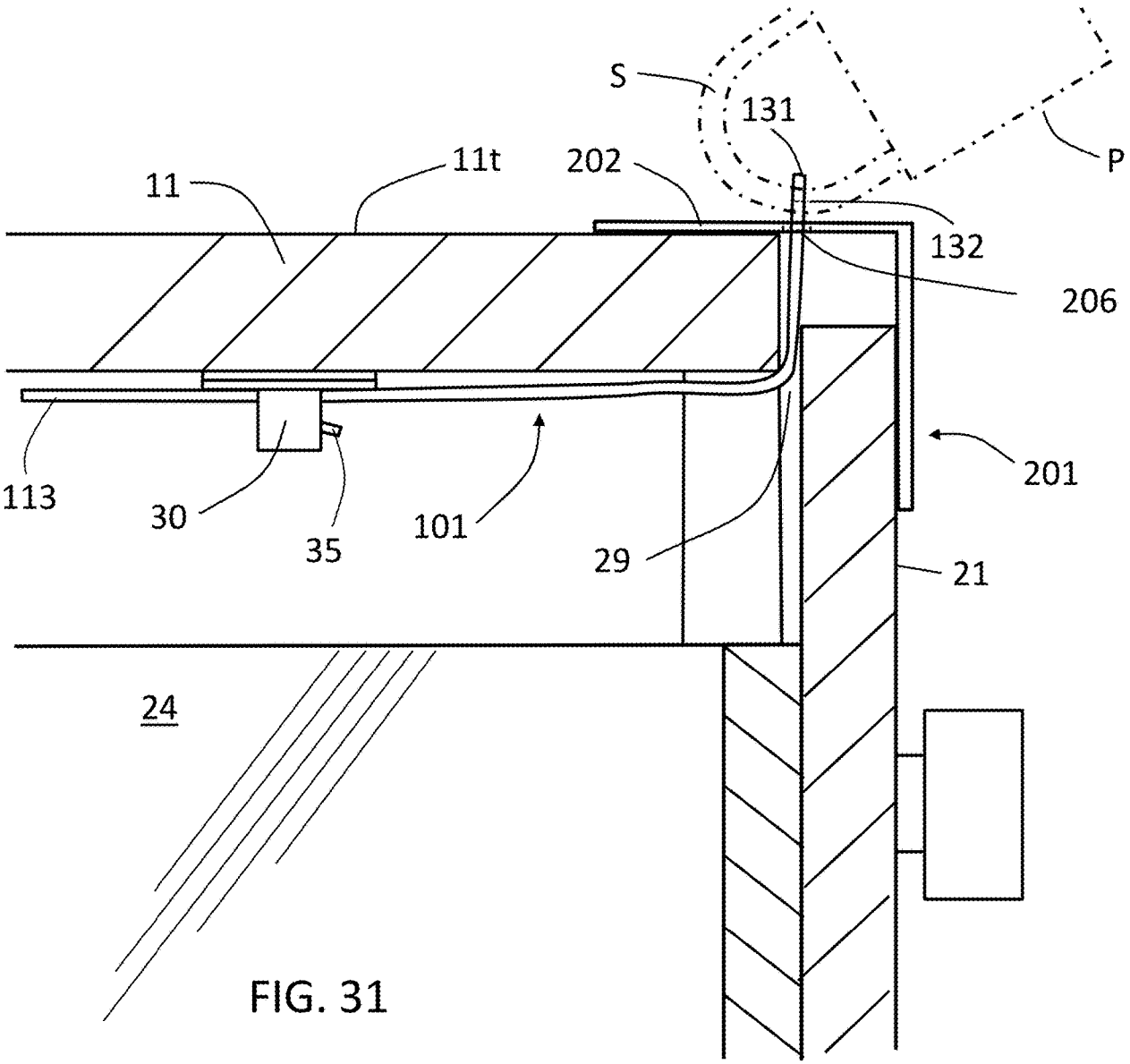
FIG. 31 shows the extending closure member of FIG. 14 attached to a securement member, in the third type of furniture and drawer, in a locked position using the shield of FIG. 25 and a padlock, with the drawer closed.

Another shield plate is a curved or angled shield plate 201, shown in FIG. 25. The angled shield plate 201 is configured to extend across a top exterior face 11*t* of the furniture, and also downward over the front face 21 of the drawer, and its use is preferred with any extending closure member securing a drawer in the third type of furniture (FIG. 5) or the fourth type of furniture (FIG. 6). The shield plate 201 has an angled shape, typically having a right angle of 90°, with generally planar portions 202, 203 which are perpendicular to each other, and having a periphery 204 and one or more slots or slots 206 formed therethrough in portion 202 to accommodate the extending distal end section 131. Using the shield plate 201 can be preferred with the planar portion 202 having the slots 206 oriented in a vertical direction, as shown in FIG. 31. Each planar portion 202, 203 typically shares the dimensions of the shield plate 107 of FIG. 24, including the thickness of about between 2 mm and about 5 mm.

Figure 27:
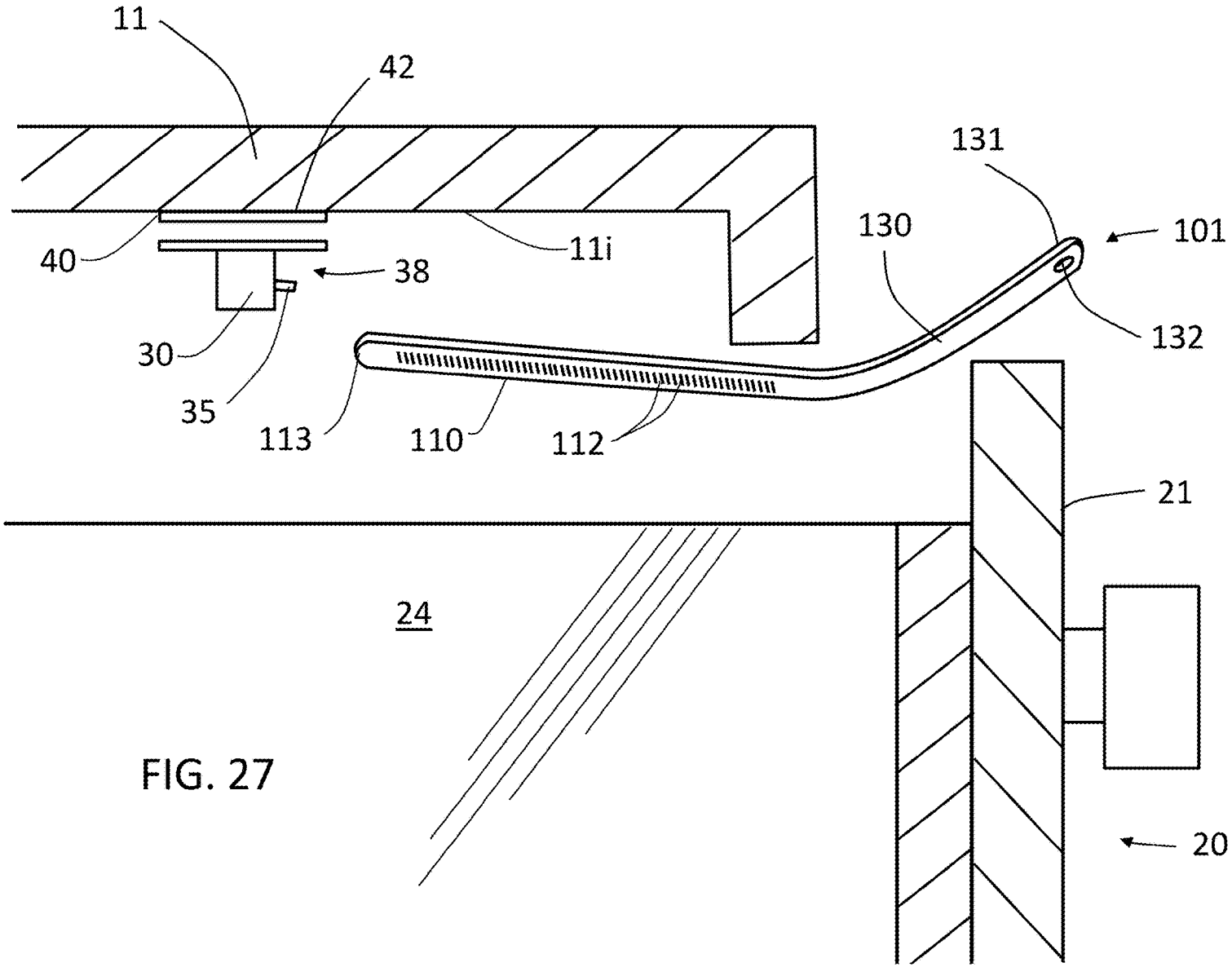
FIG. 27 shows the extending closure member of FIG. 14 being positioned for attachment to the inside of a second type of furniture and drawer.
Figure 28:
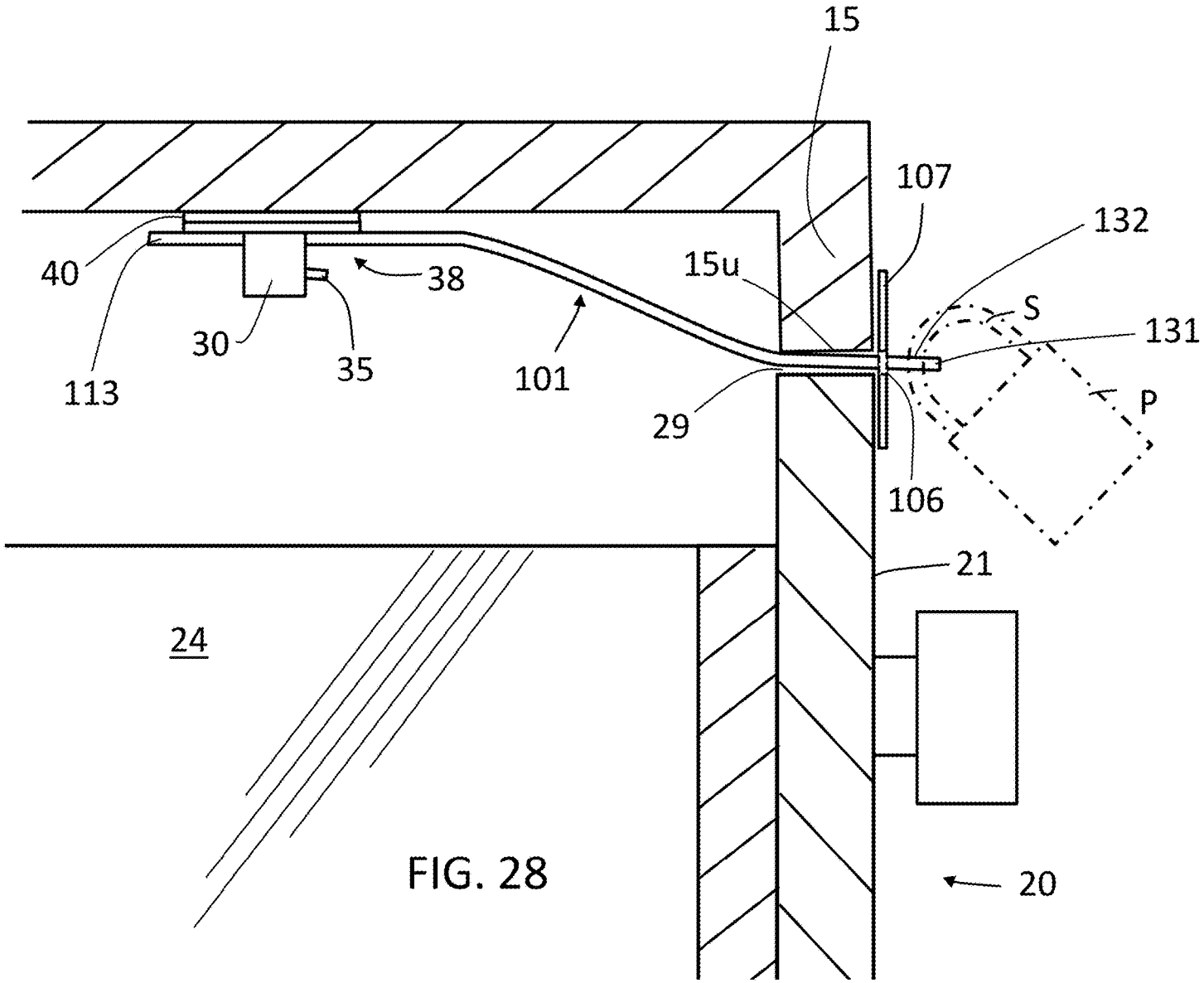
FIG. 28 shows the extending closure member of FIG. 14, attached to a securement member, in the second type of furniture and drawer and locked using the shield plate of FIG. 24 and a padlock, with the drawer closed.

FIGS. 27 and 28 show a tamper-evident securement device used for securing a drawer in the second type of furniture shown in FIG. 4. FIG. 27 shows the drawer 20 pulled open, at least one attachment base 40 adhered by the user to the inner surface 11*i* of the furniture, and the fastener base including the locking head 30. An extending closure member 101 is attached to the locking head 30 by inserting a distal end section 113 of an attaching portion 110 of the extending closure member 101 into an opening and through a passage 38 of the locking head 30, with the serrations 112 ratchetingly engaging one or more teeth 47 of the locking tab 32 (shown in FIG. 10). The distal end section 131 of the locking portion 130 is held just outside the drawer opening, as the attaching portion 110 is pushed through the locking head 30, to pull the extending closure member 101 taut.

FIG. 28 shows the drawer 20 closed within the drawer opening, with the distal end section 131 of the locking portion 130 protruding outwardly from the gap 29 beyond a slot 106 of a planar shield plate 107, the gap 29 being defined horizontally between an upper edge of the front face 21 of the drawer and a bottom edge 15*u* of the top rail 15. A shackle S of a padlock P is then passed through the aperture 132, positioned next to the face 21 of the drawer, with minimal wiggle space for pulling open the drawer, and locked, as shown in FIG. 23, to secure the drawer 20 closed within the furniture.

Figure 29:
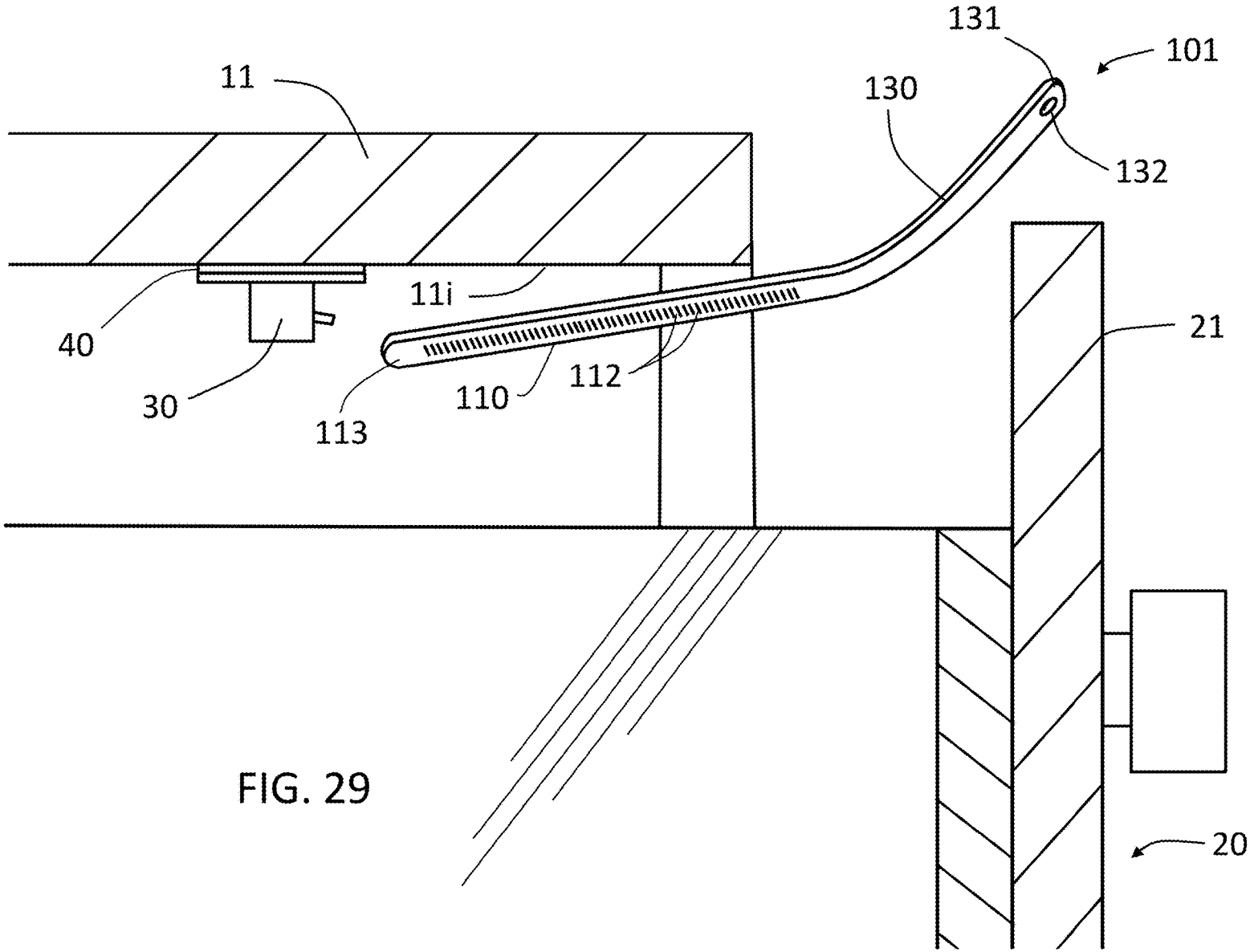
FIG. 29 shows the extending closure member of FIG. 14 being positioned for attachment to the inside of a third type of furniture and drawer.
Figure 30:
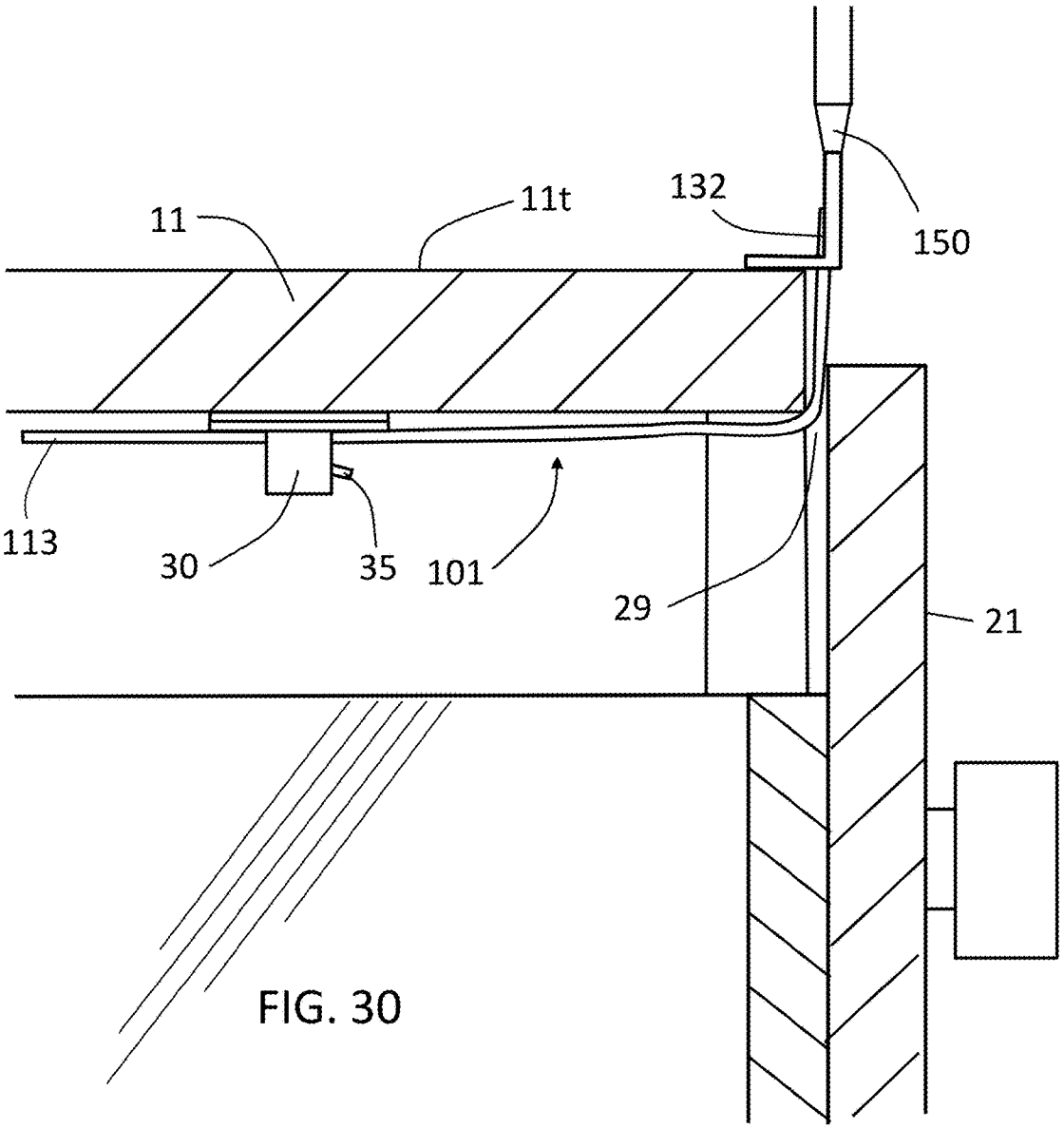
FIG. 30 shows the extending closure member of FIG. 14 being extended though a gap between the closed drawer and the furniture of the third type of furniture and drawer.

FIGS. 29 to 31 show a tamper-evident securement device used for securing a drawer in the third type of furniture that is shown in FIG. 5. FIG. 29 shows the drawer 20 pulled open, and a fastener base including a locking head 30 is attached to an attachment base 40 and thus secured to the inner surface 11*i*. An extending closure member 101 is positioned with a distal end section 113 pointing to the locking head in a similar manner to those in FIGS. 17 and 27. The distal end section 131 of the locking portion 130 is held just outside the drawer opening, as the attaching portion 110 is pushed through the locking head 30, to pull the extending closure member 101 taut.

FIG. 30 shows the drawer 20 closed within the drawer opening, with the distal end section 131 of the locking portion 130 protruding outwardly from the gap 29 which is defined vertically between a top exterior face 11*t* of the furniture and the upper, inner surface of the front face 21 of the drawer. An optional aperture-withdrawing implement 150 can be used to maintain the aperture 132 just outside the drawer opening; the implement 150 is further described herein.

FIG. 31 shows the drawer of FIG. 30 closed with tamper-evident securement after the distal end section 131 including the aperture 132 is inserted through a slot 206 of the angled shield plate 201 of FIG. 25. The planar portion 202 of the plate 201 is oriented horizontally and positioned flush with a top exterior face 11*t* of the furniture, and a shackle S of a padlock P is passed through the aperture 132, with minimal wiggle space for pulling open the drawer 20.

Figure 32:
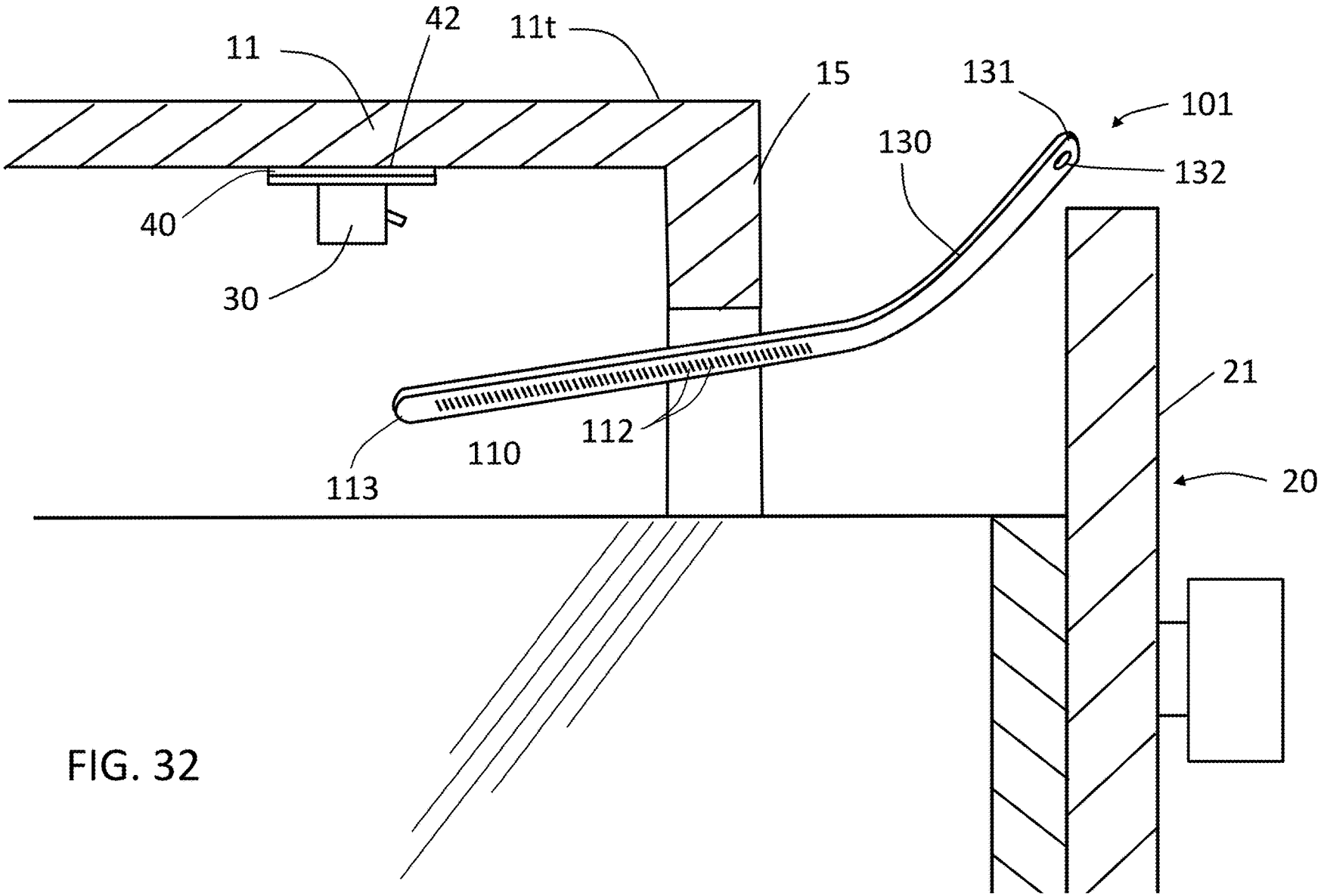
FIG. 32 shows the extending closure member of FIG. 14 being positioned for attachment to the inside of a fourth type of furniture and drawer.
Figure 33:
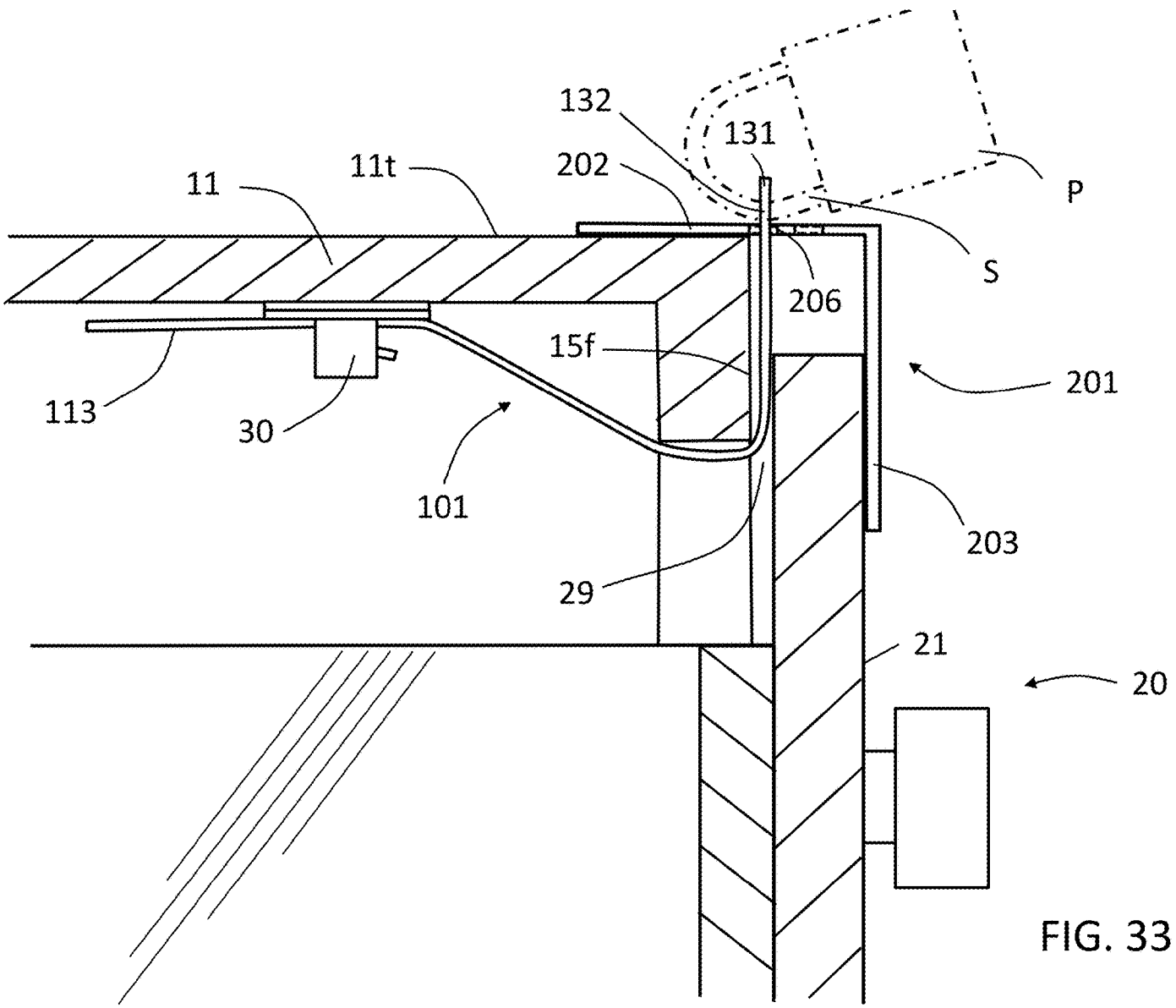
FIG. 33 shows the extending closure member of FIG. 14, attached to a securement member, in the fourth type of furniture and drawer, in a locked position using the shield plate of FIG. 25 and a padlock, with the drawer closed.

FIGS. 32 and 33 show a tamper-evident securement device used for securing a drawer in the fourth type of furniture that is shown in FIG. 6. FIG. 32 shows the drawer 20 pulled open, and a fastener base including a locking head 30 is attached to an attachment base 40 and thus is secured to the inner surface 11*i*. An extending closure member 101 is positioned with the distal end section 113 in proximity to the locking head 30. The distal end section 131 of the locking portion 130 is held just outside the drawer opening, as the attaching portion 110 is pushed through the locking head 30, to pull the extending closure member 101 taut.

FIG. 33 shows the drawer of FIG. 32 closed within the drawer opening, with the distal end section 131 protruding upwardly from the vertical gap 29 which is defined between the of forward surface 15*f* of the top rail and the upper, inner surface of the front face 21 of the drawer. The distal end section 131 further includes an aperture 132 that is inserted through a slot 206 of the angled shield plate 201 of FIG. 25. The planar portion 202 of the plate 201 is oriented horizontally and flush with the top exterior face 11*t*, and a shackle S of a padlock P is passed through the aperture 132, with minimal wiggle space for pulling open the drawer 20. The lock device completes the tamper-evident securement of the drawer 20 within the furniture.

Figure 34:
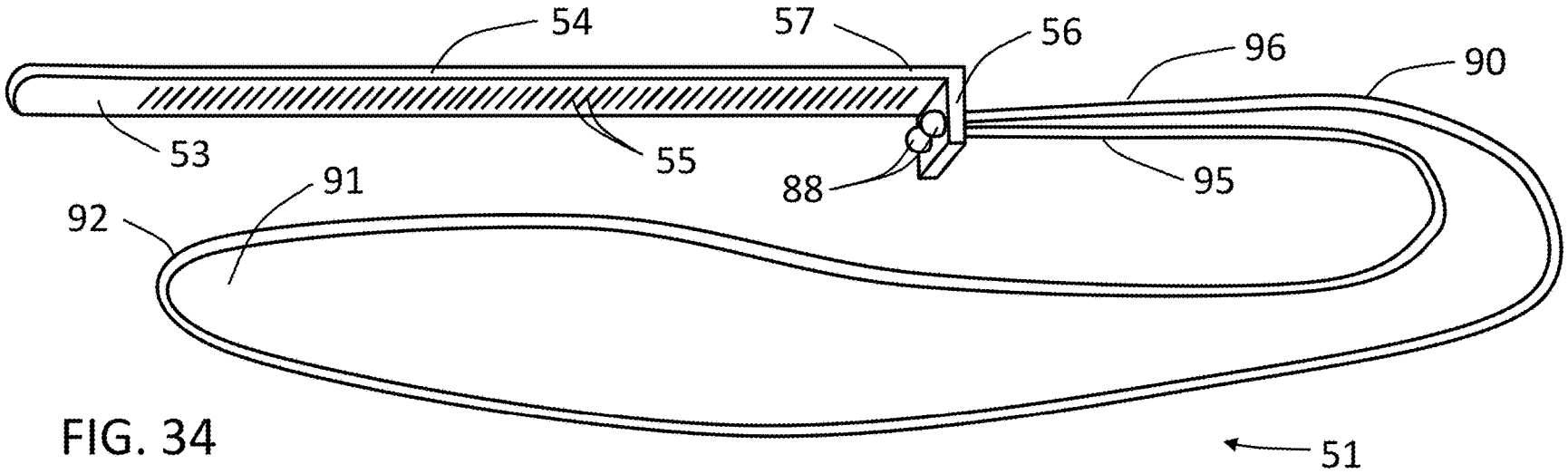
FIG. 34 shows an extending closure member comprising a cable with two legs forming a loop at a distal end section.

FIG. 34 shows another extending closure member 51 comprising an attaching portion 54 and a locking portion comprising a flexible cable 90. The attaching portion 54 is similar to the attaching portion of the first embodiment, comprising a plurality of serrations 55 and a distal end section 53. A proximal end section 57 comprises an end plate 56 extending perpendicularly from the proximal end section 57, the end plate 56 comprising a pair of holes (not shown) through which two legs comprising a proximal end 95 and a distal end 96 of the cable 90 are passed and fixed therein with stop members 88, to prevent removal of the cable 90 from the end plate 56'. The two legs 95, 96 comprise a body section of the cable 90 and extend to form an extended loop 91 at a distal end section 92.

Figure 35:
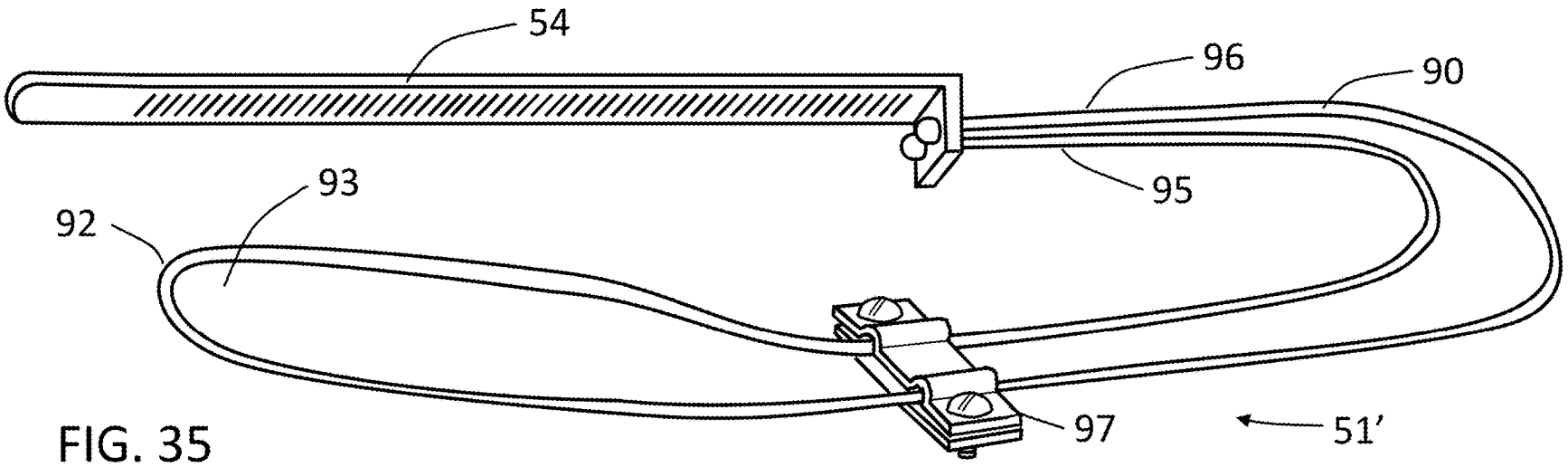
FIG. 35 shows the extending closure member of FIG. 34 with a clamp device.

FIG. 35 shows an alternative extending closure member to that of FIG. 34, wherein a clamp device 97 is secured to the body section of the cable 90 comprising the two legs 95, 96 and aligns the two legs together at a distance from the distal end section 92, to form a distal loop 93. The clamp device can be immovably secured to either or both of the legs 95, 96 to set the length of the distal loop 93, or can be slidably secured to allow for adjustment in the length or size of the distal loop 93.

Figure 36:
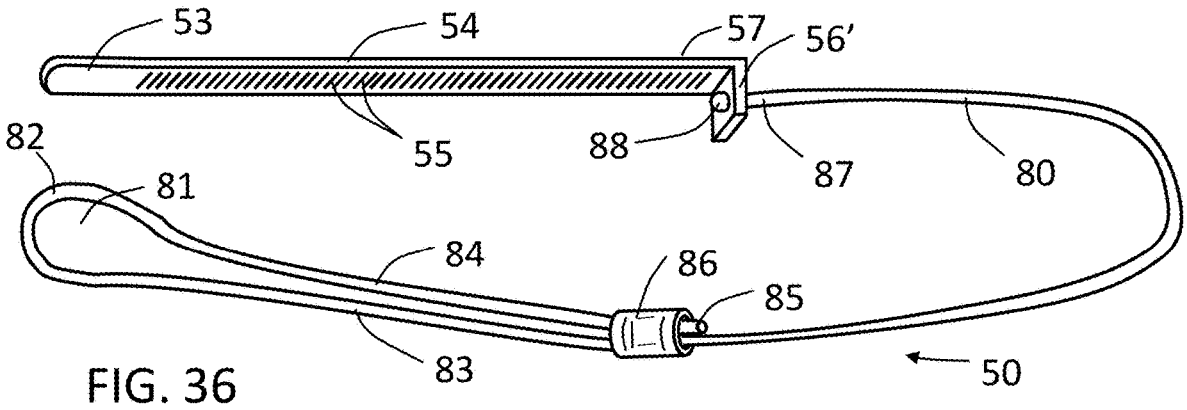
FIG. 36 shows an extending closure member comprising a cable with the distal end section forming a loop.

FIG. 36 shows another alternative extending closure member to that of FIG. 34, comprising an attaching portion 54 and locking portion comprising a cable 80. The attaching portion 54 is similar to those of FIGS. 34 and 35, except that the end plate 56' has one hole (rather than two) through which a proximal end section 87 comprising one of the legs of the cable 80 is passed and fixed therein with a stop member 88. The cable 80 extends toward a loop 81 formed by attaching a distal end 85 of the cable 80 to the body section of the cable with a fastener, illustrated as a crimped sleeve 86. The loop 81 of the cable 80 comprises two legs 83, 84 that extend from the fastener 86 to a distal loop end section 82. The fastener 86 is typically fixed at a set position on the body section of the cable 80, to prevent undesirable changes in length of the loop 81 after the device is installed and the drawer secured. The distal loop end section 82 extends through a gap 29 between a drawer and a drawer opening, to permit a lock device to be run through the extended loop 81, and an optional shield plate for the distal loop end section 82 to pass therethrough, to close the drawer with tamper-evident securement.

Figure 37:
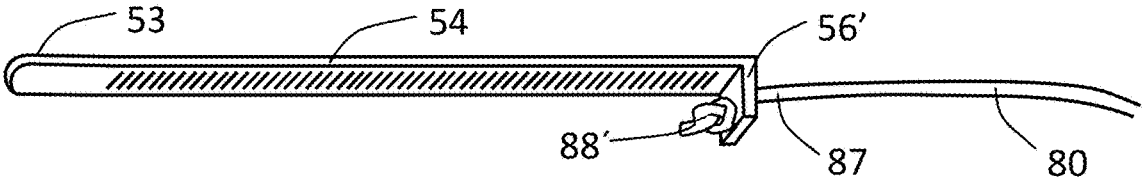
FIG. 37 shows a partial view of the extending closure member of FIG. 34 with an alternative proximal end section of the cable.

FIG. 37 shows an alternative extending closure member to that in FIG. 36, wherein the distal end section 87 of the cable 80 is formed into a knot or knuckle 88', to prevent removal of the distal end section 87 from the end plate 56'.

Figure 38:
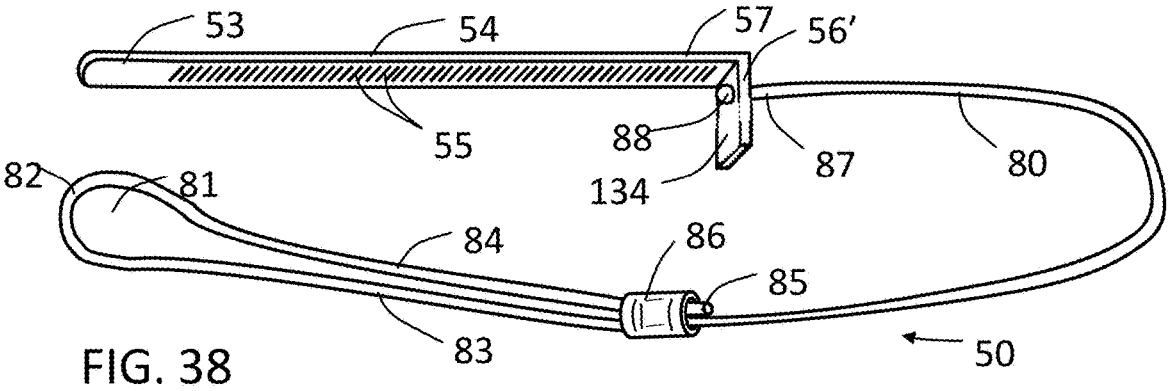
FIG. 38 shows the extending closure member of FIG. 36 further comprising a fingerplate.
Figure 39:
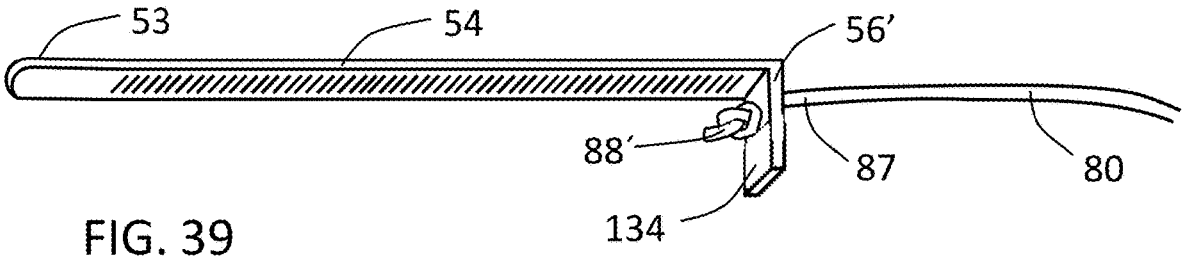
FIG. 39 shows a partial view of the extending closure member of FIG. 37 further comprising a fingerplate.

FIGS. 38 and 39 show the extending closure members of FIGS. 36 and 37, respectively, further comprising a fingerplate 134 extending from the respective end plates 56' for increased ease of use. A fingerplate can be similarly employed on the extending closure members in FIGS. 34 and 35.

While the attaching portion 54 has some flexibility, typically in a direction transverse to the plurality of serrations 55, the cable 80 has universal flexibility to accommodate the angling and manipulations of the cable from the furniture's inner surface and through the gap between the drawer and drawer opening for any type of furniture.

A typical cable that is useful in the present invention is made of a metallic material, such as a flexible steel or flexible stainless steel cable comprising a plurality of wound or woven threads of fine steel wires for enhanced strength and flexibility. The cable can also be coated with a thin layer of a thermoplastic material, for example polyethylene, polypropylene, or polyvinyl chloride, to minimize scratching and marring of wooden and metal drawer and furniture surfaces. A typical diameter of the cable is about 0.5 mm to about 3 mm, more typically about 1 mm to about 2 mm, and length is about 10-30 cm in length, from the stop member(s) 88 to the distal end section 82,92. For cables comprising loop 81, the length (each of legs 83 and 84) is about 10 cm to about 20 cm. Longer or shorter lengths can be used, as desired or required for a particular furniture type or style, or for a specific type of tamper-evident securement device, such as the ones described in FIGS. 71 and 80.

Figure 40:
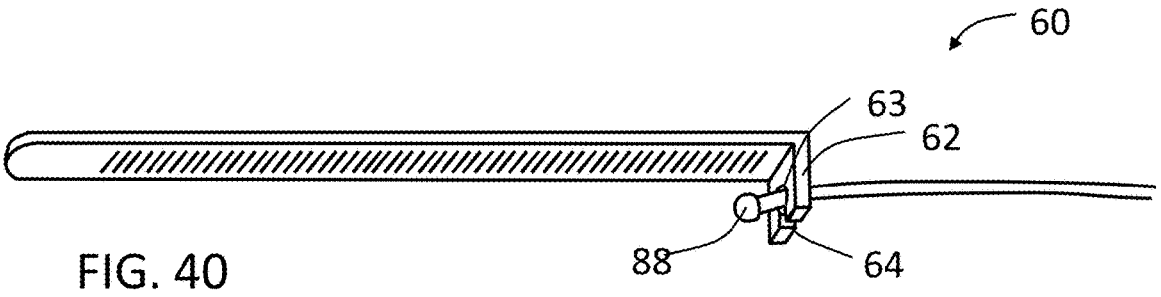
FIG. 40 shows an extending closure member comprising a cable, having a slotted endplate to attach the cable.

FIG. 40 shows another alternative extending closure member 60 to that of FIG. 36, wherein an end plate 62 has a slot opening 64 in an edge of the end plate that tapers through a throat to an opening 63. The slot and throat permit a frictional fit and passage of the cable therethrough, wherein the slot opening 64 is sized smaller than a diameter of the knot or knuckle 88 of the cable, to prevent unwanted release of the cable from the end plate 62.

Figure 41:
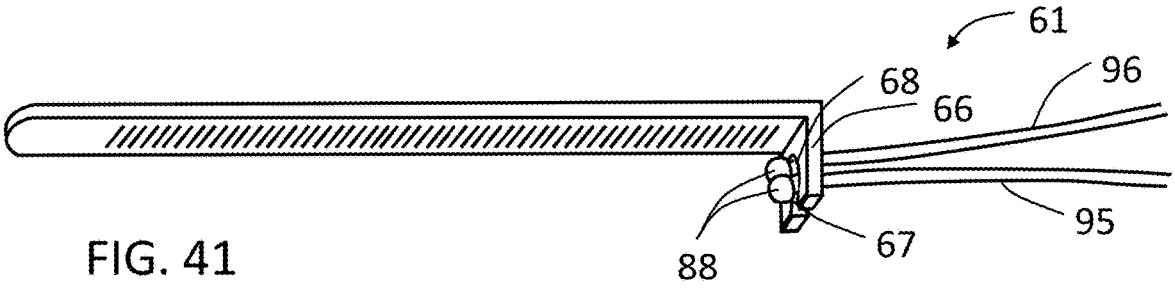
FIG. 41 shows an extending closure member comprising a cable with two legs, having a slotted endplate to attach the cable.

FIG. 41 shows an alternative extending closure member 61 to that of FIG. 40, wherein the end plate 66 has a slot opening 67 and throat into an opening 68, or optionally a pair of slot openings (not shown) into the opening 68, that is sized to accommodate both of the cable legs 95, 96 but is smaller than each diameter of the knots or knuckles 88, to prevent unwanted release of the cable from the end plate 66.

Figure 42:
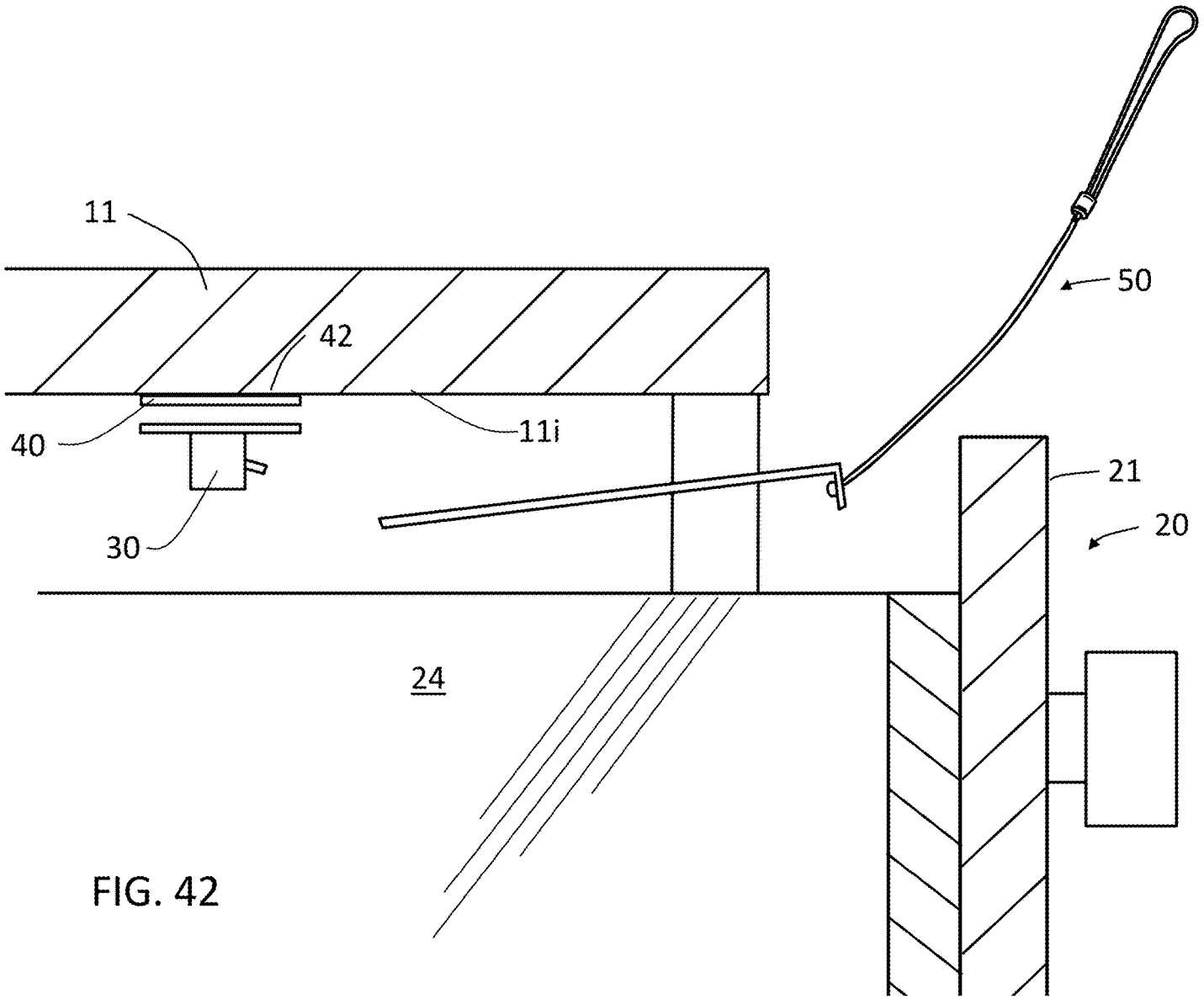
FIG. 42 shows the extending closure member of FIG. 36 and the securement member of FIG. 7 being positioned for attachment inside the first type of furniture and drawer.
Figure 43:
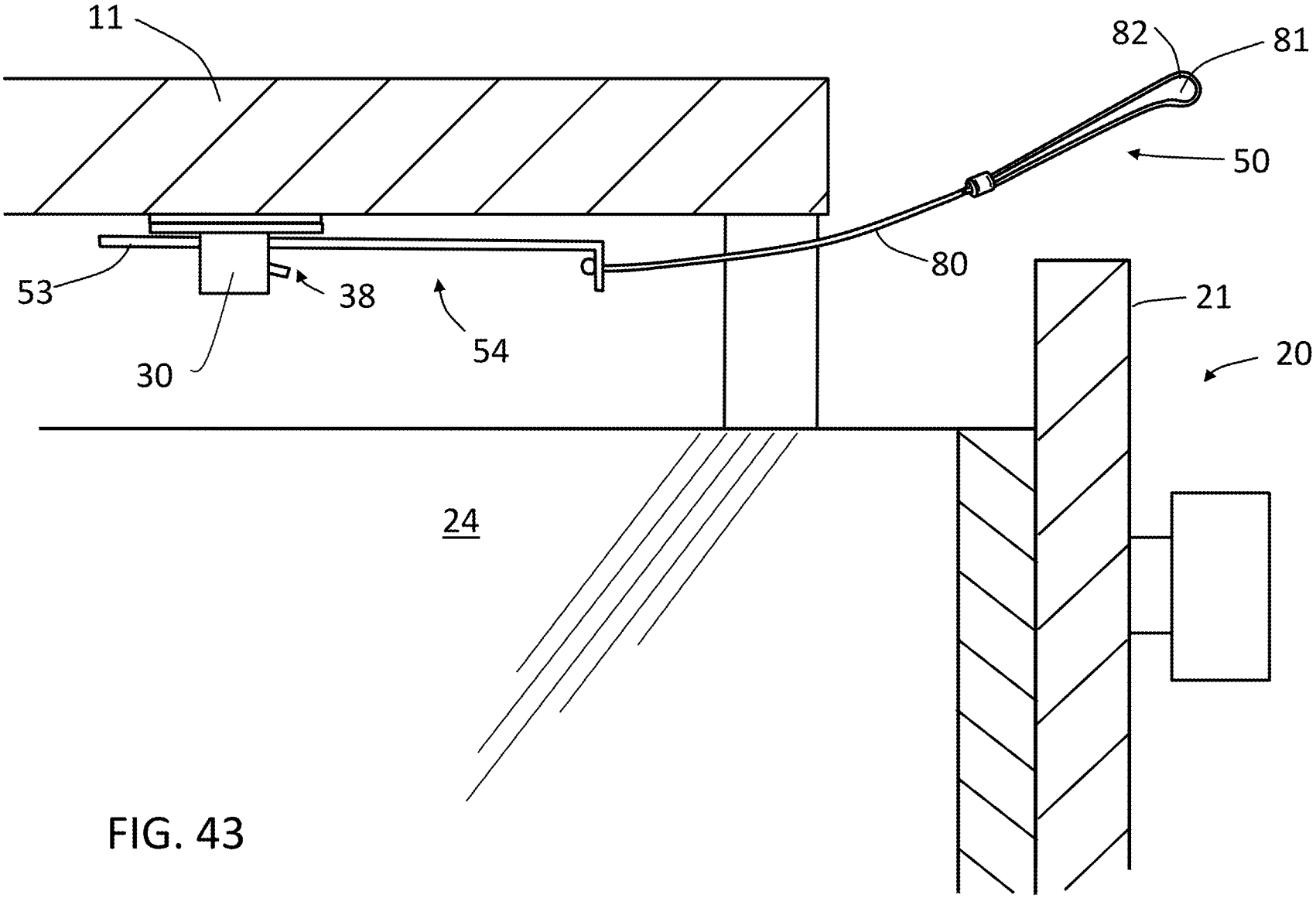
FIG. 43 shows the extending closure member of FIG. 36 partially engaged with the securement member of FIG. 7 within the first type of furniture and drawer.
Figure 44:
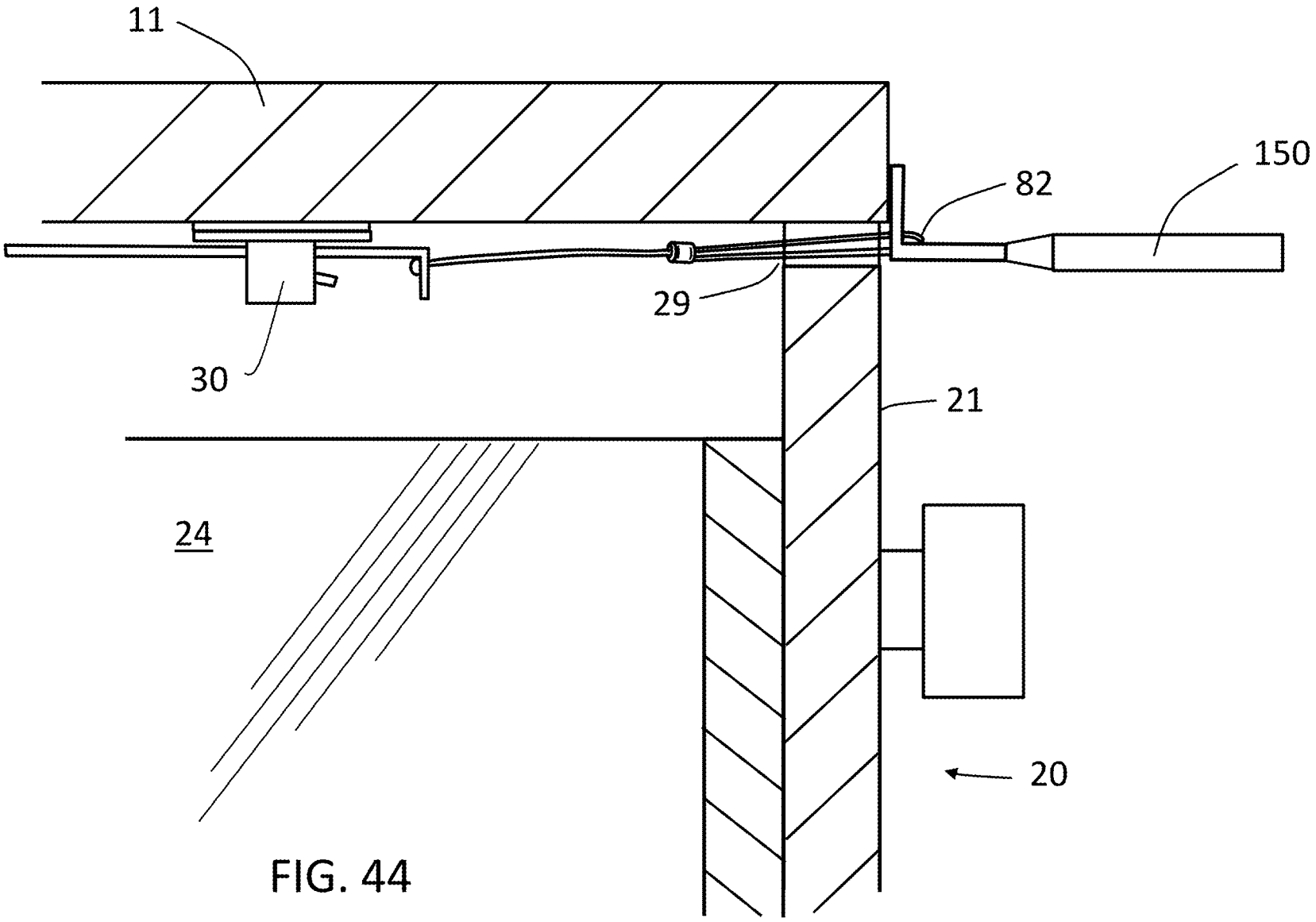
FIG. 44 shows the extending closure member of FIG. 36 being extended through the gap of the first type of furniture and drawer with an implement.
Figure 45:
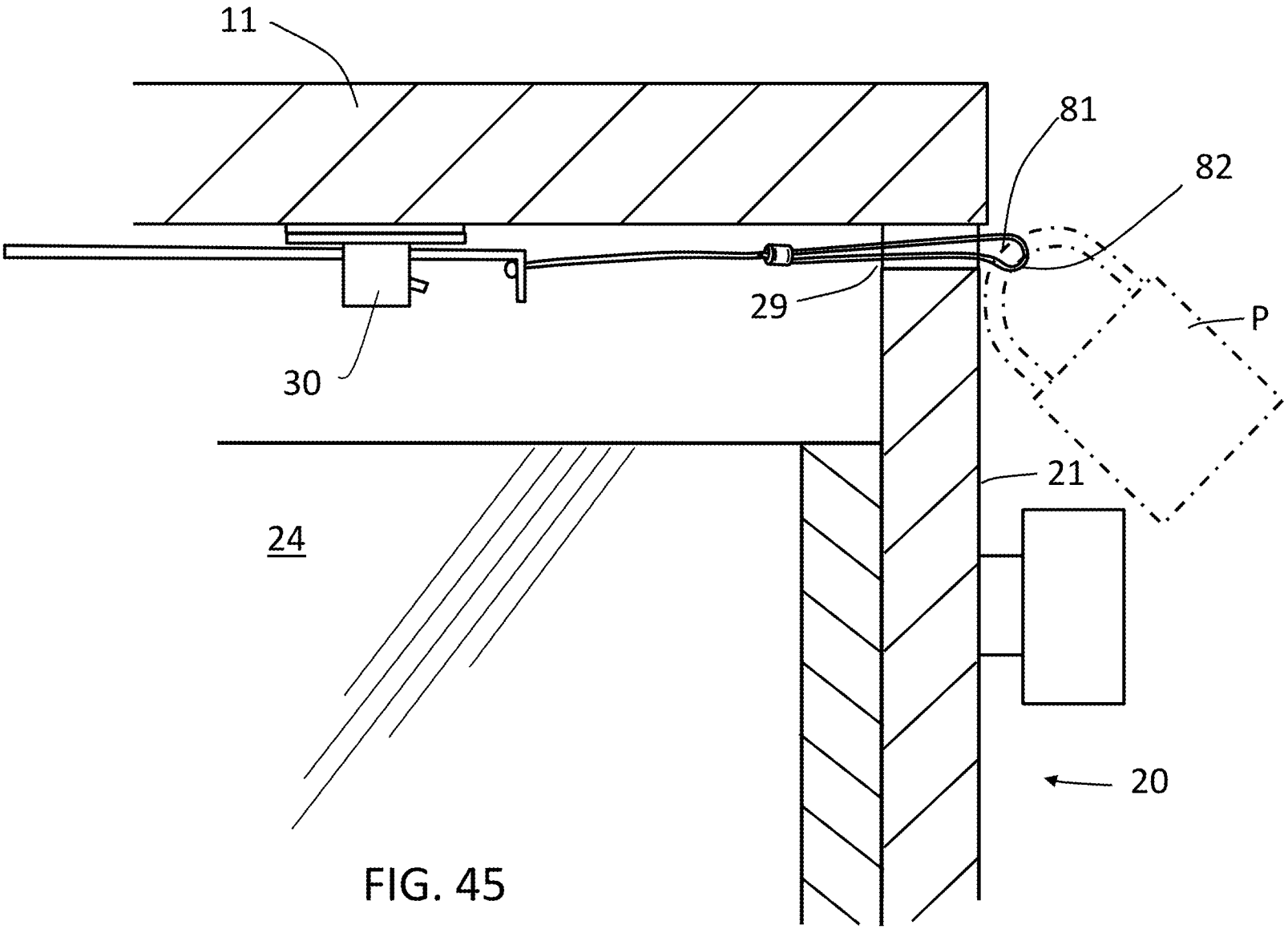
FIG. 45 shows the extending closure member of FIG. 36, attached to the securement member of FIG. 7 and secured using a padlock, in the first type of furniture and drawer, with the drawer closed.

FIGS. 42-45 show a tamper-evident securement device employing the extending closure member of FIG. 36, used in the first type of furniture and drawer shown in FIG. 3. FIG. 42 shows the drawer 20 pulled open, and an attachment base 40 secured by the user to the inner surface 11*i* of the top side 11 of the furniture. The adhesive surface 42 of the attachment base 40 may be covered with a release paper, which is removed prior to use of the adhesive surface 42. The drawer 20 is opened (FIG. 42), and the extending closure member 50 is attached to a fastener base comprising a locking head 30, as shown in FIG. 43. The user inserts the distal end section 53 of the attaching portion 54 of the extending closure member 50 into an opening and through a passage 38 of the locking head 30, with the plurality of serrations 55 (shown in FIG. 36) ratchetingly engaging one or more teeth 47 of the locking tab 32 (shown in FIG. 10). A distal end section 82 of a loop 81 of a cable 80 of the extending closure member 50 is held just outside the drawer opening as the attaching portion 54 is pushed through the locking head 30, to pull the cable 80 taut. As shown in FIG. 44, the drawer 20 is then closed within the drawer opening. Also shown in FIG. 44 is a loop-withdrawing implement 150 that can comprise a planar body having a semicircular depression and a raised cylindrical receptor, for engaging the distal loop 82. The implement further comprises laterally-extending planar supports that are disposed at a long edge of the planar body, are perpendicular to the planar body and are temporarily pressed against a front face 15*f* of the top rail, to align the implement 150 for maintaining the distal loop 82 just outside the drawer opening. In FIG. 45, after closing the drawer and releasing the implement 150, a lock device such as a shackle S of a padlock P is passed through the distal loop 82 and positioned on the face 21 of the drawer, with minimal wiggle space for pulling open the drawer, to close the drawer 20 with tamper-evident securement.

Figure 46:
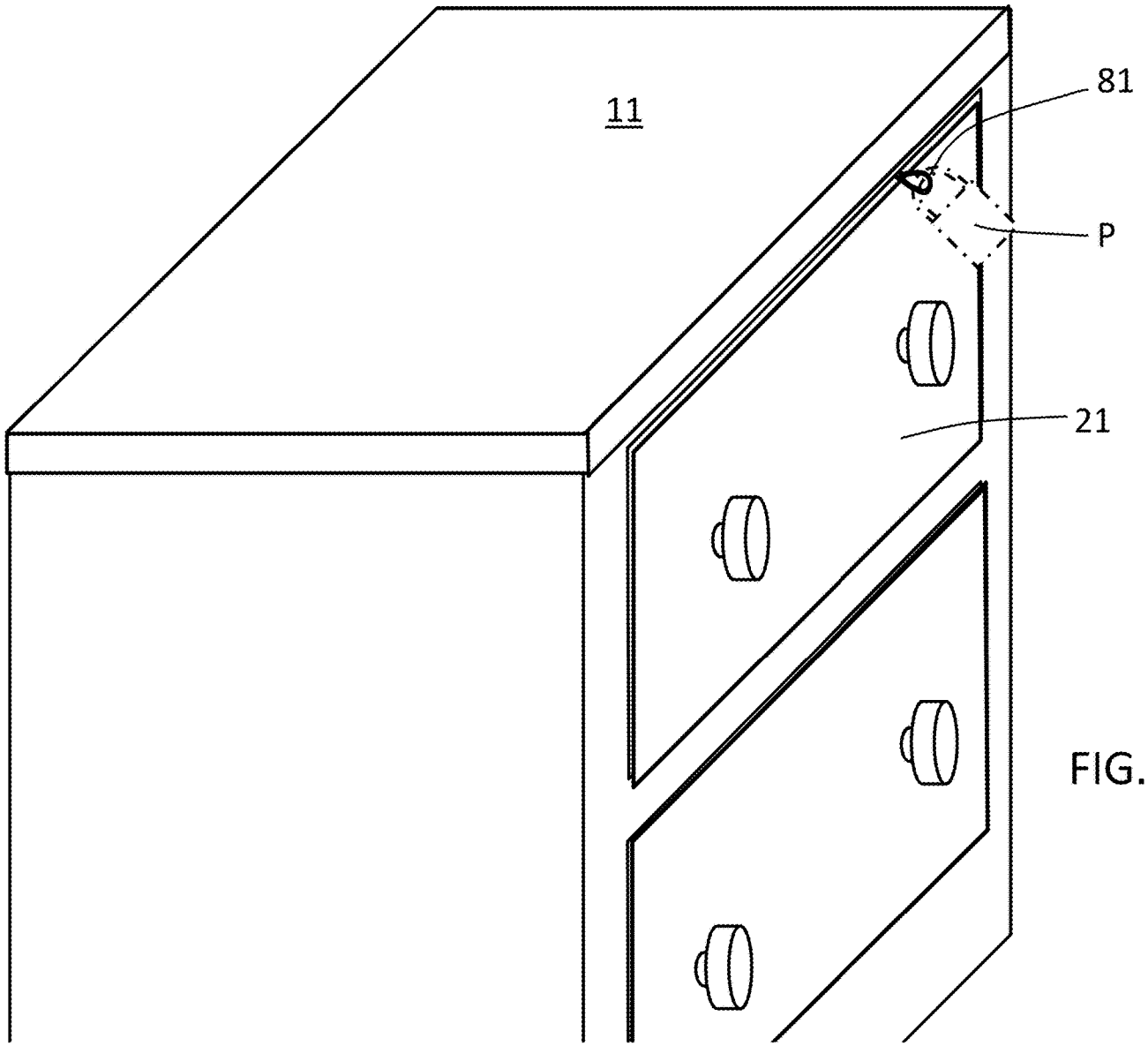
FIG. 46 shows the first type of furniture and drawer, with the extending closure member of FIG. 36 attached and locked with a padlock.

FIG. 46 shows the furniture utilizing the extending closure member 50, after closing the drawer and using the lock device such as padlock P. After use, the lock device can be removed from the loop 81, and the extending closure member 50 can be fully inserted into the locking head 30, or withdrawn out of the locking head 30 and separately stored. The extending closure member can be attached again to the locking head for a next use.

Figure 47:
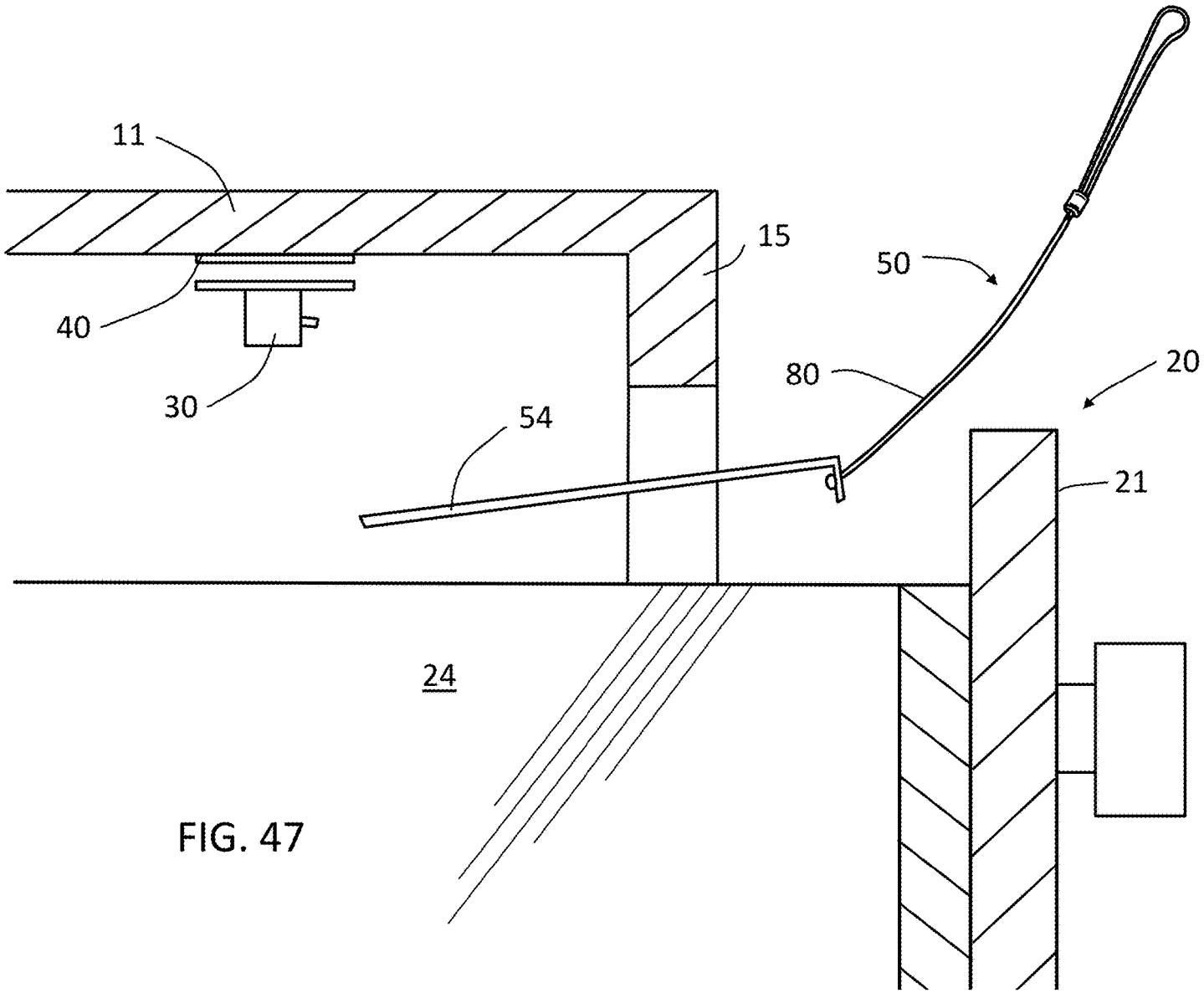
FIG. 47 shows the extending closure member of FIG. 36 and the securement member of FIG. 7 being positioned for attachment inside the second type of furniture and drawer.
Figure 48:
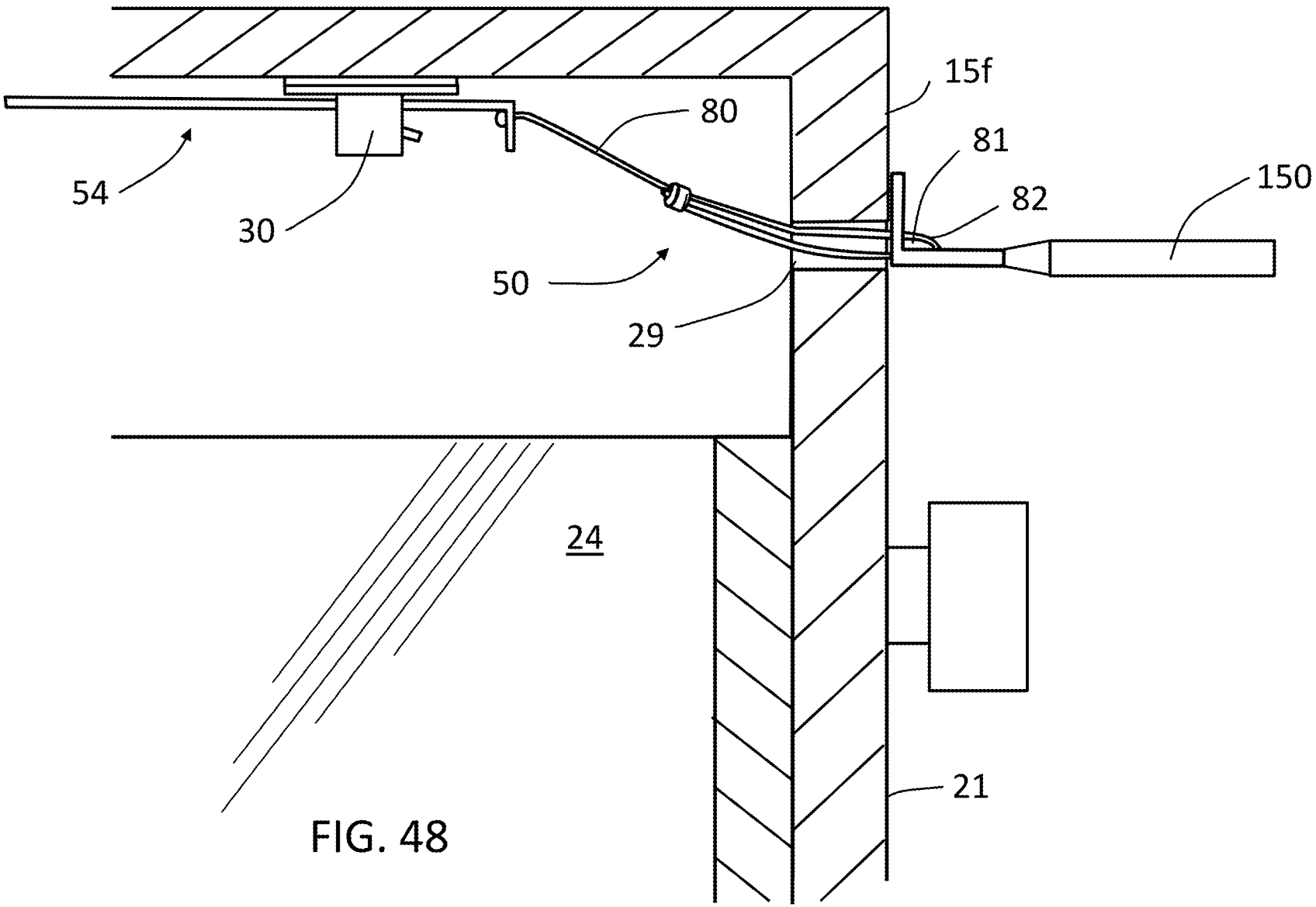
FIG. 48 shows the device of FIG. 47 with the distal end section of the extending closure member drawn through the gap with an implement.
Figure 49:
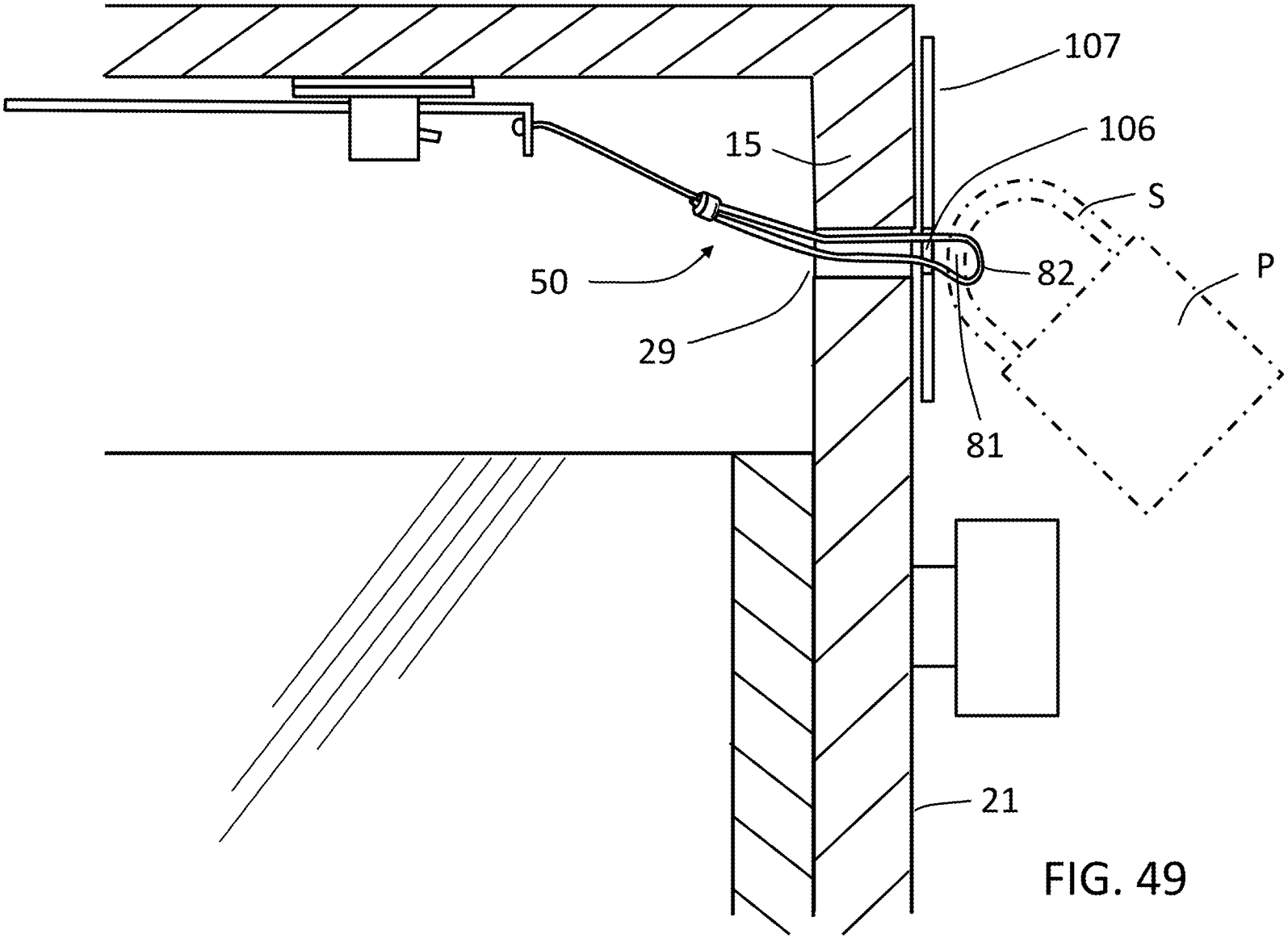
FIG. 49 shows the device of FIG. 47, attached and locked using the shield plate of FIG. 24 and a padlock, to the second type of furniture and drawer, with the drawer closed.

FIGS. 47-49 illustrate a tamper-evident securement device comprising the extending closure member of any of FIGS. 34-41, for the second style of furniture and drawer shown in FIG. 4. FIG. 47 shows positioning of the fastener base including the locking head 30 and the extending closure member 50 with the drawer 20 pulled open, similarly as previously described in FIG. 42. FIG. 48 shows the attaching portion 54 engaged in the locking head 30, and the distal end section 82 of the loop 81 of the cable 80 is held just outside the drawer opening as the attaching portion 54 is pushed through the locking head 30 to pull the cable 80 taut. A loop-extracting implement 150 maintains the distal end section 82 just outside the drawer opening. A shackle S of a padlock P is then passed through the loop 81, positioned next to the face 21 of the drawer, with very little space for pulling open the drawer, and locked as shown in FIG. 49, to secure closed and locked the drawer 20 within the furniture. The furniture with the device locking the drawer appears similarly to that in FIG. 46, except for the additional shield plate 107.

In any of the embodiments of an extending closure member, and its use as described herein, and for example as shown in FIG. 49, it may be preferred to place a shield plate 107 over the distal end section 82 of the loop 81 of the cable 80, before applying the lock device (padlock P). The shield plates are disclosed previously and are shown in FIGS. 24 and 25.

Figure 50:
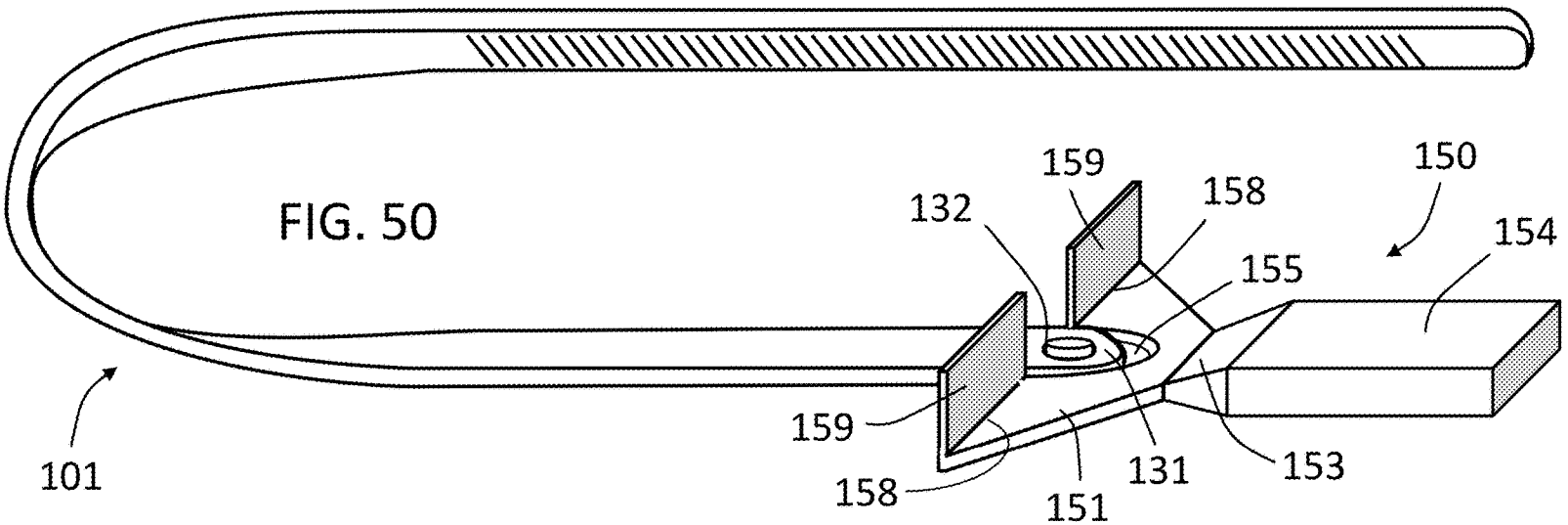
FIG. 50 shows the extending closure member of FIG. 14, further comprising an aperture-withdrawing implement engaged to the aperture of the extending closure member.

FIG. 50 shows an aperture-withdrawing implement 150 interacting with an aperture 132 of a distal end 131 of the extending closure member 101 shown in FIG. 14; other extending closure members comprising an aperture, such as those in FIGS. 15-16, 57-59, 72-74, and 79 may employ this implement 150. The aperture-withdrawing implement facilitates adjustment of the position of the aperture of the extending closure member, to stay just outside the front face of the drawer. The implement comprises a planar body 151, shown as a trapezoidal body in FIG. 50, forming an aperture-withdrawing end, wherein a short side 153 is fixed to a handle 154 at an opposite end. The planar body 151 comprises a semicircular depression 155 proximate a long side 158 of the planar body 151, that substantially fits and accommodates the distal end section 131, and a raised cylindrical receptor 156 (FIG. 51) that removably engages the aperture 132 of the closure member. The semicircular depression 155 surrounds the raised cylindrical receptor 156. Along the long side 158 of the planar body 151, two planar supports 159 extend laterally from the semicircular groove 155 and receptor 156 along the long side of the body 151, and at the junction with the long side 158, the supports extend perpendicularly, typically at a 90° angle, from the body 151. During device installation, an implement 150 engaged with the distal end section 131 and aperture 132 is maintained against a surface of the furniture to align the aperture just outside the drawer opening; the planar supports 159 are essential to increase the surface area contacting the furniture surface and the lateral stability of the alignment.

Figure 51:
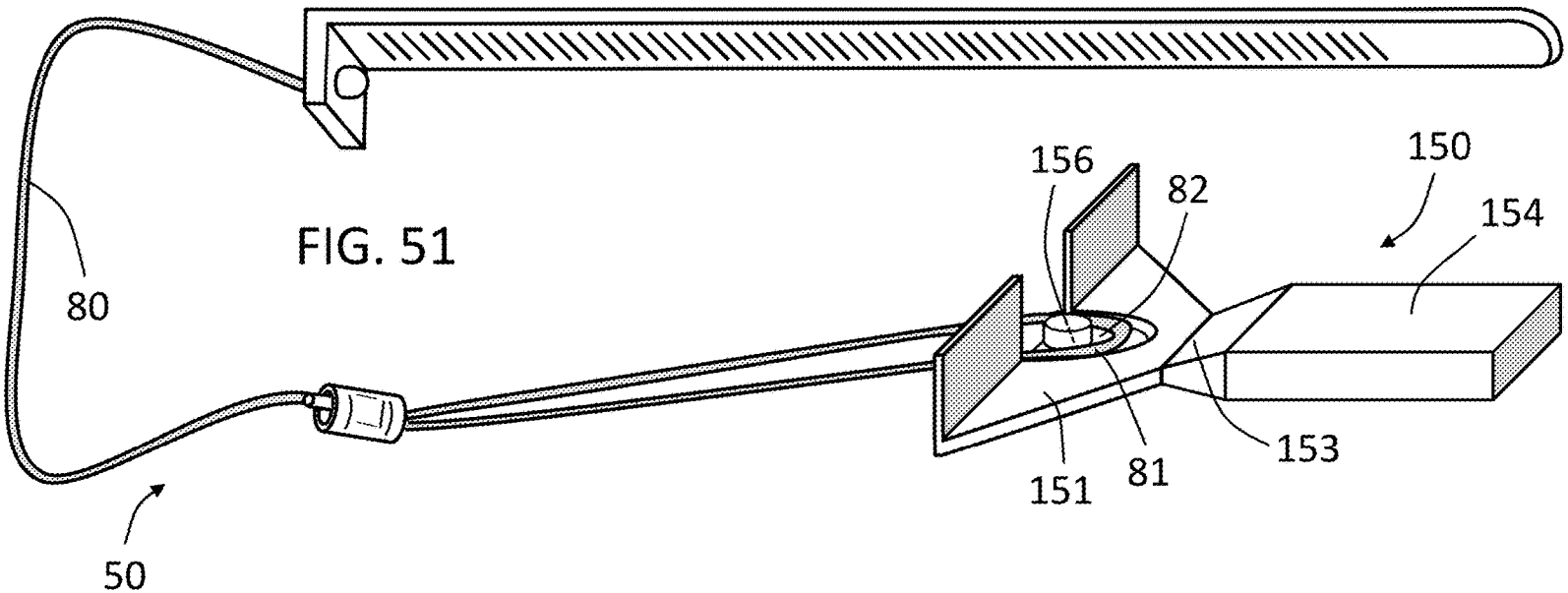
FIG. 51 shows the extending closure member of FIG. 36, further comprising an aperture-withdrawing implement engaged to the aperture of the extending closure member.

FIG. 51 shows the same implement 150 having the same purpose, interacting with the extending closure member 50 of FIG. 36 forming a loop 81 at a distal end section 82; other extending closure members comprising a loop, such as those in FIGS. 34-35, 37-41, 64, 71, and 80 may employ this implement 150.

An alternative implement (not shown) is only for maintaining the aperture 132 or loop 82 outside the drawer opening or gap; a hook end or curved end to removably engage the aperture 132 or loop 82 would suffice. An alternative aid for installing a tamper-evident securement device is having at least one pre-formed notch, groove, bevel, and/or other marking on the flexible locking portion of the extending closure member. The marking(s) would be proximal to the distal end section and aperture or loop of the flexible locking portion. For example, visible markings would aid the user in maintaining the aperture just outside the drawer opening or gap. A re-usable sleeve or other alternative implement could be placed at a notch on the flexible locking portion, comprising a perpendicular planar portion similar to the planar support 159 of the implement 150, to press against a furniture surface during installation.

Figures 86, 87:
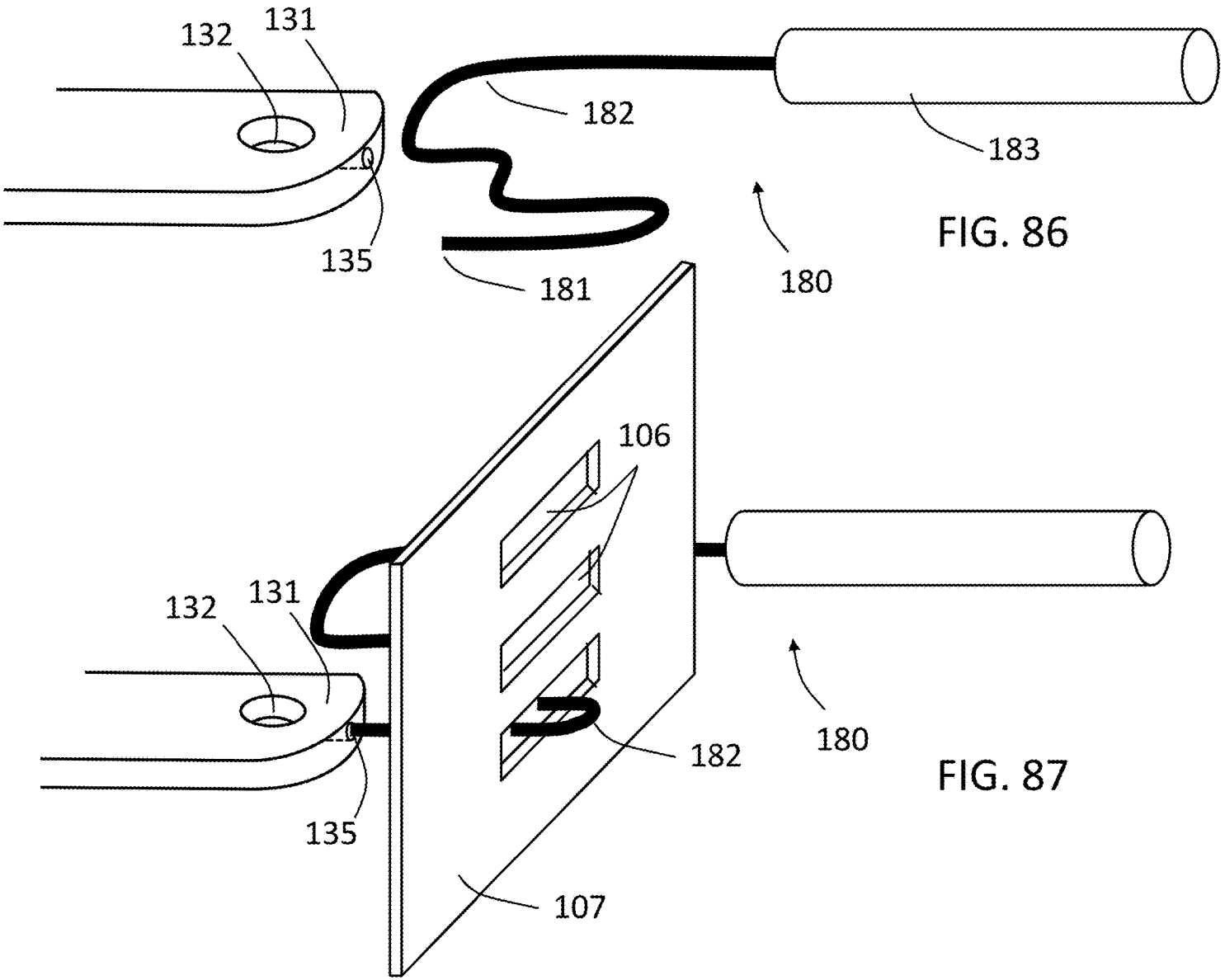
FIG. 86 shows a retracting implement comprising a molded wire that can engage a bore hole of a flexible locking portion of an extending closure.
FIG. 87 shows a shield plate interacting with the retracting implement of FIG. 86, for appropriate shield plate placement as part of device installation.

Retracting implements may be required to place a shield plate on the tamper-evident securement device, while maintaining the distal end section outside a drawer after installing the flexible extending member but before placing the lock device. FIG. 86 shows a distal end section 131 of a flexible locking portion 110, the distal end section 131 comprising an aperture 132 that traverses the entirety of the distal end section, and a bore hole 135 that is perpendicular to the direction of the aperture 132. The bore hole 135 can be threaded, and can optionally traverse completely to the aperture 132. A molded wire implement 180 comprising a handle 183 and a wire mold 182 can fit the bore hole 135 at a distal end 181; the distal end 181 can be threaded. The molded wire implement 180 could be attached in conjunction with other implements as needed, or could be attached at any stage of device installation prior to placing the shield plate. FIG. 87 shows the shield plate 107 of FIG. 24, wherein the wire mold 182 is guided through a slot 106 of the plate 107. The shield could be guided onto the distal end section 131 and past the aperture 132, such that a lock device could be inserted through the aperture 132 prior to releasing the implement 180. The slot 106 would have to comprise a width wider than the width of the distal end section 131, to be able to guide the shield plate 107 past the aperture while the implement 180 is attached.

Figure 89B:
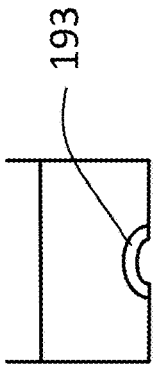
FIG. 89*b* shows a top-down view through line 6-6 of the implement of FIG. 89*a*, wherein the raised arched hook is shaped as a raised partial semicircle.
Figure 89A:
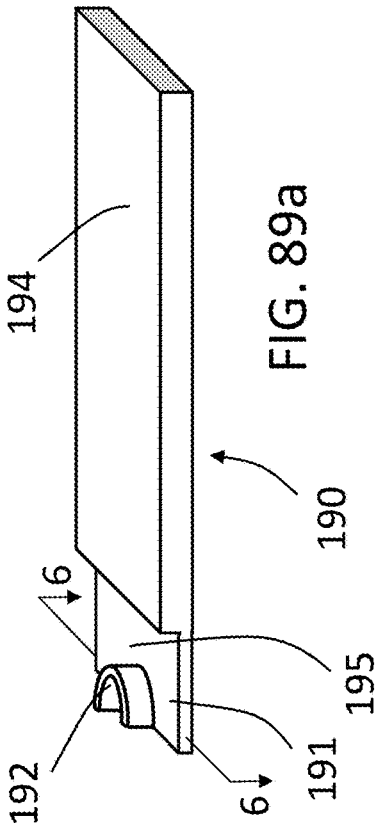
FIG. 89*a* shows a perspective view of an alternative retracting implement comprising a raised arched hook.
Figure 90:
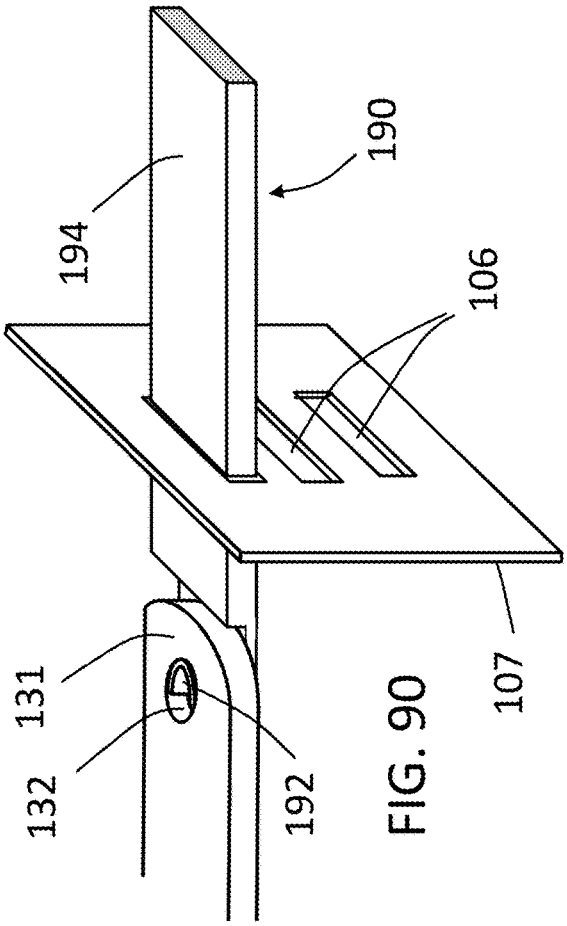
FIG. 90 shows a shield plate interacting with the retracting implement of FIG. 89*a*, for appropriate shield plate placement as part of device installation.

An embodiment of a retracting implement 190 is shown in FIG. 89*a*, and a vertical cross-section thereof through line 6-6 in FIG. 89*b*. The implement 190 can comprise a planar body such as a substantially rectangular planar body 191, wherein a raised arched hook 192 is fixed at one end, to form a retracting end, and a slim handle 194 comprises an opposite end. The raised arched hook 192 can be shaped in a raised semicircle as in FIG. 89*a* or in a raised partial semicircle 193 as in FIG. 89*b*. Further, the planar body 191 does not extend inside the radial inner portion of the raised arched hook 192. The planar body 191 has a thickness that is less than that of the raised arched hook 192 and the handle 194, forming a depression 195 that substantially fits and accommodates the distal end section 131 of the flexible locking portion 110, wherein the raised arched hook 192 removably engages the aperture 132, as shown in FIG. 90. Importantly, the portion of the implement 190 comprising the raised arched hook 192 has height and width dimensions that, when combined (by engagement) with the distal end section 131, are equal to or slightly less than respective height and width dimensions of the slot 106 of the shield plate 107 such that the entire implement 190 and the flexible locking portion 110, including the engaged distal end section 131, can slide through the slot 106 when the shield plate is positioned for device installation. In some devices, the handle 194 in fact comprises a "shield-housing" portion of the implement 190; that is, the device pre-assembly includes the shield plate 107 already on the implement 190, temporarily anchored for example at a notch along the handle 194. Also, the planar body 191 and handle 194 can alternatively be cylindrical, triangular, cubic, or other shapes, depending on the shape of the slot 106 of the shield plate 107. As defined above and as shown in FIG. 93, an aperture can also comprise a distal loop where the flexible locking portion comprises an extended flexible cable, and the retracting implement 190 can be used to similarly engage the extended flexible cable.

Figure 92:
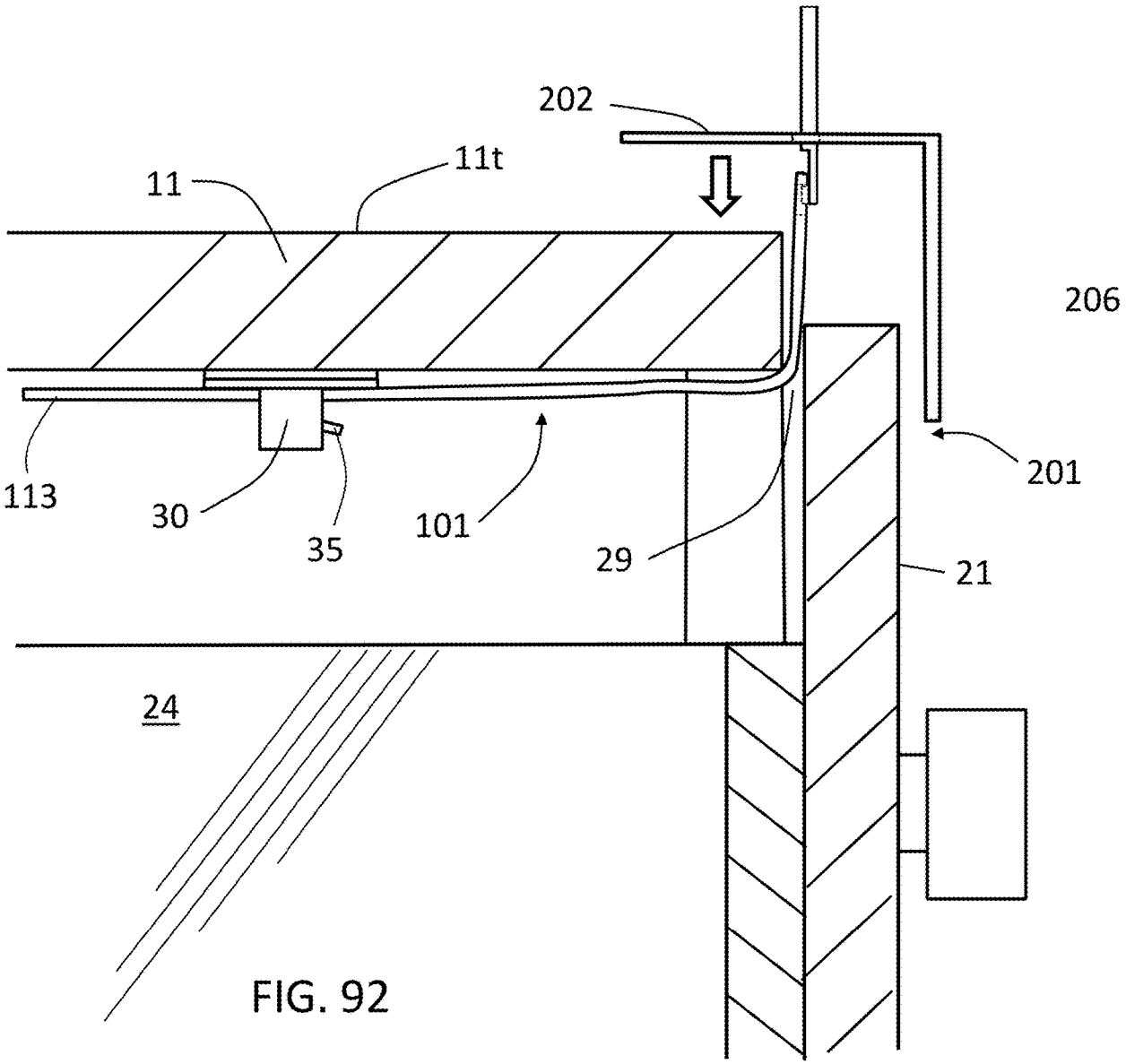
FIG. 92 shows placement of a shield plate using the implement of FIG. 89*a*, as part of installing the device of FIG. 31 in the third type of furniture and drawer.
Figure 93:
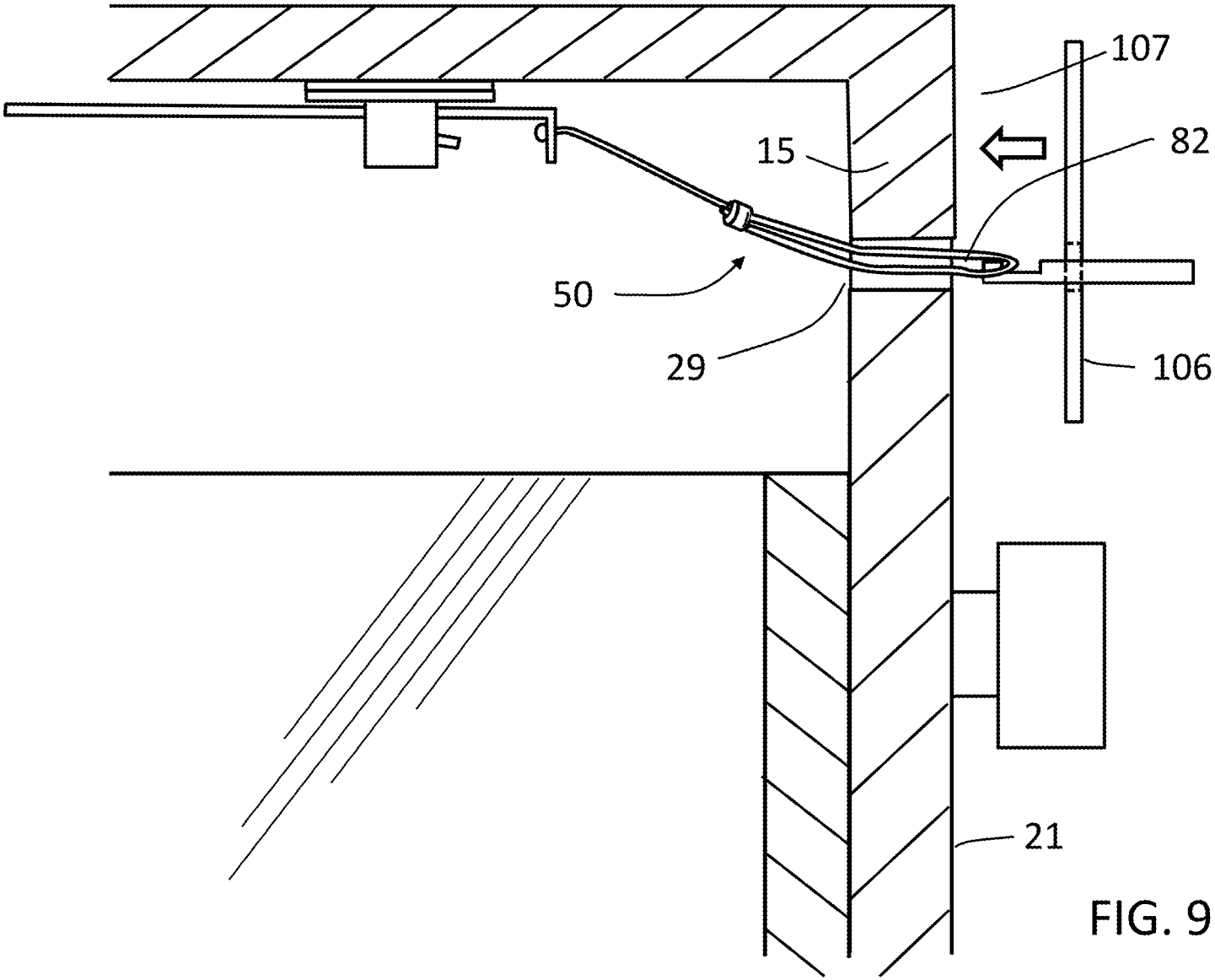
FIG. 93 shows placement of a shield plate using the implement of FIG. 89*a*, as part of installing the device of FIG. 49 in the second type of furniture and drawer.
Figure 94:
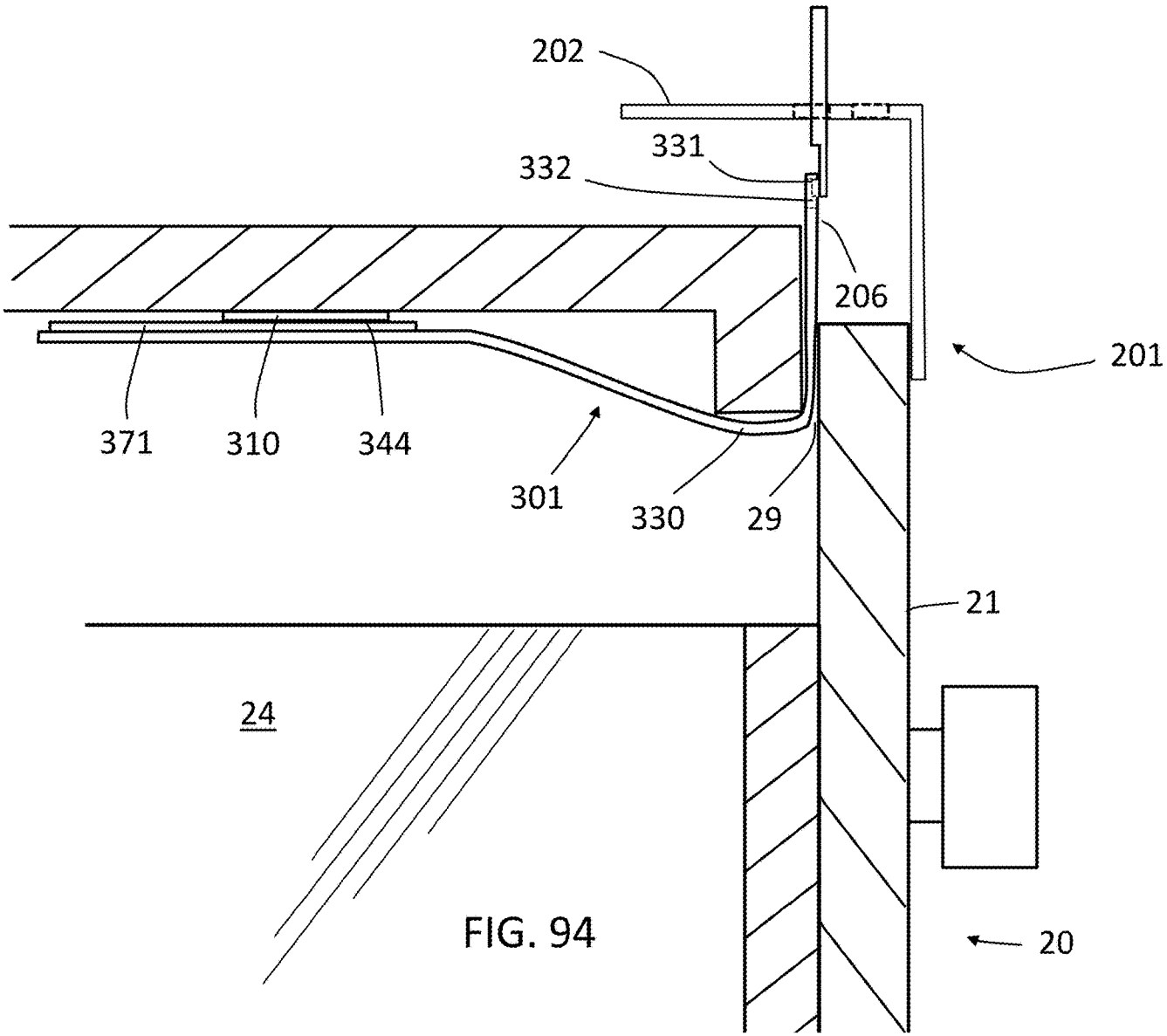
FIG. 94 shows placement of a shield plate using the implement of FIG. 89*a*, as part of installing the device of FIG. 63 in the fourth type of furniture and drawer.

A method using the retracting implement 190 permits guidance of a shield plate to appropriate placement within a securement device prior to inserting a lock device P, as shown for example in FIGS. 92-94. Once an extending closure member 101,50,301 is installed at its attaching portion to an interior surface of the drawer, preferably by using an aperture-withdrawing implement 150, prior to the step of closure of the drawer 20, the user engages the aperture 132,332 or distal loop 82 with the raised arched hook 192 of the retracting implement 190, and the user retracts the implement 190 by gently pulling it away from the furniture, such that the extending closure member 101, 50,301 is drawn taut (i.e., the aperture 132 or distal loop 82 extends just outside the gap 29). Next, the drawer 20 is closed within the drawer opening with the aperture 132 or distal loop 82 maintained just outside the gap 29. Then, if the shield plate 107 is not already anchored to the implement 190 in a "shield-housing" portion, one hand of the user maintains retraction of the implement 190 while the other hand aligns a slot 106 of the plate 107 to a distal end of the implement 190, and slides the plate 107 across the implement 190. The user can switch the hands manipulating the shield plate 107 and the implement 190, while continuing to slide the shield plate across the implement and then the distal end member 131,331 or distal loop 82 until the shield plate is flush with the front drawer surface 21, the drawer top 11*t*, or both. That is, a first hand grips the plate 107 and the second hand grips the implement 190 until the plate 107 abuts the second hand, then the first hand switches grip to the implement 190 resulting in a temporary two-hand grip on the implement 190 to maintain retraction, then the second hand switches grip to the plate 107 to continue sliding it to the drawer surface(s). Switching grip is not necessary if the implement 190 comprises the "shield-housing" portion pre-assembly and the shield plate 107 is anchored to the implement 190. Afterwards, a shackle S of a lock P is passed through the aperture 132,332 or the distal loop 82 to securely lock the drawer 20, and the implement 190 is subsequently disengaged from the distal end member 131,331 or distal loop 82, with the raised arched hook 192 passing around the shackle S.

The implement 190 may also be utilized in a method to facilitate drawer closure and shield plate placement in any embodiment of the securement device, for example those described in FIGS. 26, 33, 54, 56, 61, 69, 75, 78, 82, 83, 84, and 85, as a separate implement or as part of a combination implement with the aperture-withdrawing implement 180, as described below.

Figure 91:
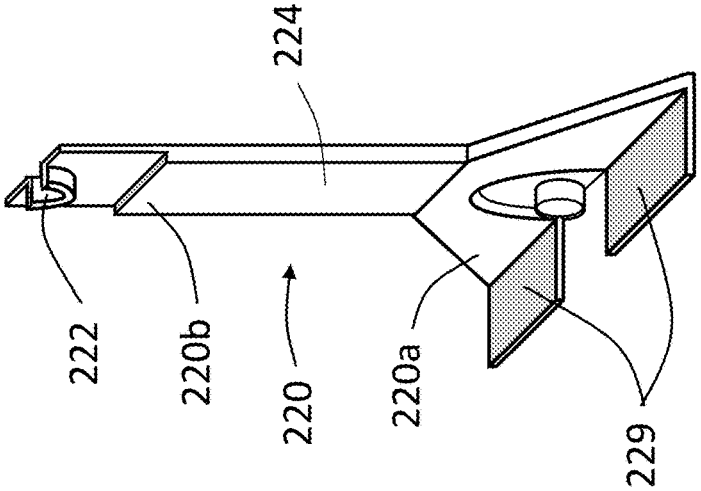
FIG. 91 shows a perspective view of a combination implement, at one end comprising the retracting implement of FIG. 89*a*, and at another end comprising the aperture-withdrawing implement of FIGS. 50-51.

In a further embodiment, as shown in FIG. 91, the aperture-withdrawing implement 150 as described above and shown in FIGS. 50-51 may be combined with the retracting implement 190 to form a combination implement 220, with one end of the implement 220*a* comprising the elements of the aperture-withdrawing implement 150 including planar supports 229, and another end of the implement 220*b* comprising the elements of the retracting implement 190 including a raised arched hook 222. The ends can be opposing as shown in FIG. 91, with the handle 224 having a cross-section dimension consistent with the handle 194 of the retracting implement, that is, a slot 106 of a shield plate 107 can slide across the handle 224. Alternatively, the ends of the combination implement 220 can be angled relative to each other in a three-dimensional orientation, for example to facilitate incorporation of other implements or tools. Further, the handle 224 can be a grip-friendly shape, with the shape of the retracting end 220*b* complementing the shape of the slot 106 of the shield plate 107.

Figure 52:
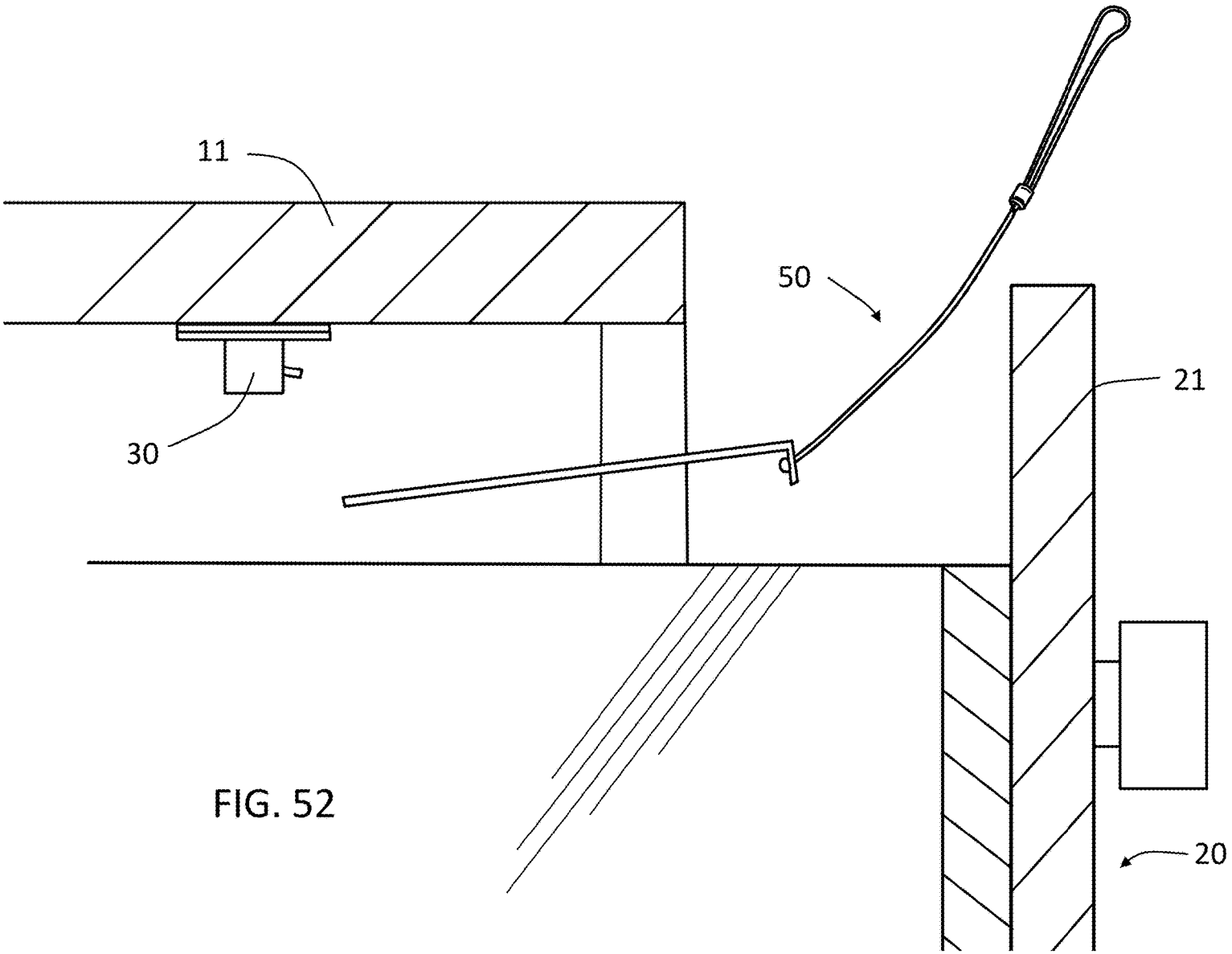
FIG. 52 shows the extending closure member of FIG. 36 being positioned for attachment inside the third type of furniture and drawer.
Figure 53:
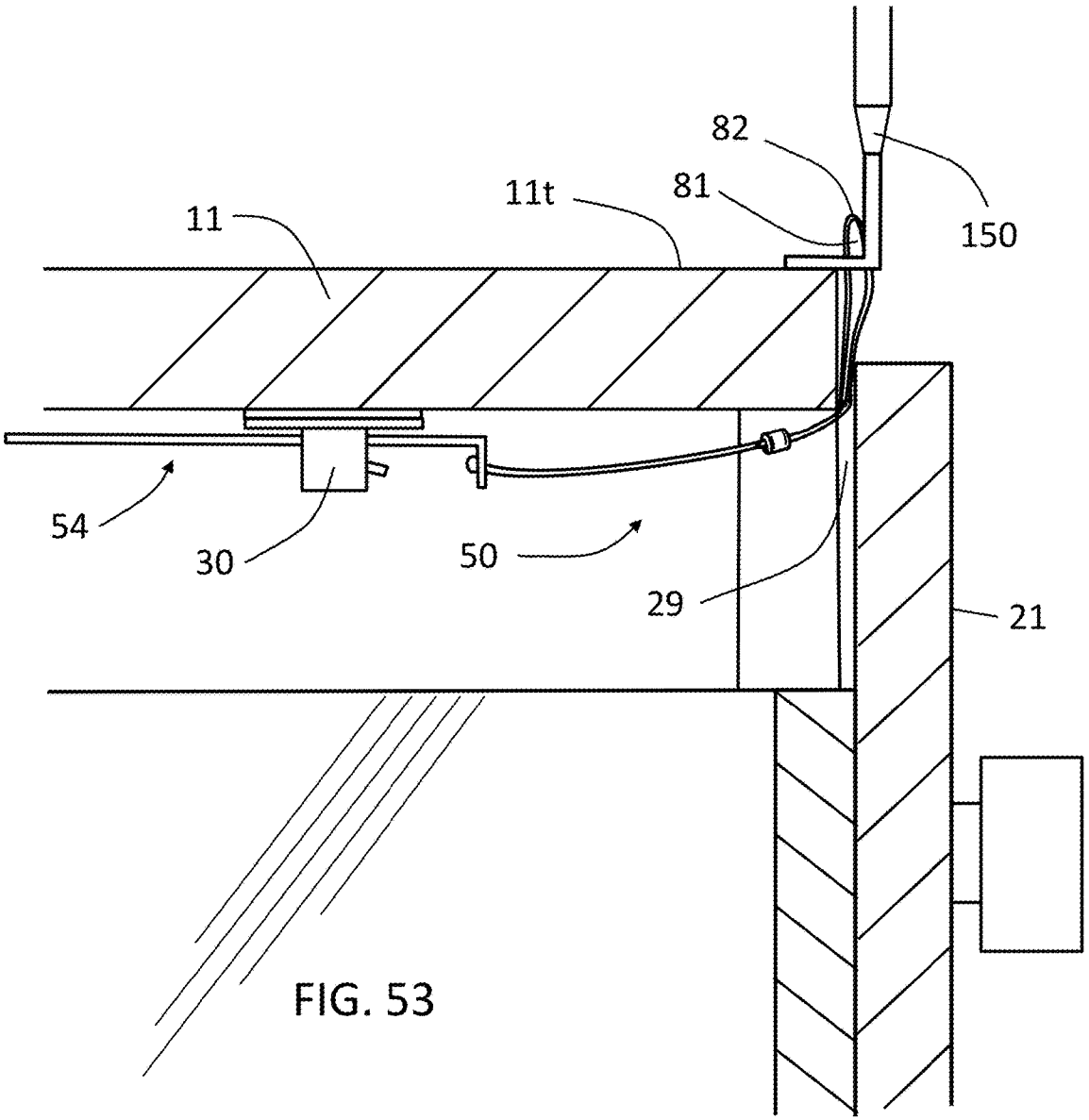
FIG. 53 shows the extending closure member of FIG. 36 engaged with a securement member and being extended through the gap of the third type of furniture and drawer with an aperture-withdrawing implement.
Figure 54:
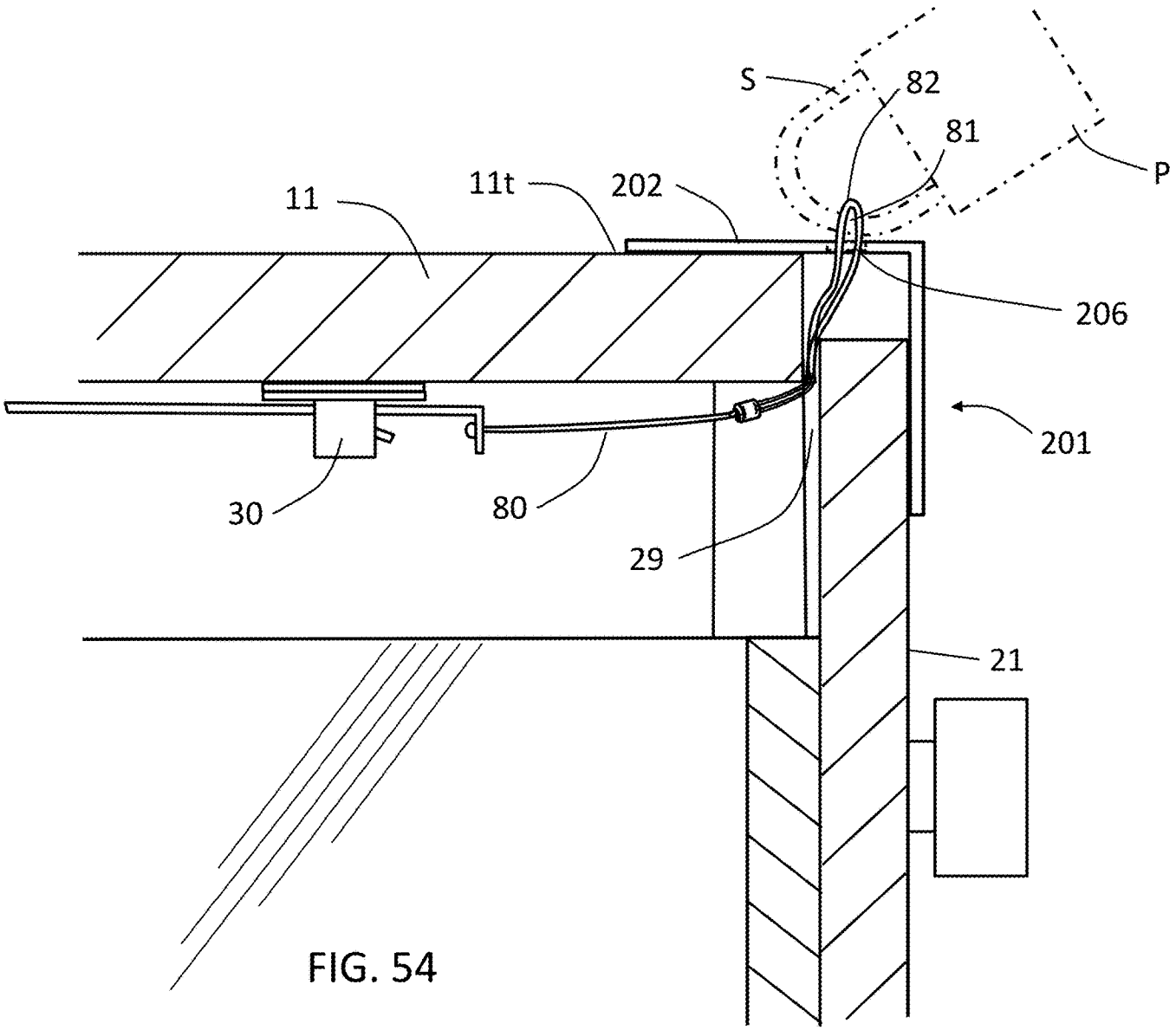
FIG. 54 shows the extending closure member of FIG. 36, attached and locked using the shield plate of FIG. 25 and a padlock, to the third type of furniture and drawer with the drawer closed.

FIGS. 52-54 illustrate a tamper-evident securement device comprising the extending closure member of any of FIGS. 34-41, for the third style of furniture and drawer shown in FIG. 5. FIG. 52 shows the fastener base including the locking head 30 and the extending closure member 50 with the drawer 20 pulled open, substantially as previously described. FIG. 53 shows the attaching end member 54 through the locking head 30, and the distal end section 82 of the cable 80 held just outside the drawer opening, preferably by using a loop-withdrawing implement 150 to maintain the cable 80 taut. The utilization of the implement 150 to maintain the distal end section 82 and loop 81 is described previously. The drawer is then closed, and the distal end section 82 of the loop 81 is then drawn through a slot 206 of the horizontal portion 202 of the angled shield plate 201 of FIG. 25, wherein the horizontal portion 202 is positioned overlaying the top exterior face 11*t* of the furniture. A shackle S of a padlock P is then passed through the loop 81, positioned just outside the slot 206, and locked, as shown in FIG. 54, to close the drawer with tamper-evident securement.

Figure 55:
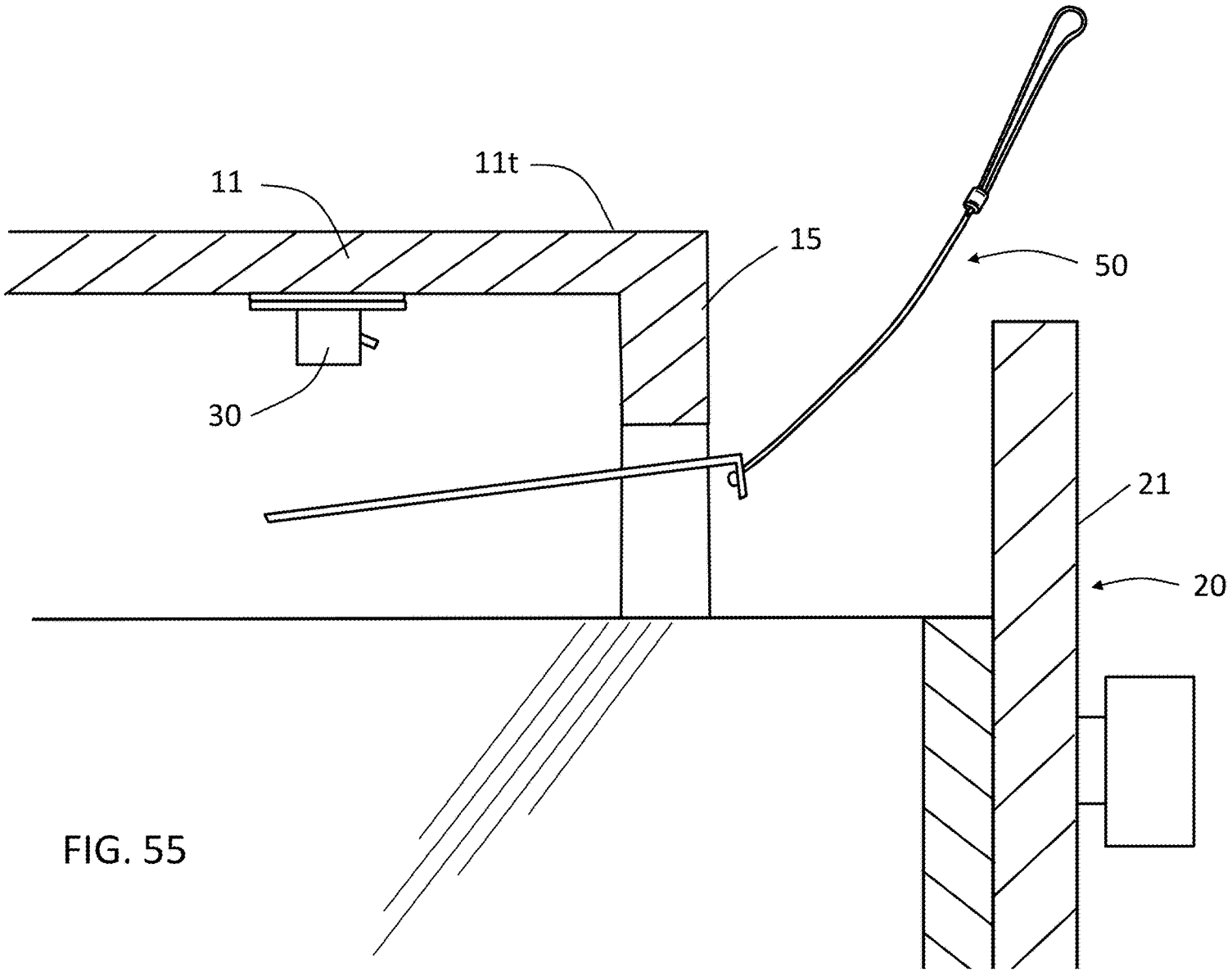
FIG. 55 shows the extending closure member of FIG. 36 being positioned for attachment inside the fourth type of furniture and drawer.
Figure 56:
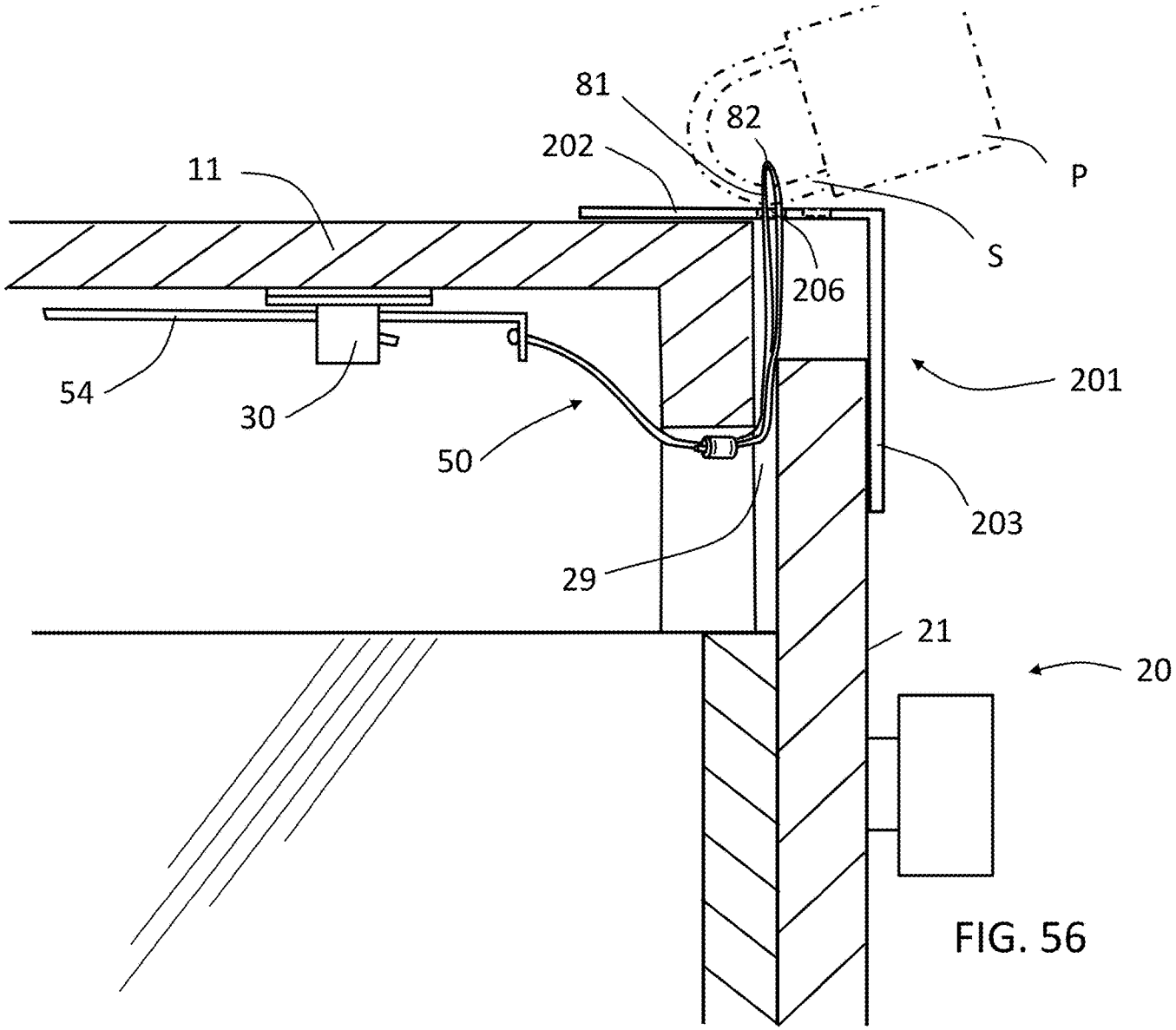
FIG. 56 shows the extending closure member of FIG. 36, attached and locked using the shield plate of FIG. 25 and a padlock, to the fourth type of furniture and drawer with the drawer closed.

A tamper-evident securement device is shown in FIGS. 55 and 56 for the fourth style of furniture and drawer shown in FIG. 6. FIG. 55 shows positioning of the fastener base including the locking head 30 and the extending closure member 50 with the drawer 20 pulled open, substantially as previously described. FIG. 56 shows the attaching portion 54 of the extending closure member 50 through the locking head 30, and the distal end section 82 of the loop 81 drawn through a slot 206 of the portion 202 of the angled shield plate 201, with a shackle S of a padlock P passed through the loop 81 and locked, similarly to the device in FIG. 54. Use of an implement 150 during installation is preferred, similarly to the use in FIGS. 52-54.

Another tamper-evident securement device comprises: 1) a securement member and 2) a flexible extending closure member, wherein the securement member comprises a fastener base comprising a ventral surface comprising a hook-and-loop mechanical fastener element configured for mechanical attachment to the hook-and-loop mechanical fastener element on a dorsal surface of the attaching portion of the flexible extending closure member, and the fastener base further comprising a dorsal surface comprising a pressure sensitive high tack adhesive for adhering to the inner surface of the top side of the furniture. The flexible extending closure member further comprises a flexible locking portion, wherein a distal end section of the locking portion comprises an opening or an aperture.

Figure 57:
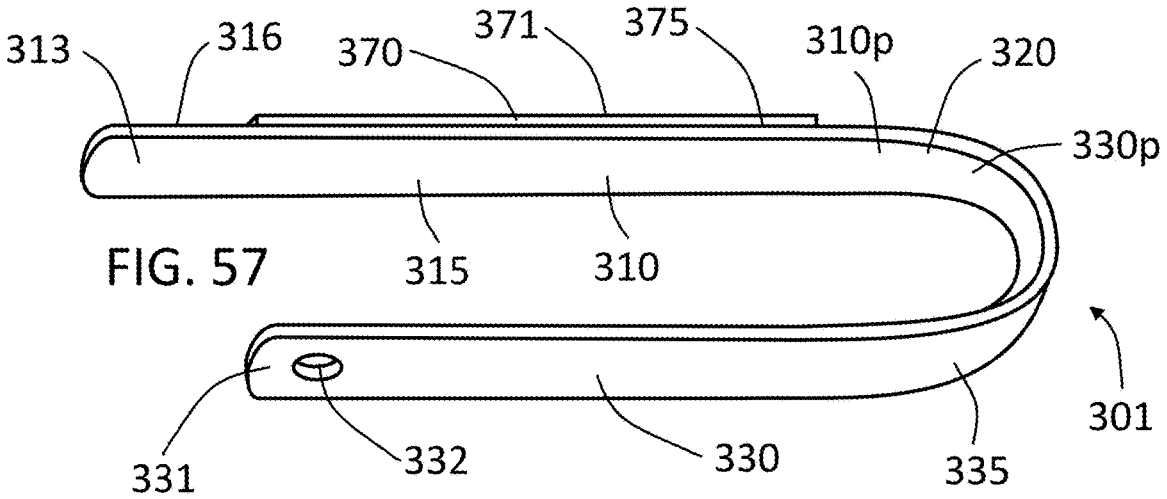
FIG. 57 shows an extending closure member comprising an attaching portion with a hook-and-loop mechanical fastener element for attachment to a securement member, and a locking portion.

FIG. 57 shows an extending closure member 301 with an attaching portion 310 having some flexibility and comprising a distal end section 313; a body section 315 with a dorsal surface 316; and a proximal end section 310*p* that is fixed to the locking portion 330 at juncture 320. The locking portion 330 has some flexibility and comprises a proximal end section 330*p* that is fixed to the proximal end section 310*p* of the attaching portion 310 at juncture 320; a body section 335 having universal flexibility to accommodate the angling and manipulation from the furniture's inner surface and through the gap between the drawer and drawer opening for any type of furniture; and a distal end section 331 which can have a rounded end, comprising a hole or aperture 332 through which a lock device, such as a shackle of a padlock, can be inserted.

The extending closure member 301 is substantially as described herein above for the extending closure member 101 of an earlier embodiment, except that the extending closure member 301 lacks the plurality of serrations 112, and instead comprises a mechanical fastener element 370 that is attached securely to the dorsal surface 316 of the attaching portion with an adhesive 375. The mechanical fastener element 370 comprises a hook-and-loop mechanical fastener 371, and includes one or the other of the hook elements or the loop elements. Typically, the fastener element 370 extends substantially along the attaching portion 310 to facilitate the adjustment of the securement device within the furniture drawer.

Figure 58:
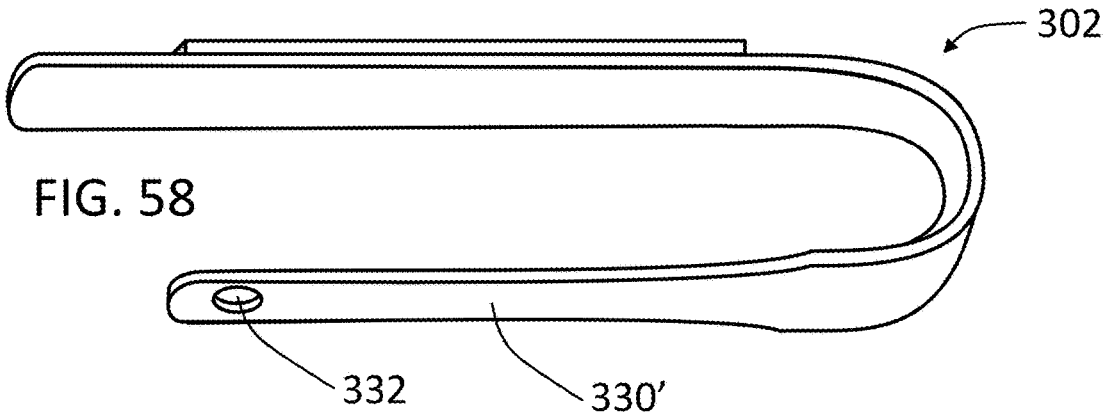
FIG. 58 shows an alternative extended closure member of FIG. 57, wherein the width of the attaching member is larger than the width of the locking portion.
Figure 59:
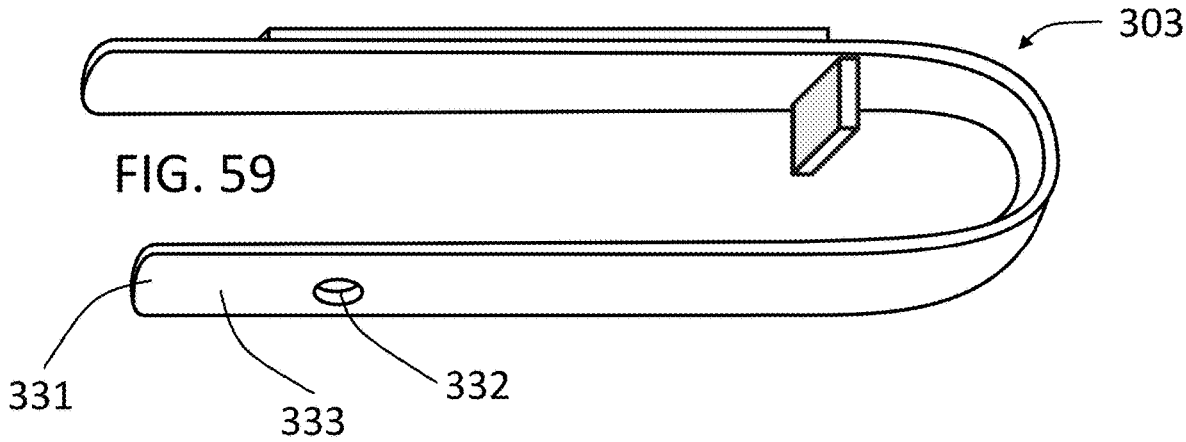
FIG. 59 shows an alternative extended closure member to that of FIG. 57, wherein a fingerplate extends from the attaching portion and wherein the distal end section of the locking portion extends past the aperture to provide a handle.

FIGS. 58 and 59 show alternative extending closure members to the that in FIG. 57. In FIG. 58, extending closure member 302 comprises a locking portion 330' is of a narrower width than the locking portion 330 of FIG. 57, while the widths of the other members are the same as previously disclosed. The extending closure member 303 in FIG. 59 further comprises a fingerplate 314 extending from the attaching section 310, similarly described as the fingerplate 114 of extending closure member 103 in FIG. 16, and also comprises an extension 333 from the locking portion 330, similar to extension 133 of extending closure member 102 in FIG. 15.

Figure 60:
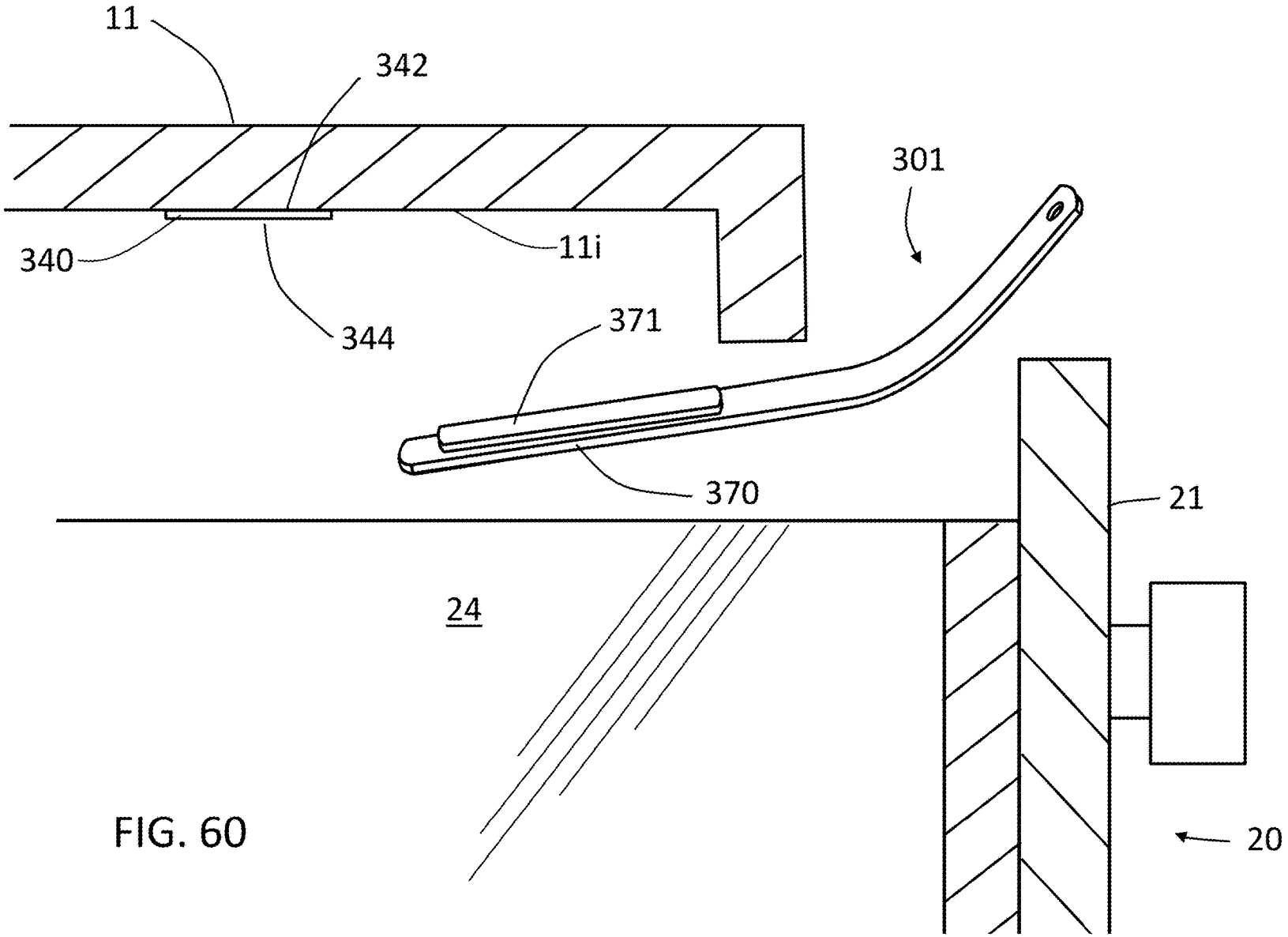
FIG. 60 shows the extending closure member of FIG. 57 being positioned for attachment inside the second type of furniture and drawer.

FIG. 60 shows positioning of the extending closure member 301 for the second type of furniture and drawer as shown in FIG. 4, with the drawer 20 pulled open. As shown in FIG. 60, a securement member comprising solely a fastener base 340 is attached, permanently or temporarily, to the inner surface 11*i* of the top side 11 of the furniture with an high tack adhesive 342, and has a ventral surface 344 comprising a hook-and-loop mechanical fastener element that is complementary to the hook-and-loop mechanical fastener element 371 of the extending closure member 301. The fastener base 340 can be an elongated planar structure that is adhered to the inner surface 11*i*, oriented transverse to the drawer opening. The fastener base can be manufactured with a release film covering the adhesive surface, which can be removed by peeling prior to attachment to the furniture.

Figure 61:
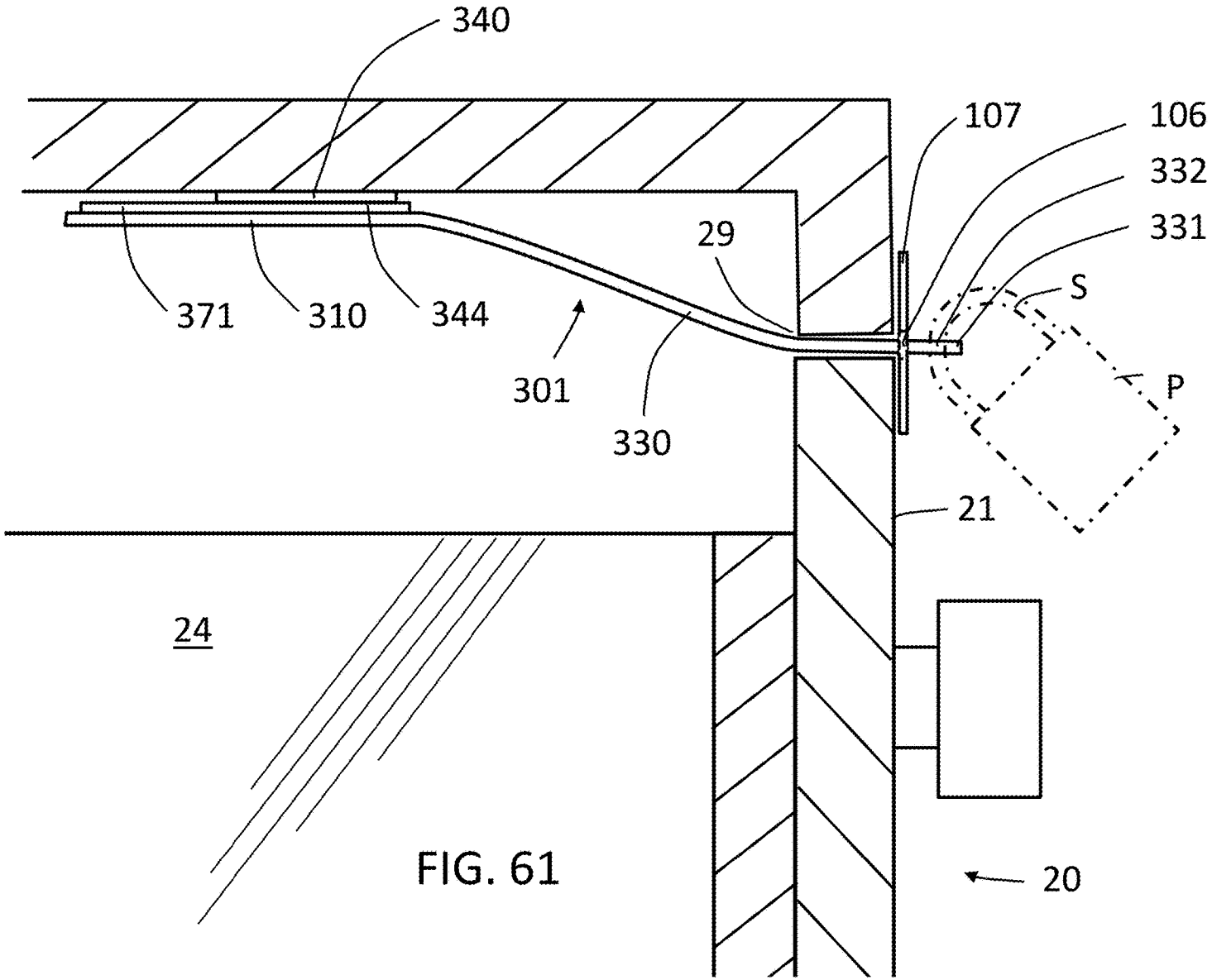
FIG. 61 shows the extending closure member of FIG. 57, attached to a securement member and locked using the shield plate of FIG. 24 and a padlock, to the second type of furniture and drawer, with the drawer closed.

FIG. 61 shows the fastener element 371 of the attaching portion 310 of the extending closure member 301 adhered to the ventral surface 344 of the fastener base 340, via a hook-and-loop mechanism. The distal end section 331 is pulled taut through the gap 29 between the drawer 20 and the furniture, and through a slot 106 of the shield plate 107 of FIG. 24, and a shackle S of a padlock P is guided through the aperture 332 of the locking portion 330 to close the drawer with tamper-evident securement.

Figure 62:
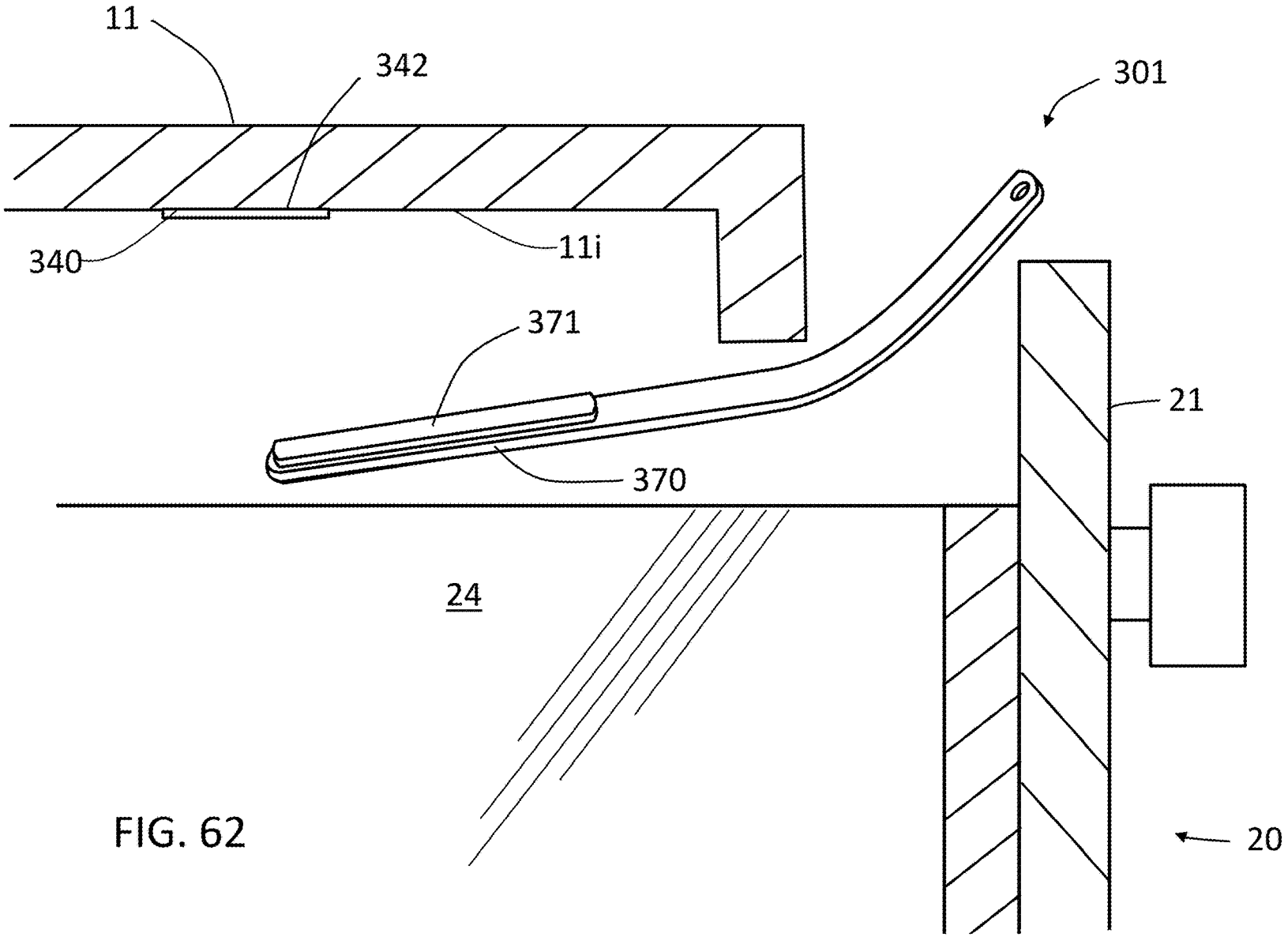
FIG. 62 shows the extending closure member of FIG. 57 being positioned for attachment inside the fourth type of furniture and drawer.

FIG. 62 shows positioning of the extending closure member 301 for the fourth type of furniture and drawer as shown in FIG. 6, with the drawer 20 pulled open. As shown in FIG. 60, a securement member comprising solely of a fastener base 340 is attached, permanently or temporarily, to the inner surface 11*i* with an adhesive 342, and has a ventral surface 344 comprising a hook-and-loop mechanical fastener element that is complementary to the hook-and-loop mechanical fastener element 371 of the extending closure member 301.

Figure 63:
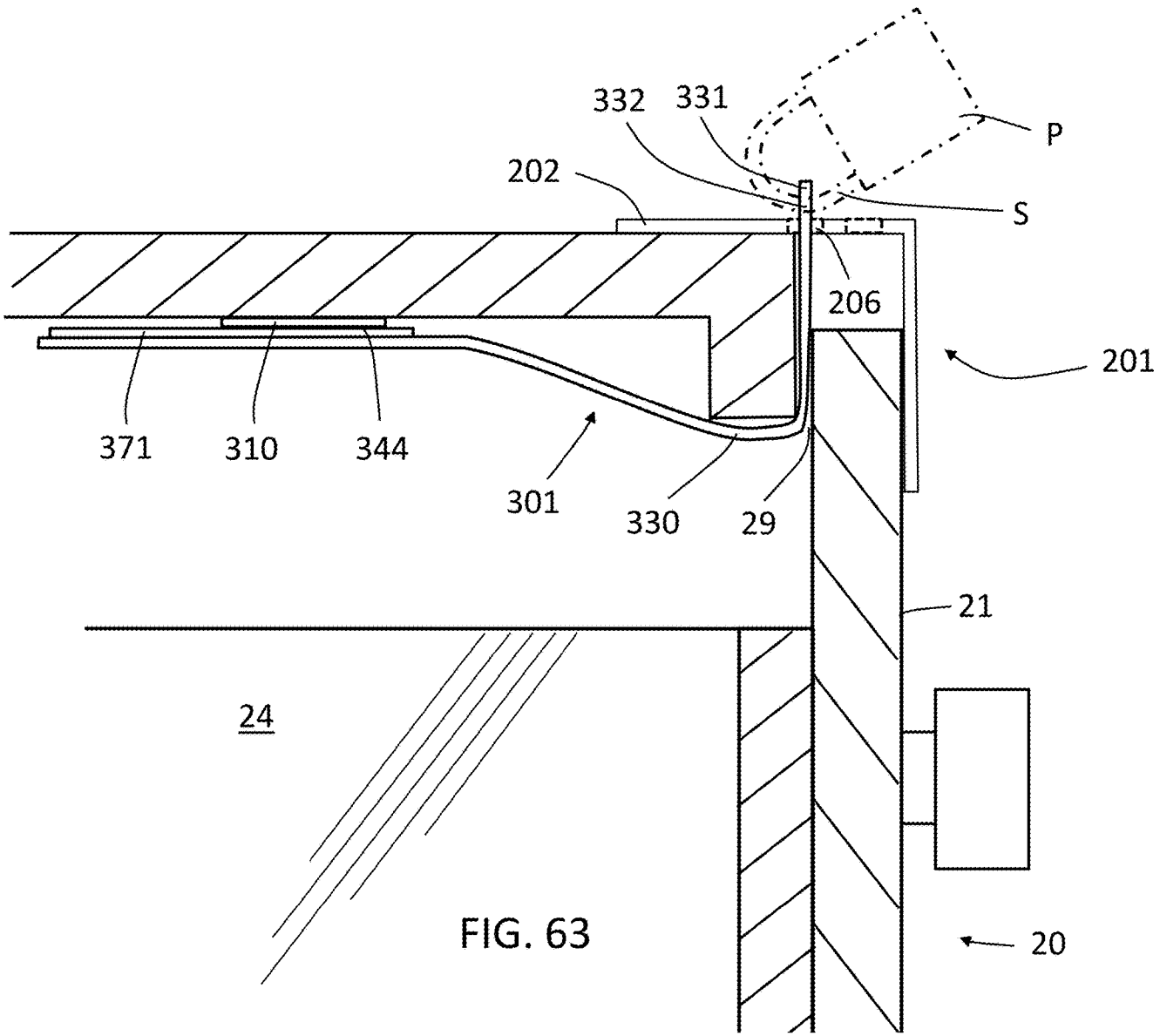
FIG. 63 shows the extending closure member of FIG. 57, attached to a securement member and locked using the shield plate of FIG. 25 and a padlock, to the fourth type of furniture and drawer with the drawer closed.

FIG. 63 shows the fastener element 371 of the attaching portion 310 of the extending closure member 301 adheres to the ventral surface 344 of the fastener base 340, via a hook-and-loop mechanism. The drawer 20 is closed. The distal end section 331 is pulled taut through the gap 29 between the drawer 20 and the drawer opening, and through a slot 206 of portion 202 of an angled shield plate 201 (of FIG. 25), and the shackle S of a padlock P is guided through the aperture 332 of the locking portion 331 to secure the locking of the drawer to the furniture.

The extending closure member 301 is made of one or more resilient materials and a thickness suitable to provide resilience but with flexibility so it can be bent to adapt to different styles of drawers, such as those shown in FIGS. 3 to 6. Non-limiting examples of a material for members 310, 320, 330 of the extending closure member 301 includes the materials that are described heretofore for the extending closure member 101. A thickness of the attaching portion 310 and the locking portion 330 can be the same or different, typically from about 0.5 mm to about 5 mm, more typically from about 0.8 mm to about 3 mm, and the width is typically from about 5 mm to about 5 cm, more typically from about 8 mm to about 2 cm. The extending closure member 301 is typically from about 10 cm to about 50 cm in length, more typically from about 20 cm to about 40 cm. Longer or shorter lengths can be used, as desired or required for a particular furniture type or style.

Figure 64:
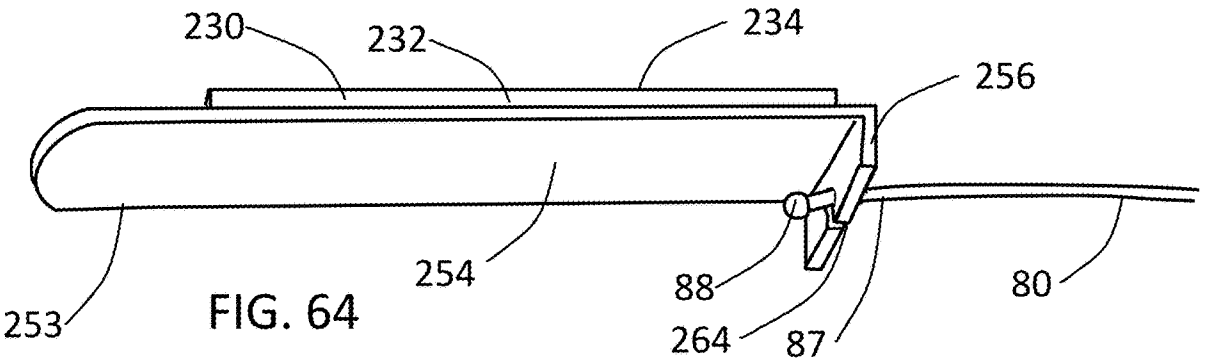
FIG. 64 shows an extending closure member with a hook-and-loop attachment.

FIG. 64 shows a tamper-evident securement device with a mechanical hook-and-loop attachment to an inner surface of a furniture. This device can be used for tamper-evident securement of any style of furniture and drawer shown in FIGS. 3-6, and it is very suitable for a drawer of a file cabinet. The extending closure member comprises an attaching portion 254 comprising a distal end section 253 and a proximal end section 256 formed as an end plate, similarly as described hereinabove. The end plate 256 can have a hole (not shown), or a slot 264, through which the proximal end section 87 of the cable, illustrated as cable 80, is passed and fixed therein with a stop member 88, which can be a knot or knuckle 88 formed in the tip end of the cable 80 to prevent removal of the distal end section 87 from the end plate 256. Non-limiting typical materials from which the attaching portion can be made are plastic, metal, ceramic, silicon, and laminates thereof. The width and thickness of the attaching portion are typically from about 1 cm to about 5 cm in width, more typically about 2 cm to about 4 cm wide, and about 0.75 mm to about 5 mm thick, more typically about 1 mm to about 3 mm thick. The metals can include, without limitation, steel, stainless steel, brass, aluminum, iron, and mixtures and alloys thereof. The plastic can include, without limitation, nylon, polypropylene acrylonitrile butadiene styrene (ABS), fluoroplastics, polyaryletherketone, polyesters, polyamides, polycarbonate, acrylonitrile styrene, and polyvinylchloride, and laminates and composites thereof. The attaching portion can be molded, cast, formed, machined, extruded and forged by well known means.

A fastener base 230 is attached securely to a dorsal surface of the attaching portion 254 with an adhesive 232. The fastener base 230 has an upper portion 234 comprising a hook-and-loop mechanical fastener, and includes one or the other of the hook elements or the loop elements. Typically, the fastener base 230 extends along the substantial portion of the length of the attaching portion to facilitate adjustment within the furniture drawer.

Figure 65:
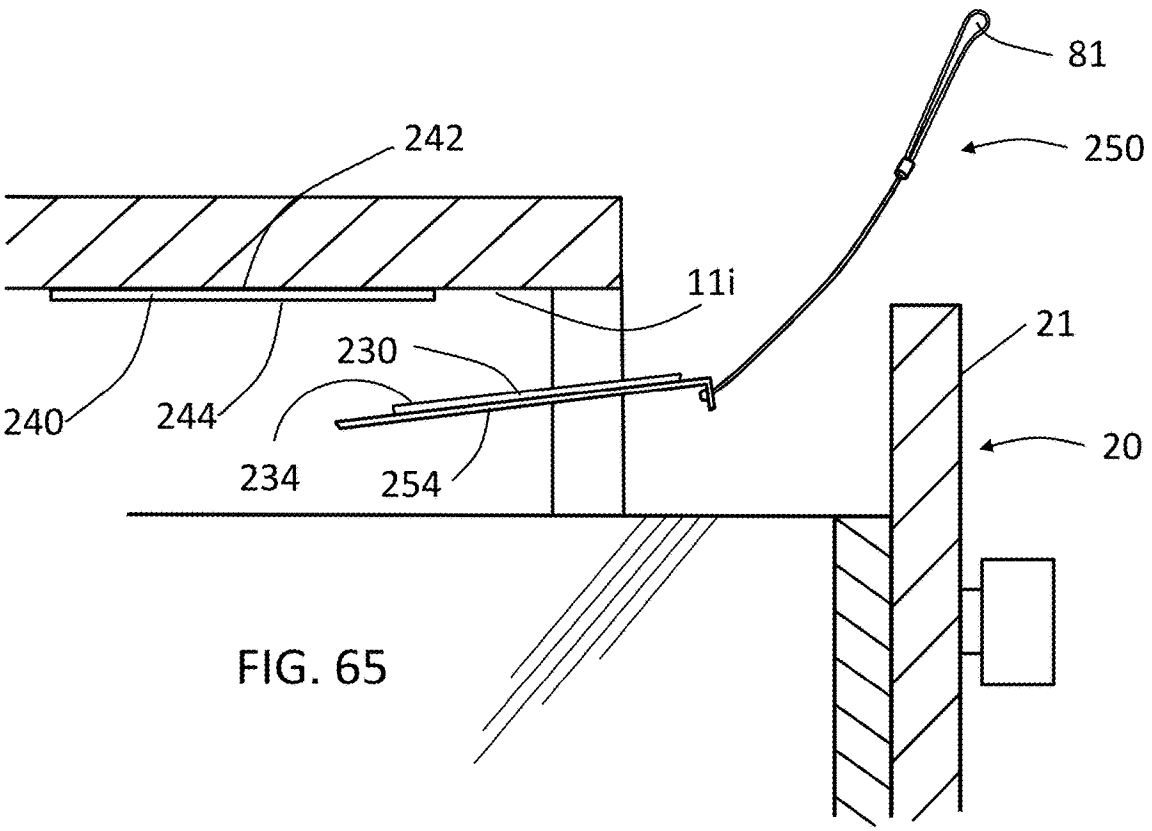
FIG. 65 shows the device of FIG. 64, with the extending closure member being positioned for attachment inside the first type of furniture and drawer.

FIG. 65 shows positioning of the extending closure member 250 for the first type of furniture and drawer as shown in FIG. 3, with the drawer 20 pulled open. An attachment base 240 is attached, permanently or temporarily, to the inner surface 11*i* of the furniture top with an adhesive 242, and has a lower portion 244 comprising a hook-and-loop mechanical fastener element that is complementary to the hook-and-loop mechanical fastener element 234 of the fastener base 230 on the attaching portion 254. The attachment base can be an elongated planar structure that is adhered to the inner surface, oriented transverse to the drawer opening. The attachment base element can be manufactured with a release film covering the adhesive surface 242, which can be removed by peeling prior to attachment.

Figure 66:
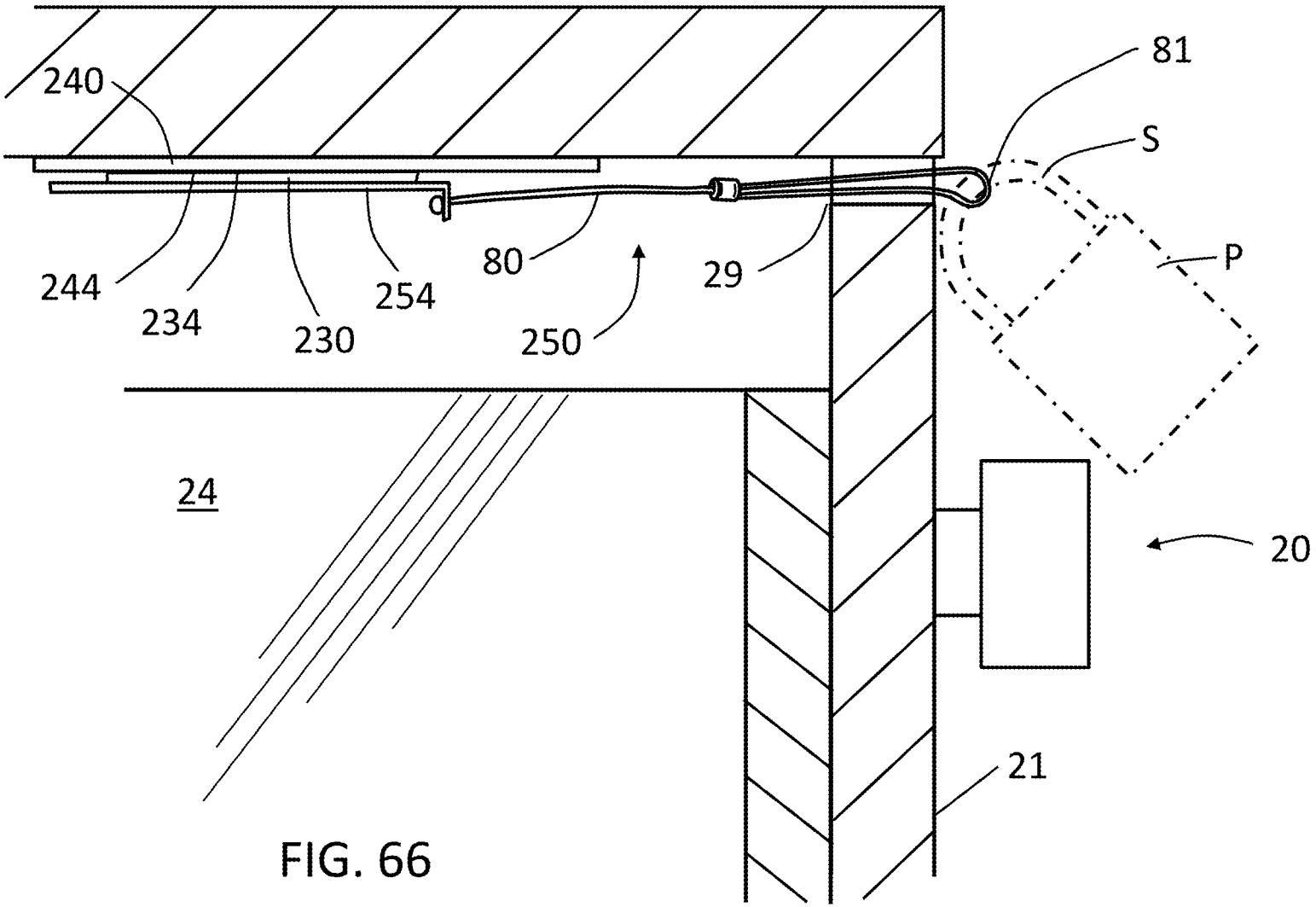
FIG. 66 shows the device of FIG. 64, attached and secured using a padlock, to the first type of furniture with the drawer closed.

FIG. 66 shows the fastener base 230 of the attaching portion 254 of the extending closure member 250, adhered to the ventral surface 244 of the attachment base 240, via a hook-and-loop mechanism. The drawer 20 is then closed. As described in earlier embodiments, the distal end of the loop 81 of the cable 80 is held just outside the drawer opening as the attaching portion 254 is inserted and adjusted into the drawer opening to pull the cable 80 taut. A loop-withdrawing implement 150 can be used to maintain the distal end of the loop 81 just outside the drawer opening until the fastening element of the attaching portion can be pressed against and mechanically attached to the attachment base. The drawer 20 is then closed within the drawer opening, and a shackle S of a padlock P is then passed through the loop 81 to secure closed and locked the drawer 20 within the furniture.

Figure 67:
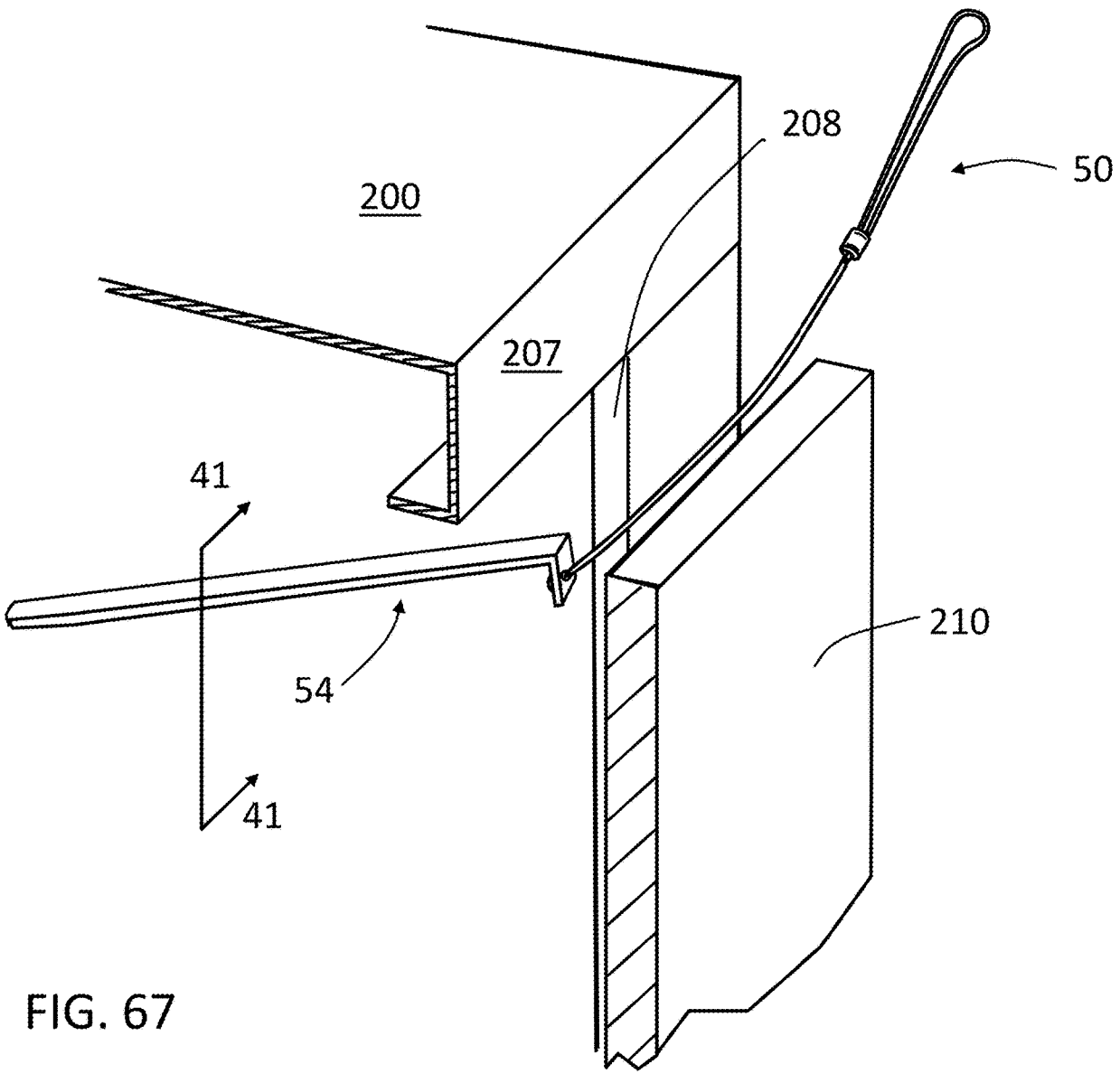
FIG. 67 shows a perspective view of the extending closure member of FIG. 36 being positioned for attachment inside of a file cabinet with a file drawer opened within the file drawer opening.
Figure 68:
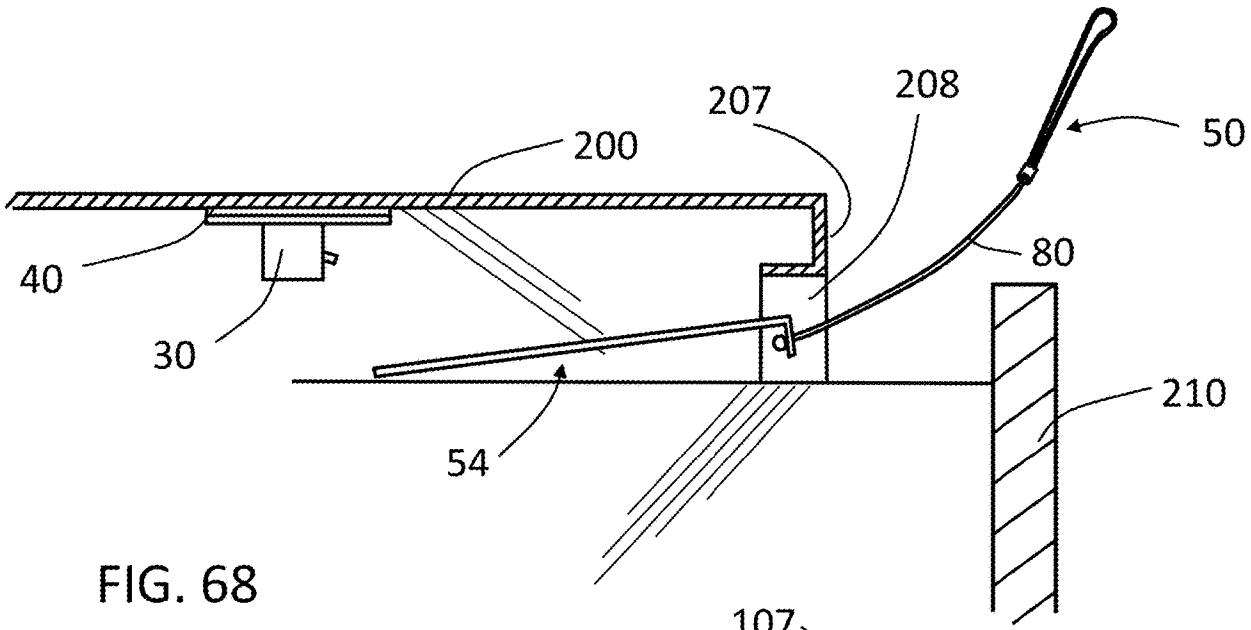
FIG. 68 shows a sectional view of FIG. 67.
Figure 69:
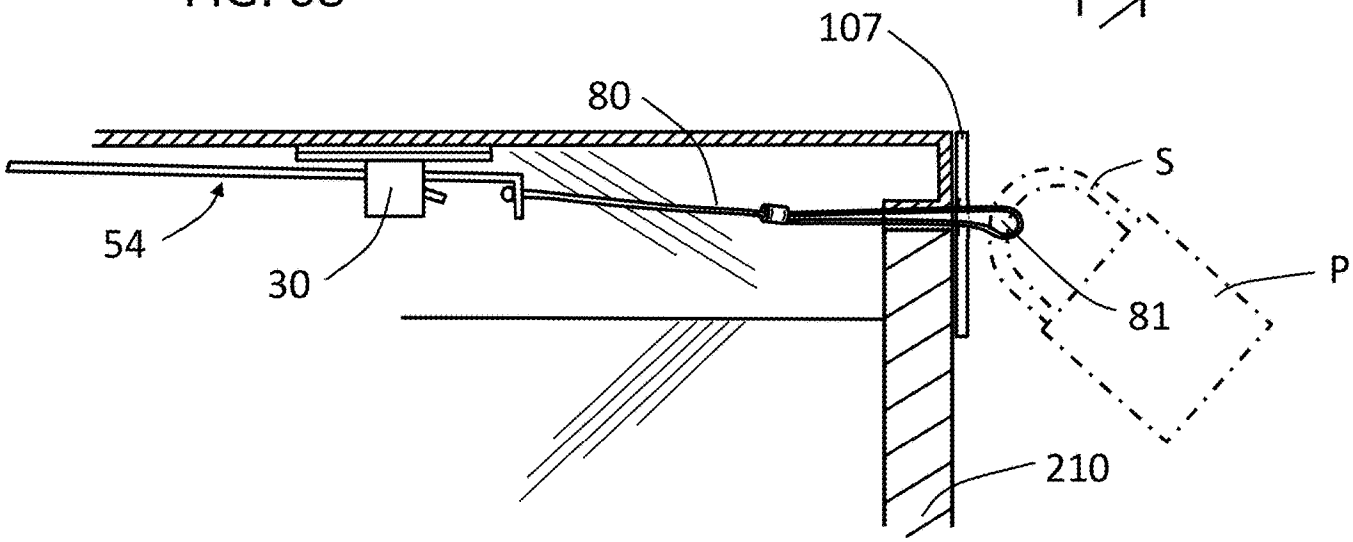
FIG. 69 shows the extending closure member of FIG. 36, attached and locked using the shield plate of FIG. 24 and a padlock, to the file cabinet with the file drawer closed.

FIGS. 67-69 show a tamper-evident securement device used in a file cabinet. FIG. 67 shows a first type or style of file cabinet comprising a main drawer disposed within a main drawer opening, an upper edge of the main drawer opening comprising a vertical outer wall having a lower edge and a lower horizontal wall of a wall thickness extending perpendicularly from the lower edge interiorly to the drawer opening. FIG. 68 shows a sectional view through lines 41-41 of FIG. 67, of a first type or style of file cabinet. Additional details of file cabinets having file drawers that can employ the tamper-evident securement devices of the present invention are disclosed in International Publication WO 2014/152711, filed Mar. 14, 2014, the disclosure of which is incorporated by reference in its entirety. The device is useful for securing closed the drawer of both types of file cabinets.

In FIGS. 68 and 69, an extending closure member 50 is used for the first style of file cabinet. This file cabinet comprises a top exterior face 200, a front cabinet surface 207 having a file drawer opening 208, and a file drawer 210 disposed and movable horizontally and rearwardly within the file drawer opening 208. FIG. 68 shows the file drawer 210 in the open position, allowing a user to install the extending closure member 50. After the securement member including the locking head 30 is installed with adhesive attachment 40 to an underside of the top exterior face 200, the attaching portion 54 is positioned within the opened file drawer 210 and inserted into the locking head 30. As described in detail hereinbefore, the attaching portion 54 is pushed through the locking head 30 with the distal end of the loop of the cable maintained just outside the cabinet opening 208, until the cable 80 is taut. The file drawer 210 is then closed into the file drawer opening 208, as shown in FIG. 69, and a shackle S of a padlock P is inserted through the loop 81. The locked device shown in FIG. 69 also comprises a shield plate 107, which is described in earlier devices.

Figure 70:
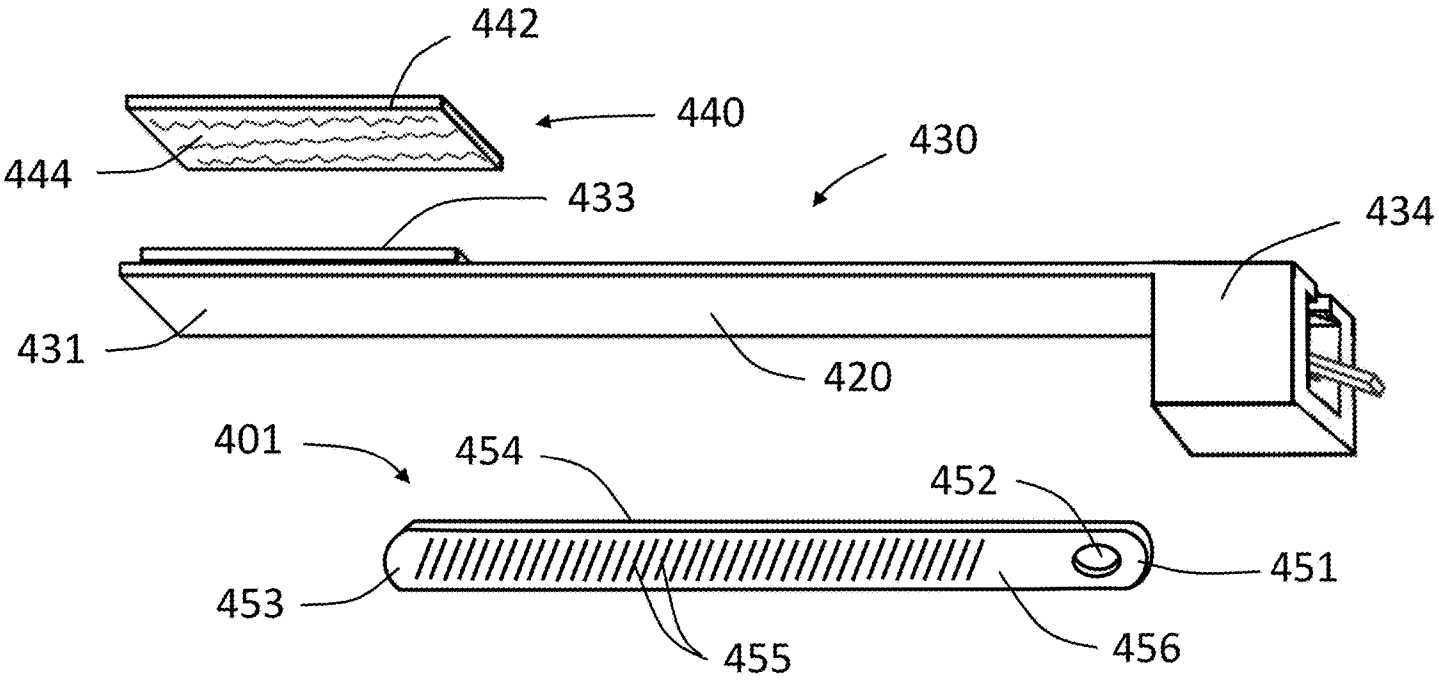
FIG. 70 shows a securement device with an extended fastener base comprising a locking head and an extending closure member shorter than the fastener base.

Another tamper-evident securement device comprises: 1) a flexible extended securement member and 2) a flexible extending closure member, wherein, compared to the first embodiment, the extended securement member is relatively more extended while the extending closure member is relatively shorter, as shown in FIG. 70. The securement member in FIG. 70 comprises an attachment base 440 and an elongated fastener base 430, wherein a fastener section 431 and a locking head 434 are separated by a lengthy body section 420, and wherein the fastener section 431, the body section 420, and the locking head 434 are preferably all integrally molded in one piece. The attachment base 440 comprises a dorsal adhesive surface 442 for adhering to the inner surface of the top side of the furniture, and a ventral surface 444 comprising either the hook elements or the loop elements for a mechanical attachment with the fastener section 431 which comprises the complementary hook elements or hook elements 433. The adhesive surface 442 can be covered with a release paper, which is removed prior to securing the attachment base 440 to the inner surface of the furniture. The locking head 434 has the same configuration as the locking head 34 in FIG. 7. The corresponding flexible extending closure member 401 has a similar shape and construction as the flexible extending closure member 101 in FIG. 14, but can be shorter than the extending closure member 101, wherein the extending closure member 401 similarly comprises a flexible attaching portion 454 comprising a plurality of serrations 455 and a distal end section 453, and a locking portion 456 having universal flexibility to traverse the furniture's interior and through the gap between the drawer and drawer opening for any type of furniture and a distal end section 451 which can have a rounded end, and a hole or aperture 452 through which a lock device, such as a shackle of a padlock, can be inserted.

Figure 71:
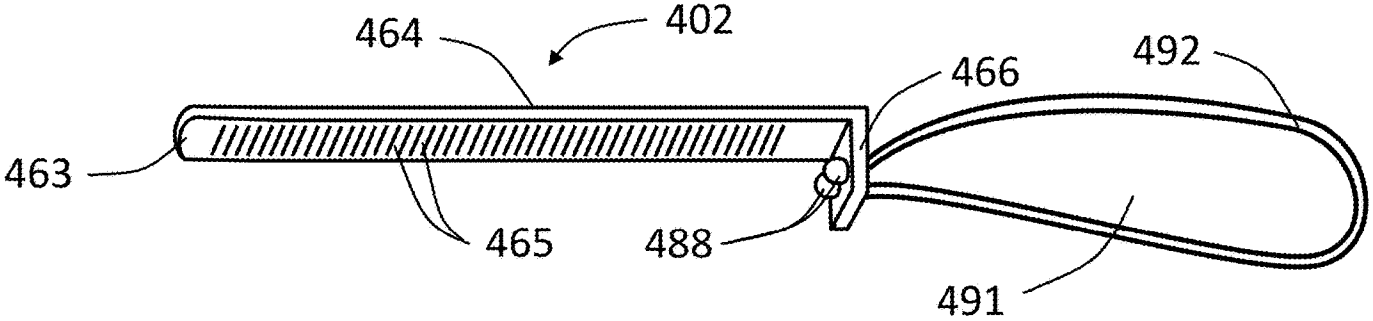
FIG. 71 shows another extending closure member for use with the tamper-evident securement device of FIG. 70.

FIG. 71 shows an alternative flexible extending closure member 402 for use with the securement member of FIG. 70. The flexible extending closure member 402 is a shorter version of the extending closure member 51 of FIG. 34, of the second embodiment, wherein the two legs 488 of the cable are fixed to an end plate 466 by different non-limiting fashions as illustrated hereinabove.

Figures 72, 73, 74:
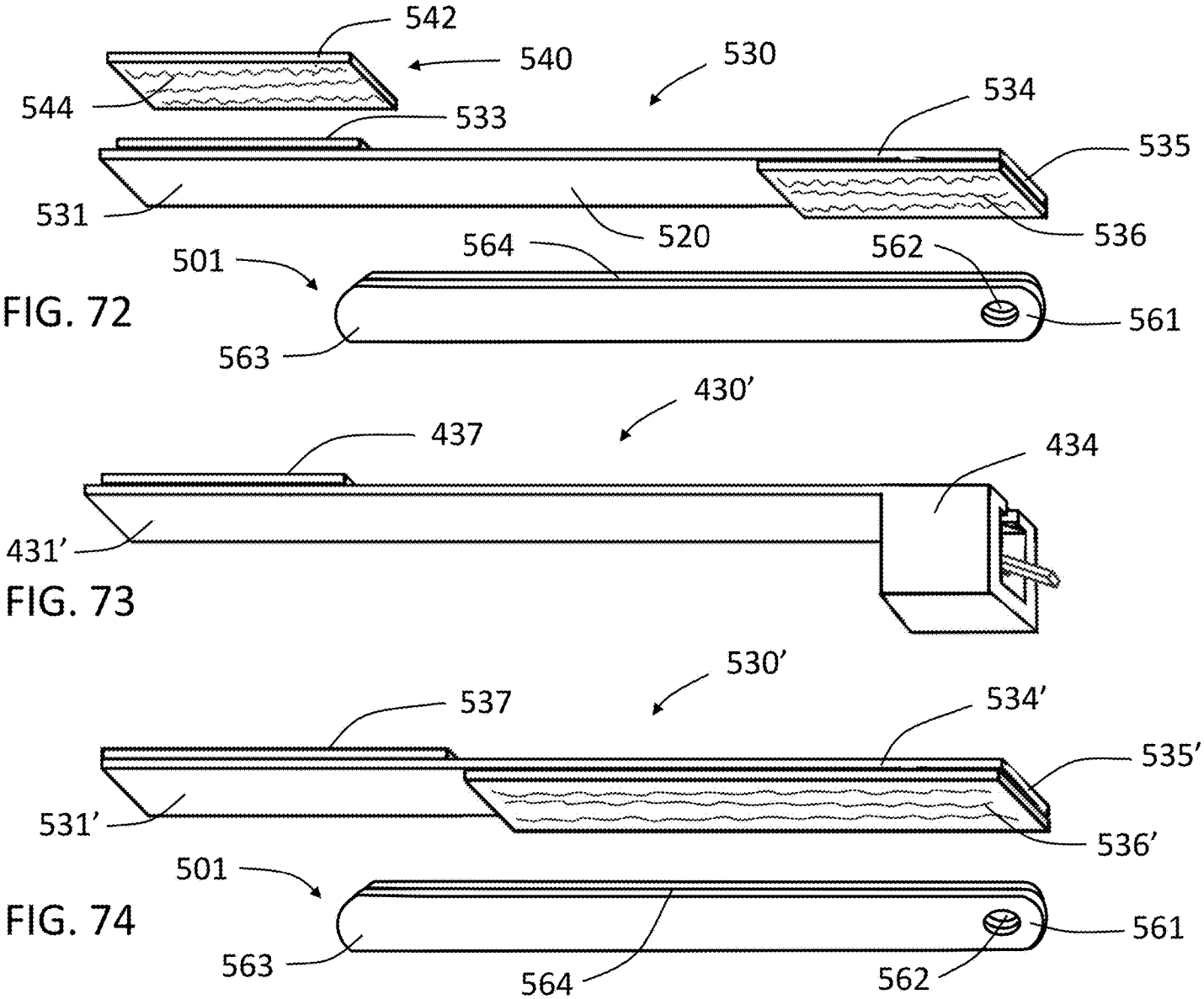
FIG. 72 shows an alternative tamper-evident securement device to that of FIG. 70, wherein the extending closure member attaches to the securement member by a hook-and-loop mechanism.
FIG. 73 shows an alternative extended securement member to that of FIG. 70 comprising an adhesive layer for a direct adhesion to the inner surface of the top side of the furniture.
FIG. 74 shows an alternative extended securement member to that of FIG. 72 comprising an adhesive layer for a direct adhesion to the inner surface of the top side of the furniture.

FIG. 72 shows another tamper-evident securement device comprising: 1) a flexible extended securement member and 2) a flexible extending closure member, as compared to the tamper-evident securement device of the third embodiment. The extended securement member comprises an attachment base 540 and an elongated fastener base 530. The attachment base 540 comprises an adhesive surface 542 for securing to an inner surface of the top side of the furniture, and a hook-and-loop mechanical fastener element 544 for a mechanical attachment to the fastener section 531 of the elongated fastener system 530 that comprises the complementary hook elements or loop elements 533. The elongated fastener base 530 comprises a hook-and-loop fastener element 533 on the dorsal surface of the distal end section 531 and a hook-and-loop fastener element 536 on the ventral surface of the proximal end section 534, with the distal end section 531 and the proximal end section 534 being linked by a body section 520, and the distal end section 531, body section 520, and the proximal end section 534 are all integrally molded in one extended strip. The proximal end section 534 ends with the proximal edge 535. The corresponding flexible extending closure member 501 has a similar shape to the flexible extending closure member 301 in FIG. 57, but can be appreciably shorter than extending closure member 301, and a hook-and-loop fastener element 564 can span the entire dorsal surface of the body 563 of the extending closure member 501.

FIG. 73 shows another tamper-evident securement device to that of FIG. 70, wherein the dorsal surface of the fastener section 431' of the elongated fastener base 430' comprises an adhesive layer 437 serving in place of a separate attachment base, for a direct adhesion of the fastener section 431' to the inner surface 11*i* of the top side of the furniture, wherein the adhesive layer 437 can be covered with a release paper, which is removed prior to securing the fastener section 431' directly to the inside of the furniture.

Similarly, FIG. 74 shows another tamper-evident securement device to that in FIG. 72, wherein the dorsal surface of the fastener section 531' of the elongated fastener base 530' comprises an adhesive layer 537 for direct adhesion to the inner surface 11*i* of the top side of the furniture. Optionally, the adhesive layer 537 can be covered with a release paper, which is removed prior to securing the fastener section 531' directly to the inside of the furniture. The flexible extending closure member 501 is the same as the flexible extending closure member 501 in FIG. 72.

Figure 75:
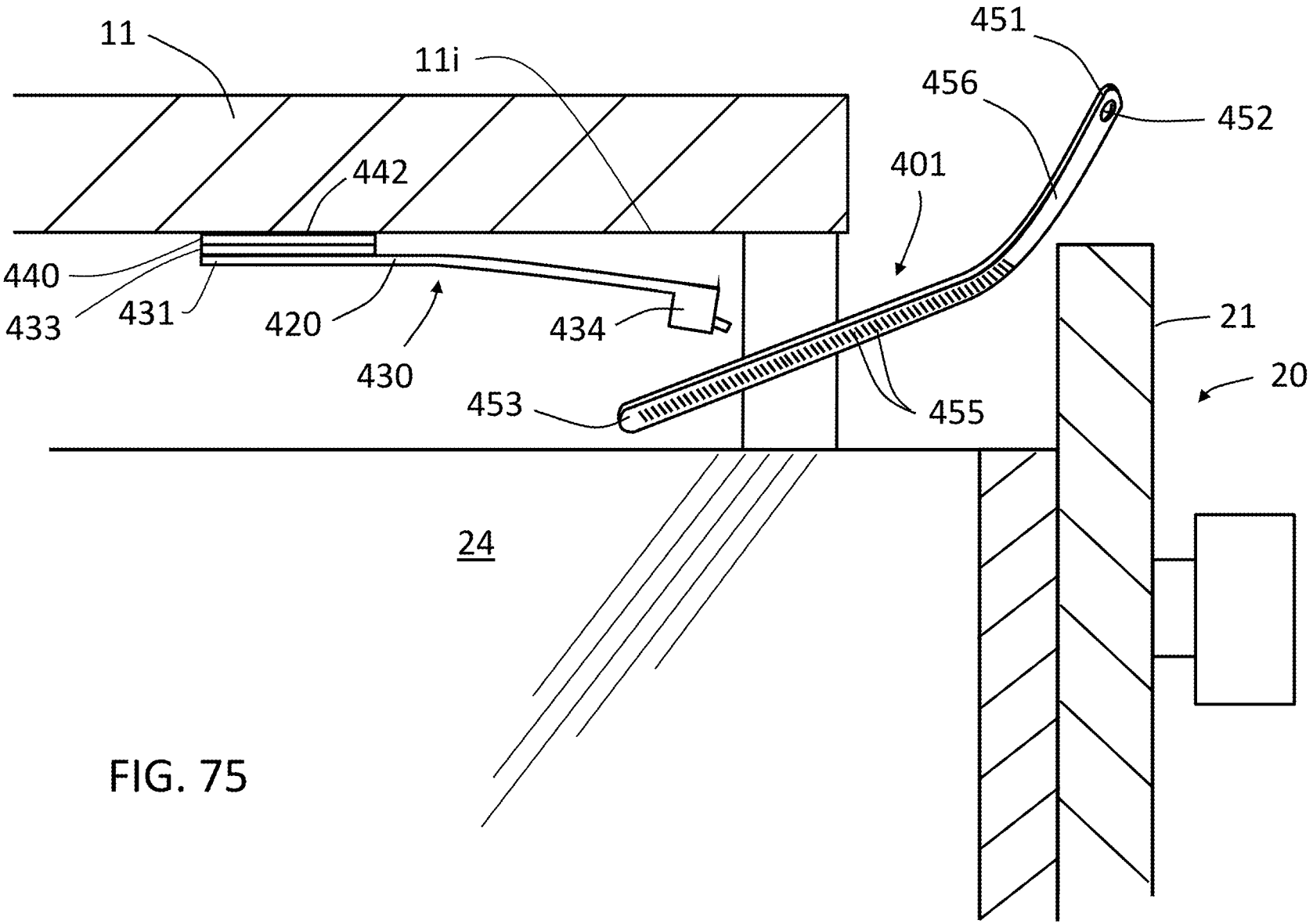
FIG. 75 shows the extending closure member of FIG. 70 being positioned for attachment to the extended securement member of FIG. 70, the extended securement member having been attached to an inner surface of the first type of furniture and drawer.
Figure 76:
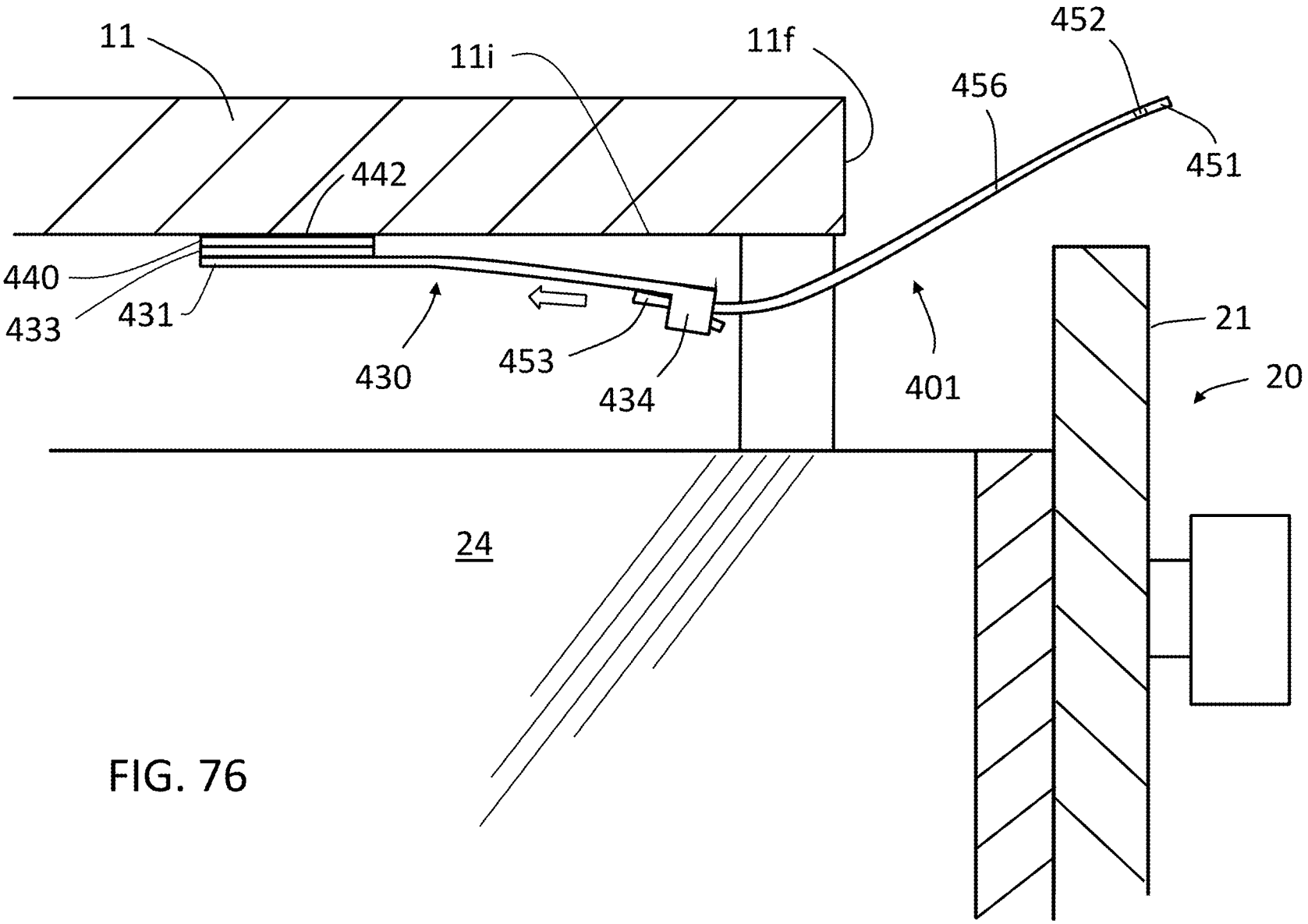
FIG. 76 shows a distal end section of the extending closure member of FIG. 70 inserted through the locking head of the securement member.

FIGS. 75 and 76 show a tamper-evident securement device comprising the flexible extending closure member 401, elongated fastener base 430, and attachment base 440 of FIG. 70, in the first type of furniture shown in FIG. 3. In FIG. 75 the attachment base 440 is pre-attached to the elongated fastener system 430 at the attachment base 431 via the hook-and-loop element 433. FIG. 75 shows the drawer 20 pulled open and the elongated fastener base 430 placed close to the inner surface 11*i* of the top side 11 of the furniture, such that the locking head 434 is close to the opening of the drawer 20, leaving a clearance of at least about 2 cm to the opening of the drawer 20 when the drawer 20 is closed. With the locking head 434 and the elongated fastener base 430 in place, the release paper is removed from the adhesive surface 442 of the attachment base 440, and the attachment base 440 and the attachment base 431 are pressed firmly upward together to be attached to the inner surface 11*i*.

With the drawer opened and elongated fastener base 430 secured inside the drawer, the user locks the drawer closed by inserting a distal end section 453 of the extending closure member 401 into the locking head 434 as shown in FIG. 76. The distal end section 451 of the locking portion 456 is held just outside the opening as the attaching portion 453 is pushed through the locking head 434 in the direction of the arrow until the extending closure member 401 is taut and the aperture 452 is substantially flush with the front face 11*f* of the top side 11 of the furniture, to be ready for insertion of a shackle of a padlock when the drawer 20 is closed. The step of pulling taut can be conveniently assisted by a withdrawing implement 150 (as shown in FIG. 19). Then a shackle of a padlock is passed through the aperture 452, positioned next to the face 21 of the drawer, with minimal wiggle space for pulling open the drawer, to close the drawer 20 with tamper-evident securement. Preferably a shield plate 107 can be used for protection of the front face 21 of the drawer, wherein distal end section 451 is passed through a slot 106 of the shield plate 107, possibly using a molded wire implement 180 that threads through the slot 106 of the shield plate and pulls the distal end section 451 with it, with the distal end section 451 exposed sufficiently for attachment of the shackle (S) of the locking means (P).

Figure 77:
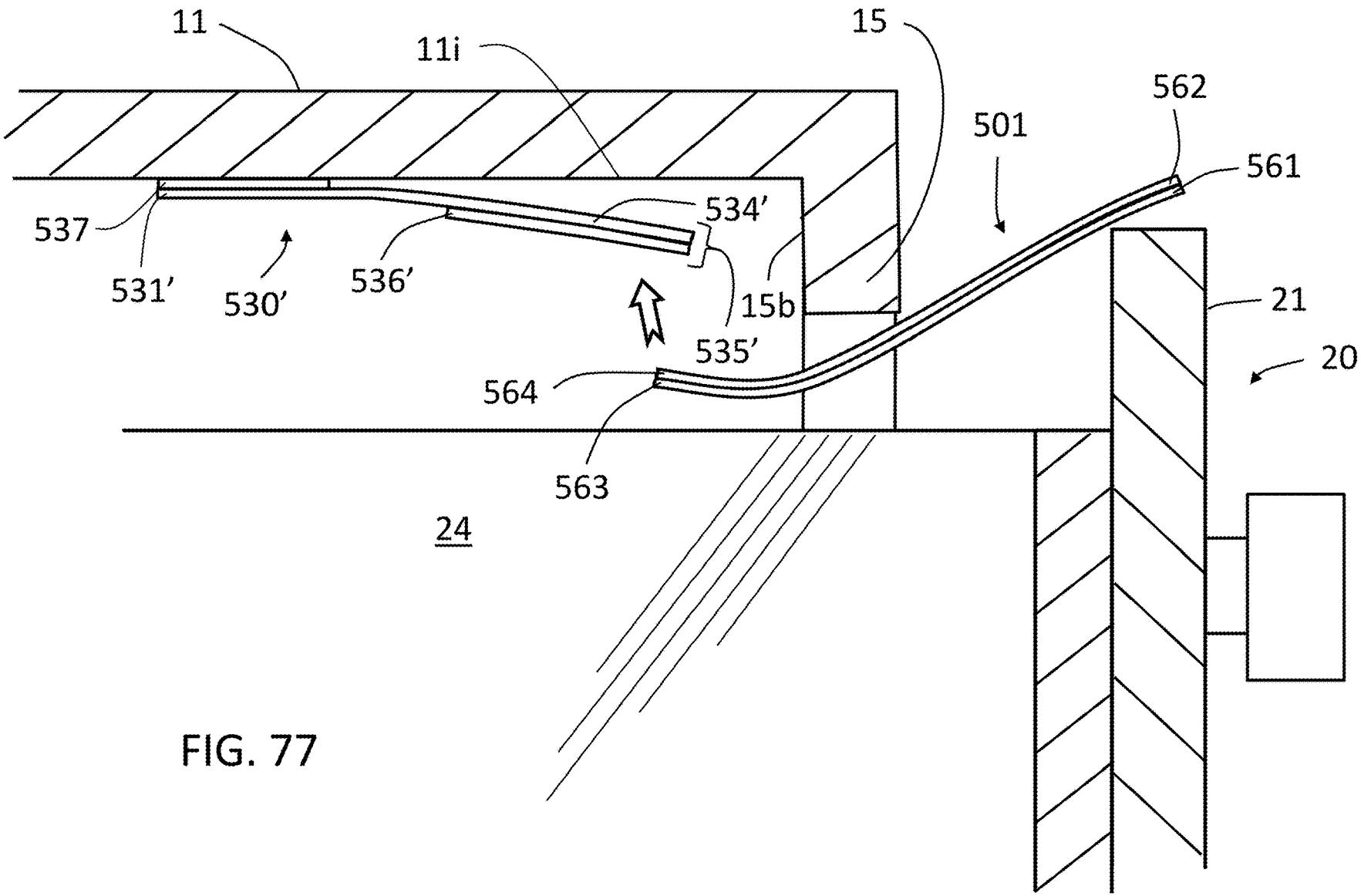
FIG. 77 shows the extending closure member of FIG. 74 being positioned for attachment to the extended securement member of FIG. 74, the extended securement member having been attached to an inner surface of the fourth type of furniture and drawer.
Figure 78:
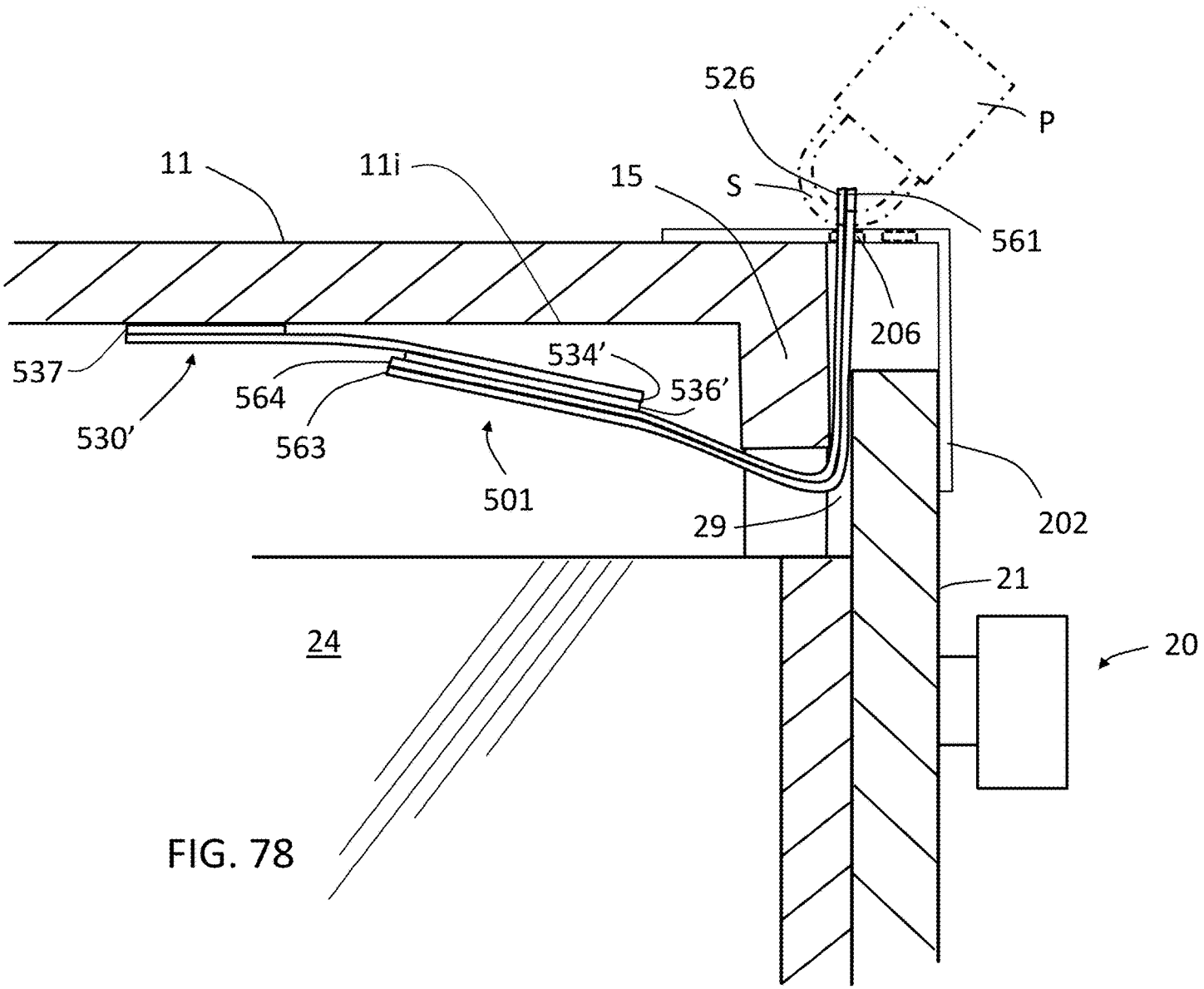
FIG. 78 shows the extending closure member of FIG. 77 attached to the securement member with the drawer closed. The shield plate of FIG. 25 is used with a lock device comprising a padlock.

FIGS. 77 and 78 show another tamper-evident securement device comprising a flexible extending closure member 501 and an elongated fastener base 530' as shown in FIG. 74, for the fourth type of furniture shown in FIG. 6. In this case, since an attachment base is not needed because the adhesive layer 537 of the elongated fastener base 530' has the function of an attachment base. FIG. 77 shows the drawer 20 pulled open and the elongated fastener base 530' placed close to the inner surface 11*i*, and arranged such that the proximal edge 535' is placed close to the opening of the drawer 20 but still leaving a clearance of at least about 2 cm away from the back side 15*b* of the top rail 15. With the elongated fastener base 530', a release paper is removed from the adhesive surface 537 and the distal end section 531' of the elongated fastener base 530' is pressed firmly upward to the inner surface 11*i*. The flexible extending closure member 501 is oriented in a manner wherein the hook-and-loop fastener element 564 faces to be attached to the hook-and-loop fastener element 536' of the elongated fastener system 530'. Before the attachment of the two hook-and-loop fastener elements 536' and 564, the distal end section 561 is pulled taut through the gap 29 between the drawer 20 and the furniture such that only the hole or aperture 562 of the distal end section 561 emerges through a slot 206 of the vertical portion 202 of an angled shield plate 201 (of FIG. 25). As the distal end section 561 is kept in that position, the hook-and-loop fastener element 564 of the flexible extending closure member 501 is firmly pressed to attach to the hook-and-loop fastener element 536' of the elongated fastener base 530' in the direction of the arrow.

FIG. 78 shows the tamper-evident securement device of FIG. 77 inside the closed drawer. The distal end section 561 of the flexible extending closure member 501 is pulled taut through the gap 29 between the drawer 20 and the furniture, and through a slot 206 of the planar portion 202 of an angled shield plate 201 (of FIG. 25) being oriented in a horizontal direction on a top exterior face 11*t* of the furniture, and the shackle S of a padlock P is guided through the aperture 562 to secure the locking of the drawer to the furniture. The lock device completes the tamper-evident securement of the drawer 20, with minimal wiggle space for pulling open the drawer.

Figure 88:
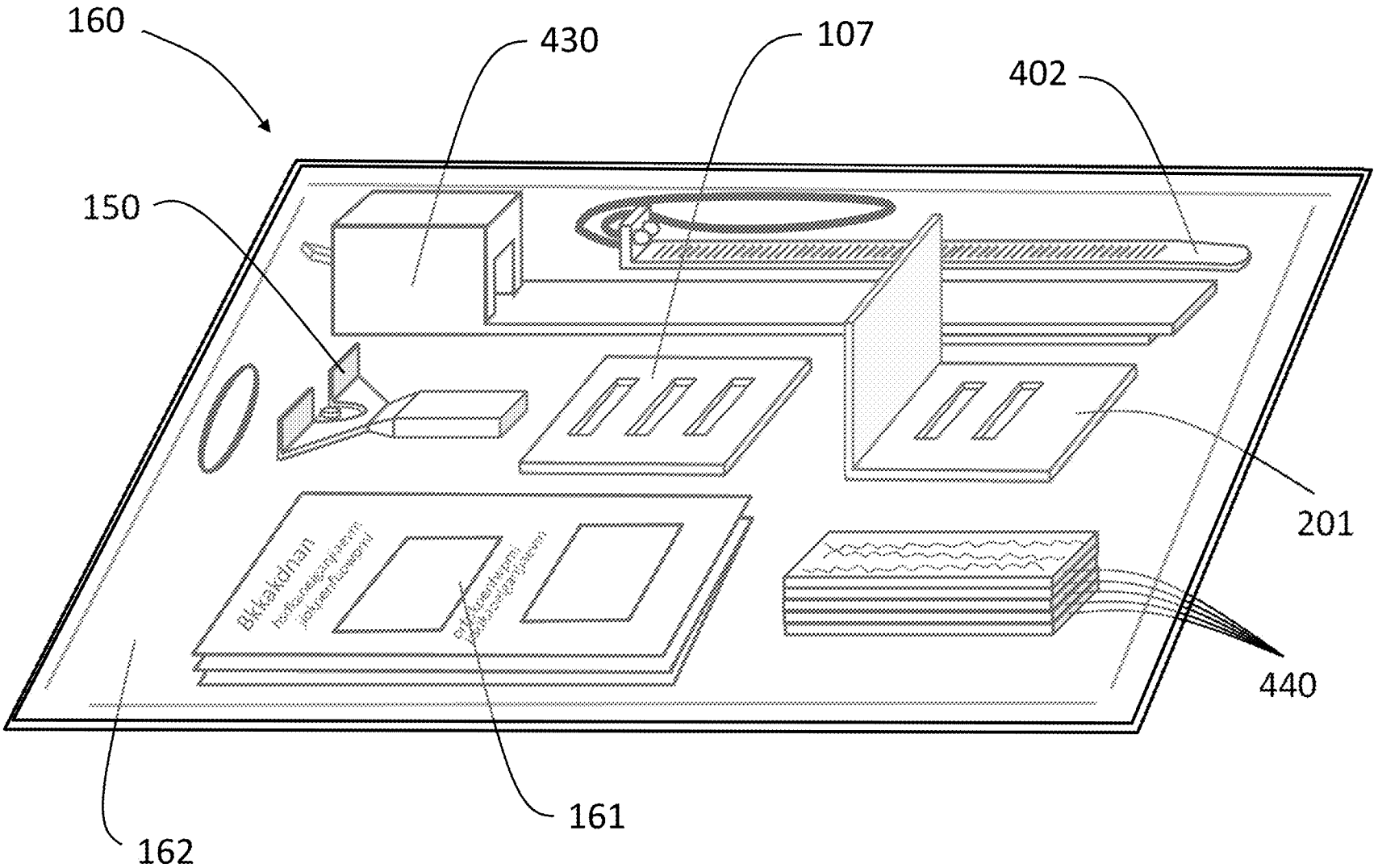
FIG. 88 shows an article of manufacture comprising a securement member, an extending closure member, several attachment bases, implement, a planar shield plate, an angled shield plate, instructions for use, and packaging.

An article of manufacture 160 can comprise a tamper-evident securement device. In FIG. 88 the tamper-evident securement device is shown comprising an elongated fastener base 430, and one or more securement bases 440 of FIG. 70, an extending closure member 402 of FIG. 71, a locking-end-section withdrawing implement of FIG. 19, a planar shield plate of FIG. 24, an angled shield plate of FIG. 25, and an implement 150 of FIG. 50. All items are packaged in association with instructions 161 for use by a consumer of the securing device with furniture, for securing closed a drawer of the furniture using the securement device. The instructions direct the consumer to attach a securement member comprising at least a fastener base to an inner surface of a furniture having a drawer, to insert an attaching portion of the extending closure member, and to close and secure the drawer in the furniture, and optionally to remove and store the securement device when not in use. The instructions may be in the form of a suitable media, such as paper, video, or a hyperlink to an Internet web site, and may further include frequently asked questions or interactive feedback. The article of manufacture can comprise more than one securement bases 440 so to allow the reuse the tamper-evident securement device in other furnitures. The article of manufacture also comprises a suitable packaging for other items, illustrated as a cardboard placard and a transparent plastic film 162 that is attached or sealed around the edges. Other suitable packaging materials can be used.

It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

We claim:

1. A tamper-evident securement device for use in securing closed a drawer of a furniture, and is not built into or integral with the drawer or the furniture, comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture, wherein the securement member comprises a mechanical fastener system comprising a fastener base and a substantially planar attachment base attached to the fastener base that attaches the extending closure member to the inner surface of the top side of the furniture;

wherein a lock device can be inserted through the aperture of the flexible locking portion; and wherein the attaching portion is adjustably and removably secured on the securement member at one of a plurality of positions on the attaching portion relative to the securement member.

2. The device according to claim 1, wherein the fastener base comprises a ventral surface selected from the group of: a plurality of hook elements; a plurality of loop elements; and a locking head comprising an opening to a passage and a locking tab disposed in the passage; and the attaching portion comprises one of:

a dorsal surface selected from the group of a plurality of hook elements or a plurality of loop elements; or a ventral surface comprising a plurality of serrations; such that the ventral surface of the fastener base complements the dorsal surface or the ventral surface of the attaching portion.

3. The device according to claim 2, wherein the ventral surface of the fastener base comprises a locking head comprising an opening to a passage and a locking tab disposed in the passage, wherein the locking tab is hingedly attached to the locking head, and comprises one or more transversely-arranged teeth that partially extend into the passage, to ratchetingly engage the serrations of the attaching portion, and further comprises a lever extending from the locking tab that can manually pivot the locking tab away from the passage and move the one or more teeth out of ratcheting engagement with the serrations of the attaching portion.

4. The device according to claim 1, wherein the attachment base comprises a dorsal surface comprising at least one adhesive layer that attaches the attachment base to the inner surface of the top side of the furniture; and a ventral surface selected from the group of: a plurality of hook elements wherein the dorsal surface of the fastener base has a plurality of loop elements, a plurality of loop elements wherein the dorsal surface of the fastener base has a plurality of hook elements, a magnetic substrate, and at least one adhesive layer.

5. The device according to claim 1, wherein the flexible locking portion is an elongated approximately planar portion comprising the distal end section comprising the aperture through which the lock device can be inserted.

6. The device according to claim 5, further comprising a shield plate having one or more slot openings through which the flexible locking portion can extend, wherein the shield plate has one or both of:

a planar shape, or an angled shape.

7. The device according to claim 1, further comprising a shield plate having one or more slot openings through which the flexible locking portion can extend, wherein the shield plate has one or both of:

a planar shape, or an angled shape.

8. The device according to claim 1, further comprising a combination implement comprising:

a) an aperture-withdrawing implement at an aperture-withdrawing end;

b) at a middle portion, a handle; and c) a retracting implement at a retracting end.

9. The device according to claim 1, wherein the lock device comprises a padlock comprising a shackle that passes through the aperture of the flexible locking portion.

10. A tamper-evident securement device for use in securing closed a drawer of a furniture, and is not built into or integral with the drawer or the furniture, comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture;

wherein a lock device can be inserted through the aperture of the flexible locking portion, wherein the flexible locking portion is an extended flexible cable comprising a proximal end section, a body section and the distal end section, wherein both the proximal end section and the distal end section of the extended flexible cable are fixed to the attaching portion, and the body section of the cable forms a loop through which the lock device can be inserted.

11. The device according to claim 10, further comprising a shield plate having one or more slot openings through which the flexible locking portion can extend, wherein the shield plate has one or both of:

a planar shape, or an angled shape.

12. A tamper-evident securement device for use in securing closed a drawer of a furniture, and is not built into or integral with the drawer or the furniture, comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture;

a securement member disposed within the furniture that attaches the extending closure member to an inner surface of a top side of the furniture, and an aperture-withdrawing implement comprising a planar body comprising a handle at one edge, a raised cylindrical receptor to removably engage the aperture, and a semicircular depression surrounding the raised cylindrical receptor to accommodate the distal end section, wherein one or more planar supports are disposed perpendicularly to and extending laterally from an opposite edge of the planar body, wherein the one or more planar supports can be temporarily pressed flush against a front face or a top face of the furniture;

wherein a lock device can be inserted through the aperture of the flexible locking portion.

13. A tamper-evident securement device for use in securing closed a drawer of a furniture, and is not built into or integral with the drawer or the furniture, comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture;

a securement member disposed within the furniture that attaches the extending closure member to an inner surface of a top side of the furniture, and a retracting implement comprising a handle, a raised arched hook, a depression surrounding the raised arched hook, and a shield-housing portion proximate to the raised arched hook and the depression surrounding the raised arched hook, wherein the depression surrounding the raised arched hook accommodates the distal end section and the raised arched hook can removably engage the aperture;

wherein a lock device can be inserted through the aperture of the flexible locking portion.

14. The device according to claim 13, further comprising a shield plate having one or more slot openings through which the flexible locking portion can extend, wherein the shield plate has one or both of:

a planar shape, or an angled shape.

15. A method for deterring unauthorized access to a drawer in a furniture employing a tamper-evident securement device for use in securing closed a drawer of a furniture that is not built into or integral with the drawer or the furniture, the device comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture;

wherein a lock device can be inserted through the aperture of the flexible locking portion, the method comprising the steps of:

a) with the drawer open, temporarily pressing and maintaining the flexible locking portion against an upper edge of a drawer opening or a front face of the furniture, such that the aperture is disposed just outside the drawer opening;

b) extending the attaching portion into and past the drawer opening while maintaining the flexible locking portion against the upper edge or the front face, until the flexible extending closure member is taut;

c) firmly attaching the attaching portion to an inner surface of a top side of the furniture using a securement member, while maintaining the flexible extending closure member taut and maintaining the flexible locking portion against the upper edge or the front face;

d) releasing the flexible locking portion from the pressing against the upper edge or the front face;

e) closing the drawer within the drawer opening while maintaining the aperture just outside of the drawer opening; and f) inserting a lock device through the aperture.

16. The method of claim 15, wherein the closing the drawer within a drawer opening further comprises:

i) engaging the aperture with a retracting implement;

ii) gently pulling the retracting implement to maintain the aperture just outside the drawer opening;

iii) closing the drawer within the drawer opening; and iv) sliding a slot of a shield plate across the retracting implement until the shield plate is flush with the drawer opening.

17. A method for deterring unauthorized access to a drawer in a furniture employing a tamper-evident securement device for use in securing closed a drawer of a furniture that is not built into or integral with the drawer or the furniture, the device comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture;

wherein a lock device can be inserted through the aperture of the flexible locking portion, the method comprising the steps of:

a) with the drawer open, temporarily pressing and maintaining a planar support of an aperture-withdrawing end of at least one implement against a front face of the furniture or a top exterior face of the furniture, such that the aperture is disposed at a position outside the furniture;

b) extending the attaching portion into and past the drawer opening while maintaining the planar support against the front face or the top exterior face, until the flexible extending closure member is taut;

c) firmly attaching the attaching portion to an inner surface of a top side of the furniture using a securement member, while maintaining the flexible extending closure member taut and maintaining the planar support against the front face or the top exterior face;

d) disengaging the aperture-withdrawing end of the at least one implement from the aperture;

e) engaging the aperture with a retracting end of the at least one implement;

f) gently pulling taut the retracting end to maintain the aperture at the same position outside the furniture as when maintained by the aperture-withdrawing end;

g) closing the drawer within the drawer opening;

h) sliding a slot of a shield plate across the retracting end until the shield plate is flush with at least one surface of the drawer;

i) inserting a lock device through the aperture; and j) disengaging the retracting end of the at least one implement from the aperture.

18. A method for deterring unauthorized access to a drawer in a furniture employing a tamper-evident securement device for use in securing closed a drawer of a furniture that is not built into or integral with the drawer or the furniture, the device comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture;

wherein a lock device can be inserted through the aperture of the flexible locking portion, the method comprising the steps of:

a) with the drawer open, attaching a securement member of the device to an inner surface of a top side of the furniture;

b) while temporarily maintaining the aperture just outside a drawer opening, extending the attaching portion into and past the drawer opening;

c) removably securing the attaching portion on the securement member at one of a plurality of positions on the attaching portion relative to the securement member, using a mechanical fastener system of the securement member, until the extending closure member is taut, while maintaining the aperture just outside the drawer opening;

d) closing the drawer within a drawer opening while maintaining the aperture just outside of the drawer opening; and e) inserting a lock device through the aperture.

19. The method of claim 18, wherein the step c) further comprises adjusting the attaching portion on the securement member, by securing the attaching portion on the securement member at a second position on the attaching portion relative to the securement member, such that the aperture is just outside the drawer opening.

20. A method for deterring unauthorized access to a drawer in a furniture employing a tamper-evident securement device for use in securing closed a drawer of a furniture that is not built into or integral with the drawer or the furniture, the device comprising:

a flexible extending closure member comprising:

an at least partially flexible attaching portion disposed within the furniture, and a flexible locking portion comprising a distal end section that traverses a gap between the drawer and a drawer opening when the drawer is closed, and provides an aperture that is disposed outside the furniture; and a securement member disposed within the furniture that attaches the extending closure member to an inner surface of a top side of the furniture;

wherein a lock device can be inserted through the aperture of the flexible locking portion, the method comprising the steps of:

a) with the drawer open, attaching a securement member of the device to an inner surface of a top side of the furniture;

b) while temporarily pressing and maintaining a planar support of an aperture-withdrawing end of at least one implement against a front face of the furniture or a top exterior face of the furniture, extending the attaching portion into and past a drawer opening;

c) removably securing the attaching portion on the securement member at one of a plurality of positions on the attaching portion relative to the securement member, using a mechanical fastener system of the securement member, until the extending closure member is taut with the aperture disposed at a position outside the furniture, while maintaining the planar support against the front face or the top exterior face;

d) disengaging the aperture-withdrawing end from the aperture;

e) engaging the aperture with a retracting end of the at least one implement;

f) gently pulling taut the retracting end to maintain the aperture at the same position outside the furniture as when maintained by the aperture-withdrawing end;

g) closing the drawer within the drawer opening;

h) sliding a slot of a shield plate across the retracting end until the shield plate is flush with at least one surface of the drawer;

i) inserting a lock device through the aperture; and j) disengaging the retracting end from the aperture.

* * * * *